US010711416B2

(12) United States Patent
Glubrecht et al.

(10) Patent No.: US 10,711,416 B2
(45) Date of Patent: Jul. 14, 2020

(54) ROADWAY SWEEPER WITH MULTIPLE SWEEPING MODES

(71) Applicant: Schwarze Industries, Inc., Huntsville, AL (US)

(72) Inventors: Dale D. Glubrecht, Madison, AL (US); Brian Giles, New Market, AL (US); Felix W. Crunk, III, Meridianville, AL (US); Ronald J. Schrimsher, Grant, AL (US); Sean H. Howley, Huntsville, AL (US); Jared N. Berke, Huntland, TN (US); John D. Madderra, Helena, AL (US)

(73) Assignee: Schwarze Industries, Inc., Hunstville, AL (US)

( * ) Notice: Subject to any disclaimer, the term of this patent is extended or adjusted under 35 U.S.C. 154(b) by 274 days.

(21) Appl. No.: 15/952,929

(22) Filed: Apr. 13, 2018

(65) Prior Publication Data

US 2018/0298573 A1 Oct. 18, 2018

Related U.S. Application Data

(60) Provisional application No. 62/485,879, filed on Apr. 14, 2017, provisional application No. 62/503,923,
(Continued)

(51) Int. Cl.
*E01H 1/08* (2006.01)
*B08B 1/00* (2006.01)
(Continued)

(52) U.S. Cl.
CPC ..... *E01H 1/0845* (2013.01); *A46B 13/00* (2013.01); *A46B 13/008* (2013.01); *B08B 1/002* (2013.01);
(Continued)

(58) Field of Classification Search
CPC ..... A46B 13/00; A46B 13/008; A46B 2200/3066; B08B 1/002; B08B 1/04;
(Continued)

(56) References Cited

U.S. PATENT DOCUMENTS 1,407,180 A * 2/1922 Todd ..... E01H 1/045 15/87
2,972,159 A 2/1961 Swanson et al.
(Continued)

FOREIGN PATENT DOCUMENTS

CA 3042127 A1 * 5/2018 ..... E01H 1/0845
DE 4128988 A1 * 3/1993 ..... E01H 1/053
(Continued)

OTHER PUBLICATIONS

International Search Report and Written Opinion issued in corresponding PCT application No. PCT/US2018/027494 dated Sep. 19, 2018 (30 pages).
(Continued)

*Primary Examiner* — Marc Carlson
(74) *Attorney, Agent, or Firm* — Pizarro Allen PC

(57) ABSTRACT

A roadway or pavement sweeper with multiple sweeping modes for the removal of debris from a swept surface may, in some embodiments, include a sweeper vehicle having a pair of side-brooms independently movable between a retracted and extended position for sweeping debris into an area therebetween and at least one material-transfer broom to sweep a portion of the debris accumulated between the side-brooms as the vehicle moves in its direction of travel. A fan-driven suction-inlet may be provided at or adjacent each side of the vehicle. The at least one material-transfer broom may rotate in a first or other direction to transfer
(Continued)

debris for entrainment into a selected suction-inlet for transfer to a debris hopper. Other embodiments are also described.

16 Claims, 31 Drawing Sheets

Related U.S. Application Data filed on May 9, 2017, provisional application No. 62/505,973, filed on May 14, 2017.

(51) Int. Cl.

| | |
|---|---|
| ***B08B 1/04*** | (2006.01) |
| ***B08B 5/04*** | (2006.01) |
| ***A46B 13/00*** | (2006.01) |
| ***F04D 17/16*** | (2006.01) |
| *F04D 25/08* | (2006.01) |

(52) U.S. Cl.
CPC ..... *B08B 1/04* (2013.01); *B08B 5/04* (2013.01); *F04D 17/168* (2013.01); *A46B 2200/3066* (2013.01); *E01H 2001/0881* (2013.01); *F04D 25/08* (2013.01)

(58) Field of Classification Search
CPC . B08B 5/04; E01H 1/0845; E01H 2001/0881; F04D 17/168; F04D 25/08
See application file for complete search history.

(56) References Cited

U.S. PATENT DOCUMENTS

| | | | | |
|---|---|---|---|---|
| 3,886,623 | A | 6/1975 | Landesman et al. | |
| 3,886,624 | A | 6/1975 | Landesman et al. | |
| 4,490,874 | A | 1/1985 | Duncan | |
| 4,571,771 | A * | 2/1986 | Worwa | A47L 9/19 15/319 |
| 4,831,684 | A * | 5/1989 | Duncan | A47L 11/283 15/340.1 |
| 6,041,471 | A * | 3/2000 | Charky | A47L 11/24 15/320 |
| 6,195,837 | B1 * | 3/2001 | Vanderlinden | E01H 1/042 15/340.3 |
| 9,353,492 | B1 * | 5/2016 | Stell | E01H 1/042 |
| 9,783,942 | B1 * | 10/2017 | Stell | E01H 1/056 |
| 2007/0124892 | A1 * | 6/2007 | Adair | E01H 1/0854 15/340.3 |
| 2012/0192377 | A1 * | 8/2012 | Stell | B01D 46/0009 15/347 |

FOREIGN PATENT DOCUMENTS

| | | | | |
|---|---|---|---|---|
| EP | 1061180 | A1 * | 12/2000 | E01H 1/053 |
| EP | 1061180 | A1 | 12/2000 | |
| GB | 2246381 | A * | 1/1992 | E01H 1/0845 |
| KR | 20100086614 | A * | 8/2010 | |
| KR | 10-1103139 | B1 | 1/2012 | |
| WO | WO-2012003727 | A1 * | 1/2012 | E01H 1/0845 |
| WO | WO-2012088869 | A1 * | 7/2012 | E01H 1/0845 |
| WO | WO-2018196532 | A1 * | 11/2018 | E01H 1/05 |

OTHER PUBLICATIONS

Wayne Engineering Front Sweeper Broom Attachment, dated Oct. 14, 2011 (1 Page).
Chengli Special Automobile Co., Ltd. (CLW 5071TSL4 Road sweeper with side brooms), dated Jun. 3, 2015 (3 Pages).
Beam—The specialist range S9000-S14000, dated 2009 (12 Pages).

* cited by examiner

ROADWAY SWEEPER WITH MULTIPLE SWEEPING MODES

CROSS-REFERENCE TO RELATED APPLICATIONS

This application claims priority to and the benefit of U.S. Provisional Patent Application No. 62/485,879 filed Apr. 14, 2017; U.S. Provisional Patent Application No. 62/503,923 filed May 9, 2017; and U.S. Provisional Patent Application No. 62/505,973 filed May 14, 2017.

BACKGROUND

This section is intended to provide a background or context to the invention that is recited in the claims. The description herein may include concepts that could be pursued but are not necessarily ones that have been previously conceived or pursued. Therefore, unless otherwise indicated herein, what is described in this section is not prior art to the description and claims in this application and is not admitted to be prior art by inclusion in this section.

Various types of vehicles have been developed to sweep or vacuum debris from pavements, roadways, and streets. In general, these vehicles can be classified as mechanical broom sweepers, regenerative air sweepers, vacuum sweepers, and, in some cases, combinational variants thereof.

Mechanical broom sweepers use a motor-driven broom or brooms to mechanically sweep paper, plastic, litter, trash, vegetation (leaves, twigs, grass clippings, etc.), asphalt debris, concrete debris, and larger sand or gravel particles toward and onto a conveyor for transport into a debris collection hopper.

Regenerative air sweepers use a motor-driven fan to create a high-velocity recirculating air flow to entrain dust, particulates, and other debris from the pavement or street surface. The recirculating air flow may be passed through a debris container or hopper that includes various types of partitions, screens, and/or baffles that are designed to slow the airflow and cause the entrained debris to collect in the debris hopper.

Vacuum sweeper vehicles use a motor-driven fan to develop a sub-atmospheric pressure within the vehicle air flow pathway(s) so that ambient air at atmospheric pressure enters a suction-inlet or suction-inlets to create a suction effect to entrain debris into the air flow. The debris-entrained air flow may be delivered to the debris-collecting hopper where the debris may be separated from the air flow with the air flow being exhausted from the sweeper vehicle. Brooms are often used to move debris in the direction of the suction-inlet to improve sweeping efficiency. For example, a cylindrical tube broom may be aligned in a side-to-side alignment (or at a selected angle) in relationship to the direction of travel to move debris toward the suction-inlet.

Optionally, a side-broom (also known as a gutter broom) carried on a pivotally mounted arm may be mounted on one or both lateral sides of the sweeper vehicle to brush debris into the path of an intake hood (also known as a pick-up head).

While tube brooms may be effective where the road surface is flat, many streets and road surfaces have an irregular profile. For example, many road surfaces are intentionally crowned in the center of the roadway and may also have unintentional spaced-apart depressions caused by the front and rear tires of heavy vehicles. In these situations, a tube broom may efficiently sweep the raised surfaces but in some instances may be less effective or ineffective for sweeping the depressed areas. It is common for the tube broom to wear unevenly and often become tapered at one or both opposite ends (a condition known as "coning").

It would be a significant advancement in the art to provide an improved sweeper vehicle that may be more effective in sweeping road surfaces having a variety of different profiles.

SUMMARY

A sweeper vehicle having multiple sweeping modes may include a motor-driven rotatable side-broom on one side of the vehicle and another motor-driven rotatable side-broom on the other side of the vehicle, each side-broom independently movable between a retracted position and an extended position for sweeping debris into an area between the side-brooms. Each side-broom may be equipped with a broom tilt system (e.g., 1-6 degrees or so), which may be under control of a stored-program controlled microprocessor or other computer.

A debris suction-inlet may be provided on one side of the vehicle and another debris suction-inlet may be provided on the other side of the vehicle for suctioning debris from the surface being swept, which may generally be referred to as a roadway. As used herein, a roadway may be any type of surface on which a vehicle may travel, such as a street, road, highway, parking lot, parking garage, or airport runway, for example, which may or may not be paved with a material such as asphalt, concrete, pavers, bricks, cobblestones, or a combination thereof. Any reference herein to a specific type of roadway (e.g., a street, pavement, highway, or other type of surface) should be understood to mean any type of roadway. A motor-driven fan may create an air flow from one or the other, or both, of the debris suction-inlets for transporting debris entrained into the air flow through one, the other, or both, debris suction-inlets to a debris hopper, in which the entrained debris may be substantially separated from the air flow. Each debris suction-inlet may have an associated valve device operable to substantially close off the air flow through the associated debris suction-inlet and to open the air flow through the associated debris suction-inlet. A motor-driven material-transfer-broom or a plurality of such motor-driven material-transfer-brooms may be arranged to direct debris provided by one, the other, or both side-brooms into one, or the other, or both, of the suction-inlets.

In some embodiments, a sweeper vehicle may have a defined longitudinal axis $A_L$-$A_L$ that also may define a forward direction of travel. The longitudinal axis $A_L$-$A_L$ may or may not be coincident with a centerline of the vehicle. A first side-broom may be mounted to the vehicle on a first side of the axis $A_L$-$A_L$ and a second side-broom may be mounted to the vehicle on a second side of the axis $A_L$-$A_L$. Each side-broom may include a drive motor configured for rotating its respective side-broom in a selected direction to sweep debris into an area generally between the two side-brooms. Additionally, each side-broom may be mounted on a carrier structure and may be movable to and from a retracted position and an extended position and may be further movable between a lifted or "travel" position and a lowered position in engagement with the surface to be swept. A first debris suction-inlet may be provided on the first side of the longitudinal axis $A_L$-$A_L$ for suctioning debris from the surface being swept, and a second debris suction-inlet may be provided on the second side of the longitudinal axis $A_L$-$A_L$ for also suctioning debris from the surface being swept. In some embodiments, in lieu of or in addition to the first and second debris suction inlets, a debris suction-inlet may be provided on or about the longitudinal axis $A_L$-$A_L$ for suctioning debris from the surface being swept.

In some embodiments, a motor-driven fan may be provided to create an air flow through one or the other, or both, debris suction-inlets and direct that air flow into a debris hopper where the debris may be substantially separated from the air flow. Each debris suction-inlet may be operatively associated with a valving device selectively operable to substantially halt or stop air flow therethrough and to substantially open air flow therethrough for accepting debris.

In some embodiments, a cluster or array of at least three material-transfer brooms may be arranged in a transfer-broom array, which may include a primary, leading, or apex material-transfer broom having a motor for rotating the broom in a first or a second rotary direction. Two secondary or trailing material-transfer brooms may be positioned aft of the primary material-transfer broom. The secondary material-transfer brooms may be laterally spaced from each other with one secondary material-transfer broom positioned to brush debris to one side of the longitudinal axis $A_L$-$A_L$ and the other secondary material-transfer broom being positioned to brush debris to the other side of the longitudinal axis $A_L$-$A_L$. One of the secondary material-transfer brooms may include a motor configured for rotating the associated material-transfer broom in a first direction to brush debris toward one side of the vehicle, and the other secondary material-transfer broom may include a motor configured for rotating its broom in an opposite direction to brush debris toward the other side of the vehicle. Depending upon the sweeping mode, the primary or lead material-transfer broom may be rotatable in a direction to transfer all or a portion of the debris provided thereto by the side-brooms or debris on the surface being swept to one of the trailing material-transfer brooms for transfer toward and pick-up by one of the suction-inlets, or rotatable in an opposite rotary direction to transfer all or a portion of the debris provided thereto by the side-brooms or debris on the surface being swept toward the other secondary material-transfer broom to transfer debris to the other suction-inlet.

In a first operational state or mode of operation, sometimes referred to herein as the "right-side sweep" mode, the first side-broom may be positioned in its inward or retracted position and the second side-broom may be positioned in its extended or outward position. Each side-broom may be rotated by its respective motor to sweep debris into the area defined between the side-brooms, which may, depending upon the type of debris being swept, form a respective debris windrow.

As used herein, a windrow may be any collection of debris that remains on a roadway after a sweeping action of a broom, and a windrow may or may not take the form of a row or other defined shape. In this first mode of operation, the valve device associated with the first debris suction-inlet may be in its substantially closed position to substantially block or close air flow thereinto, and the valve device associated with the second debris suction-inlet may be in its substantially open position. The second suction-inlet may be positioned to receive the debris windrow formed by the second side-broom in its extended position. Air and any debris entrained therein may be entrained into or suctioned into and through the second debris suction-inlet for transfer to the debris hopper where the debris may be substantially separated from the air flow. The debris windrow formed by the first side-broom may be intercepted by the primary material-transfer broom which may rotate in a direction to transfer at least a portion of the debris to a secondary material-transfer broom for transfer into the path of the second suction-inlet where debris may be suctioned thereinto as the vehicle moves in its direction of travel.

In a second operational state or mode of operation, sometimes referred to herein as the "left-side sweep" mode, the first side-broom may be positioned in its extended or outward position and the second side-broom may be positioned in its retracted or inward position with each side-broom rotated by its respective motor to sweep debris into the area defined therebetween. The first side-broom may be rotated to brush debris to form a debris windrow that may be aligned with the first suction-inlet for pickup therein as the sweeper vehicle moves in its direction of travel. The primary material-transfer broom may be rotated in a direction to sweep debris provided by the second side-broom toward the first secondary material-transfer broom which, in turn, may be rotated to transfer debris towards the first debris suction-inlet. In this second mode of operation, the valve device associated with the first debris suction-inlet may be in its substantially open position and the valve device associated with the second debris suction-inlet may be in its substantially closed position to substantially block air flow thereinto. Air and any debris entrained therein may be suctioned into and through the first debris suction-inlet for transfer into the debris hopper where the debris may be substantially separated from the air flow.

In a third mode of operation, sometimes referred to herein as the "all-sweep" mode, the first and second side-brooms may be in their respective extended or outward positions and may be rotated by their respective motors to sweep debris into an area between the side-brooms. The first side-broom may be rotated to sweep debris in a direction to form a debris windrow that may be aligned with the first suction-inlet for pickup thereby, and the second side-broom may be rotated in a direction to form a second debris windrow which may be aligned with the second suction-inlet for pickup thereby. The primary material-transfer broom may be rotated in a direction to sweep debris provided by the side-brooms toward either the first or second trailing material-transfer broom. The first trailing material-transfer broom may be rotated in a direction to sweep debris towards the first suction-inlet for pickup therein, and the second trailing material-transfer broom may be rotated in a direction to sweep debris towards the second suction-inlet for pickup therein. In this third mode of operation, the valve device associated with the first debris suction-inlet and the valve device associated with the second debris suction-inlet may both be in their substantially open positions so that air and any debris entrained therein may be suctioned into and through the first and the second debris suction-inlets for transfer into the debris hopper where the debris may be substantially separated from the air flow. Thus, in some embodiments, such a mode may be referred to as a "dual sweep" or "dual nozzle sweep" mode. While the primary material-transfer broom may be described as rotated in a direction to transfer material to the second secondary material-transfer broom, rotation of the primary material-transfer broom in an opposite direction may be equally suitable.

The fan may be optionally provided with a particulate recovery and recirculation/capture system by which a portion of the air flow in the fan with relatively heavier particles may be diverted therefrom to a discharge conduit for discharge just forward of one of the suction-inlets, e.g., the first or the second suction-inlet, to introduce or re-introduce the relatively heavier particles into the suction-inlet to increase to probability that the so recirculated particles will eventually be retained in the debris collection hopper. If desired, the discharge conduit may be placed to discharge the debris onto the roadway in a position that minimizes the re-introduction of the particles into a suction inlet.

If desired, the material-transfer brooms may be mounted so that each broom may be tilted at a small angle (e.g., between approximately 1 and 6 degrees) to create an arcuate "contact patch" with enhanced or more aggressive brushing action to scrub and remove adhered aggregations or agglomerations of debris from the roadway being swept.

In some embodiments, the material-transfer brooms may be characterized as vertical-type brooms in the sense that they may be rotated about an approximate or somewhat vertical axis ($A_V$). The descriptive phrase approximate or somewhat vertical axis indicates the axis of rotation may be vertical or off-vertical by the tilt angle of the broom and may also vary with time as the broom rides the various undulations, declinations, and inclinations of the roadway during sweeping.

In a variant of the above described broom array, the broom array may include five material-transfer brooms including a primary, leading, or apex material-transfer broom having a motor for rotating the primary broom in a first or a second direction. Two secondary or trailing material-transfer brooms may be positioned aft of the primary broom, the secondary material-transfer brooms laterally spaced from each other with one secondary material-transfer broom positioned to brush debris substantially to one side of the longitudinal axis and the other secondary material-transfer broom being positioned to brush debris substantially to the other side of the longitudinal axis. One of the secondary material-transfer brooms may include a motor configured for rotating the associated material-transfer broom in a first direction to brush debris toward the first side of the vehicle, and the other secondary material-transfer broom may include a motor configured for rotating its broom in an opposite direction to brush debris toward the other side of the vehicle. Additionally, a set of intermediate material-transfer brooms may be positioned aft of the primary material-transfer broom and forward of the secondary material-transfer brooms with each intermediate-transfer broom having a motor configured for rotating its broom in a first or second direction.

Depending upon the sweeping mode, the primary or lead material-transfer broom may be rotatable in a direction to transfer a portion of the debris provided thereto by the side-brooms to one of the intermediate material-transfer brooms for transfer to one of the secondary material-transfer brooms and thereby transfer debris to a position along a path intercepted by a suction-inlet as the vehicle proceeds in the direction of travel for pick-up by one of the suction-inlets, or the primary or lead material-transfer broom may be rotatable in an opposite rotary direction to transfer debris provided thereto by the side-brooms to the other intermediate material-transfer broom and subsequent transfer to a secondary material transfer broom and thereby transfer debris to a position along a path intercepted by the other suction-inlet as the vehicle proceeds in its direction of travel for pick-up by the other of the suction-inlets.

In a further variant, only a single primary broom may be provided which may be selectively rotatable in a first or second direction. In a first mode of operation, the primary broom may be rotated in a first direction to transfer debris presented by the first and second side-brooms as a windrow along a path that may be intercepted by the first suction-inlet for aspiration thereinto as the vehicle proceeds in its direction of travel. In a second mode of operation, the primary broom may be rotated in a second direction to deposit debris presented by the first and second side-brooms as a windrow along a path that may be intercepted by the other suction-inlet for aspiration thereinto as the vehicle proceeds in its direction of travel.

In yet another variant, a swing-arm assembly may include a first secondary material-transfer broom or a first and a second secondary material-transfer broom that cooperates with the primary broom. The swing-arm assembly may be moved to a first position in which the broom or brooms on the swing-arm assembly function as the trailing material-transfer broom or brooms to direct debris toward one of the suction-inlets or moved to a second position in which the broom or brooms on the swing-arm assembly function as the trailing material-transfer broom or brooms to direct debris toward the other of the suction-inlets.

In view of the present disclosure, persons of ordinary skill in the art will appreciate that various features described herein may improve street sweeping, either separately or in combination with each other. For example, material-transfer brooms may be single units, configured in arrays, rotatable about a substantially vertical axis, rotatable clockwise or counterclockwise, pivotable on an arm, tiltable to form a contact patch, configured as an apex broom, configured as a trailing broom, retractable into a travel position, of various sizes and shapes, and controlled manually or automatically. Similarly, side-brooms may be extendable and retractable, rotatable about a substantially vertical axis, rotatable clockwise or counterclockwise, tiltable to form a contact patch, retractable into a travel position, of various sizes and shapes, and controlled manually or automatically. Additionally, suction-inlets for entraining debris may be single or multiple, may be placed in various locations with respect to brooms, may be opened and closed in a manner that allows for stronger pull in a given suction-inlet, may be used in conjunction with water spray, and may be used with a particulate recirculation and recovery system. Further, a controller may provide an ability to set and adjust sweeping modes to optimize use of brooms and suction-inlets for selected environments, including left-side sweep, right-side sweep, crowned-road sweep, and full sweep. Also, various modes of operation may be defined in terms of broom placement, broom operation, broom orientation, and direction of broom rotation for any combination of brooms, as well as suction-inlet placement and suction-inlet operation, either separately or in combination with one or more of the foregoing broom characteristics. Moreover, although a vehicle direction of travel is illustrated as being a forward direction of travel, in some embodiments the direction of travel may be reversed and the various components described herein (e.g., brooms and suction-inlets) may be reversed with respect to the vehicle's front and rear ends in order to accomplish the same or similar objectives in a rearward direction of travel. Other advantages will also be apparent to persons of ordinary skill in the art in view of this disclosure.

DETAILED DESCRIPTION

Figure 1:
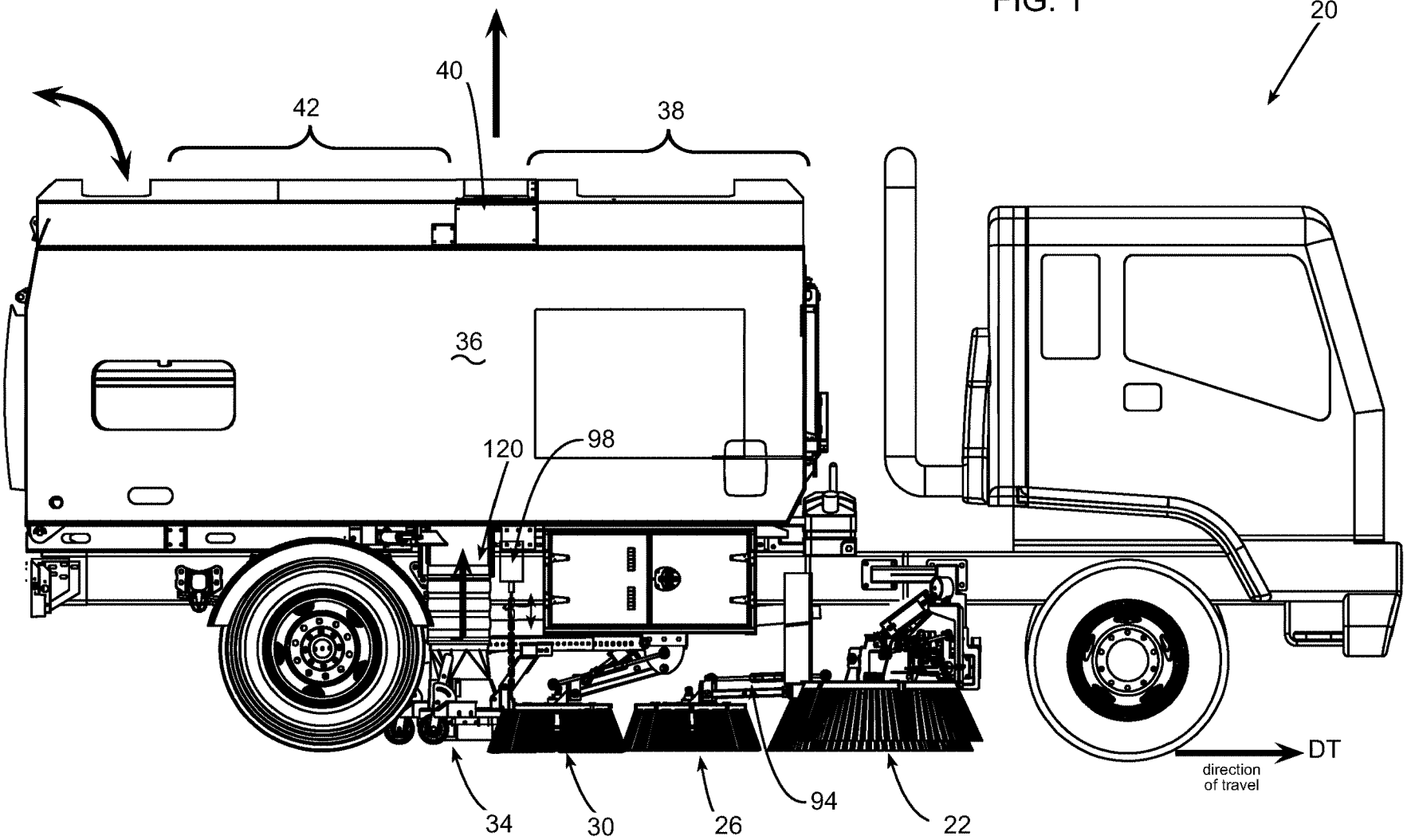
FIG. 1 is a right-side elevational view of an exemplary sweeper vehicle.
Figure 2:
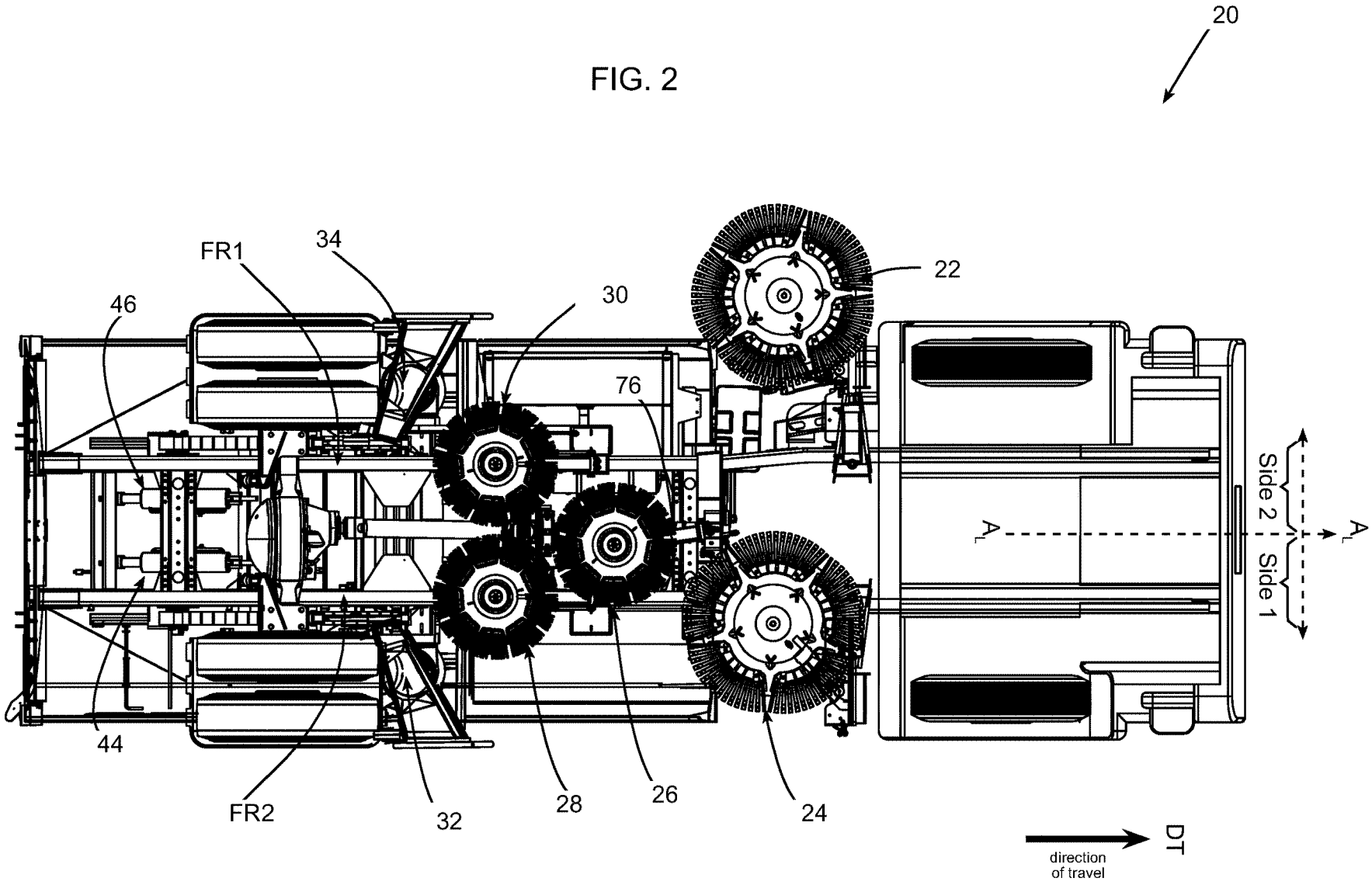
FIG. 2 is a bottom or underside view of the sweeper vehicle of FIG. 1 illustrating debris engaging components including a side-broom in its extended position on the right side and a side-broom in its retracted position on the left side.

An exemplary roadway sweeper vehicle is shown in right side elevation in FIG. 1 and from its underside in FIG. 2 and is designated by the reference character 20.

The sweeper vehicle 20, which may be assembled on a commercial truck chassis or other suitable prime mover, may include first and second side-brooms 22 and 24 (best shown in FIG. 2) mounted to or connected to the vehicle undercarriage either directly or indirectly through the use of adapter plates, spacer plates, stand-offs, brackets, shims, and/or some combination thereof. The truck chassis may include an undercarriage which may include at least two spaced-apart longitudinally extending frame rails FR1 and FR2 and one or more lateral support members. One side-broom may be positioned to one side of the longitudinal axis $A_L$-$A_L$ and the other side-broom may be positioned on the other side of the longitudinal axis $A_L$-$A_L$. The longitudinal axis $A_L$-$A_L$ may or may not correspond to the geometrical centerline of the sweeper vehicle, but generally axis $A_L$-$A_L$ may be between frame rails FR1 and FR2 in some embodiments.

In some embodiments, three material-transfer brooms 26, 28, and 30 may also be mounted to or connected to the vehicle undercarriage either directly, e.g., via a bolted or welded connection, or indirectly, e.g., through the use of adapter plates, spacer plates, stand-offs, brackets, shims, and/or some combination thereof. Of course, fewer or more than three material-transfer brooms may be included, and the material-transfer brooms may be configured in a triad arrangement as shown in FIG. 2 or another suitable arrangement.

In some embodiments, the side-brooms 22 and 24 may move between extended and retracted positions and, in some instances, to positions therebetween. In FIG. 2, the side-broom 22 is shown in its extended or outermost position, and the side-broom 24 is shown in its retracted or innermost position. The range of extension and retraction of the side-brooms 22, 24 may be any suitable range, and the range may or may not be the same for side-broom 22 and side-broom 24. In some embodiments, one or more of the side-brooms may be fixed rather than extendable and retractable.

In some embodiments, material-transfer brooms 26, 28, and 30 may be disposed aft of the first and second side-brooms 22 and 24 with respect to the direction of travel and arranged in a formation resembling a triangle as shown in FIG. 2, with the material-transfer broom 26 designated as the leading or primary or apex broom with respect to the direction of travel. The secondary or trailing material-transfer brooms 28 and 30 may be positioned aft of the leading or primary broom 26 with secondary material-transfer broom 28 laterally displaced to one side of the center of rotation of the primary broom 26 and secondary material-transfer broom 30 laterally displaced to the other side of the center of rotation of the primary broom 26. The secondary material-transfer brooms 28 and 30 are designated as trailing brooms since they are aft of the leading or primary material-transfer broom 26 when the sweeper vehicle is moving in its forward direction of travel DT. The positioning of the secondary material-transfer brooms 28 and 30 does not require that the secondary material-transfer brooms be entirely on one side or the other side of the longitudinal axis $A_L$-$A_L$. Thus, a secondary material-transfer broom may have a portion thereof on or overlapping the longitudinal axis $A_L$-$A_L$, depending upon the physical organization of the commercial truck chassis and possibly other design considerations.

As explained below, the various brooms may be operated in multiple different modes to sweep debris toward and to a path of the first suction-inlet 32 or sweep debris toward and to a path of the second suction-inlet 34, or, in the alternative, sweep debris toward respective paths of both suction-inlets 32 and 34. Depending upon the sweeping mode, air may flow into one or the other, or both, of suction-inlets 32 and 34 and entrain debris therein for eventual collection in the debris hopper 42.

As shown in FIG. 1, major components of the sweeper vehicle 20 may be mounted in a hull-like structure 36 that may include a forward auxiliary engine compartment 38, which may include an internal combustion engine (not shown) that powers a centrifugal fan via a belt-drive connected to the engine, as described more fully below. The internal combustion engine may connect to and power a hydraulic pump to provide pressurized hydraulic fluid to operate various hydraulic motors and actuators and may also power an air compressor and cooperate with an associated compressed air storage tank to supply a source of compressed air to various pneumatically operated actuators. The control of the pressurized fluids (hydraulic or pneumatic) may be implemented via electrically controlled valves (on/off, proportional, reversing, etc.) as well as various types of regulators and ancillary devices as will be appreciated by persons skilled in the art.

In general, pressurized air may be preferred for those fluidic actuators for which a measure of resiliency may be desired; for example, in some embodiments, the fluidic actuators that are used to control the material-transfer brooms preferably are pneumatic so that the brooms may be lifted to and lowered from a "travel" position and allow the brooms to move upwardly and downwardly as the broom "rides" or follows the various undulations, inclinations, and declinations in the surface being swept as the sweeper vehicle moves in its direction of travel DT. Although suitable, pressurized hydraulic fluid may be less preferred in some embodiments, since more complex and more expensive compressed fluid chambers may be required in communication with the hydraulic lines.

A debris collection hopper 42 may be mounted aft of the auxiliary engine compartment 38 and may accumulate debris and particles separated from the debris-entrained air flow prior to the air being exhausted through air-flow exhaust outlet 40. As represented by the curved bidirectional arrow at the rear of the vehicle in FIG. 1, in some embodiments the debris collection hopper 42 may be raised to a dumping position and lowered to its operational position by hydraulic cylinders 44 and 46, for example, as best shown in FIG. 2.

The debris collection hopper 42 may receive the particle-entrained air flow from either or both of the suction-inlets 32 and 34 and separate the debris from the air flow by virtue of the expansion of the air flow into the much larger volume of the debris collection hopper 42 with the debris dropping from the air flow, and, optionally, by various types of screens, baffles, apertured plates, and the like, or a combination thereof, which may be useful in the separation of particles from an air flow. Additionally, in some embodiments, the introduction of a water mist or spray may be useful in separating the debris from the air flow.

Figure 3:
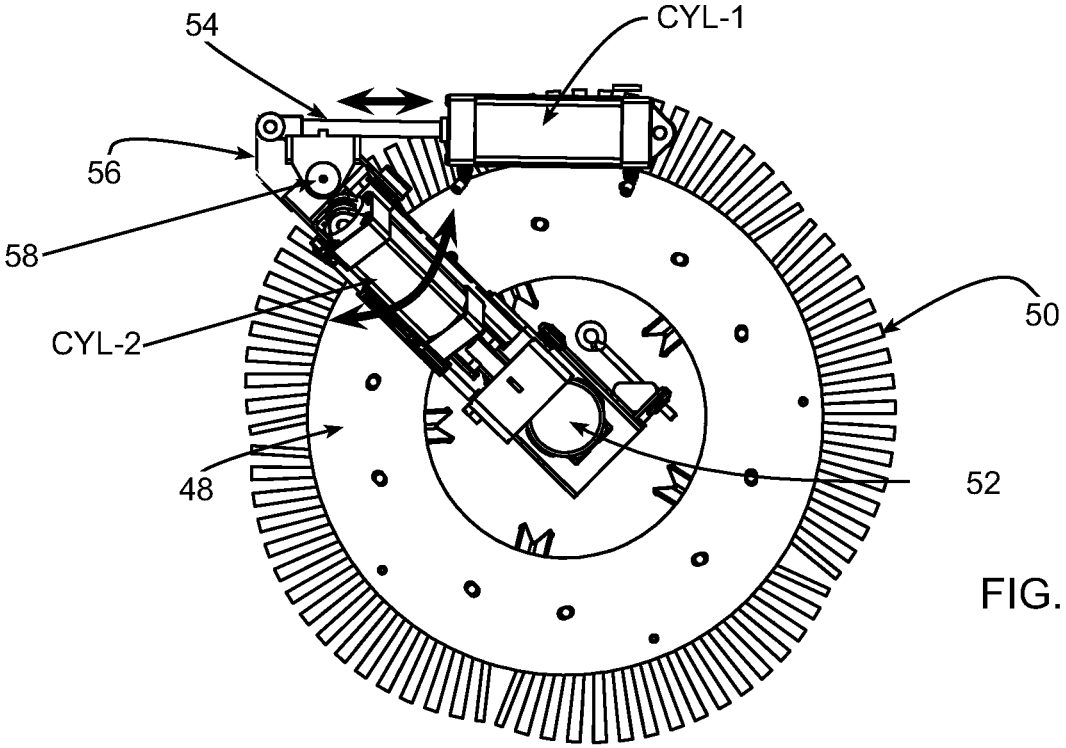
FIG. 3 is a top or plan view of a side-broom showing an actuator for moving the side-broom between an extended position and a retracted position and another actuator for lifting the broom to a raised travel position and lowering the broom to a surface-engaging position.
Figure 4:
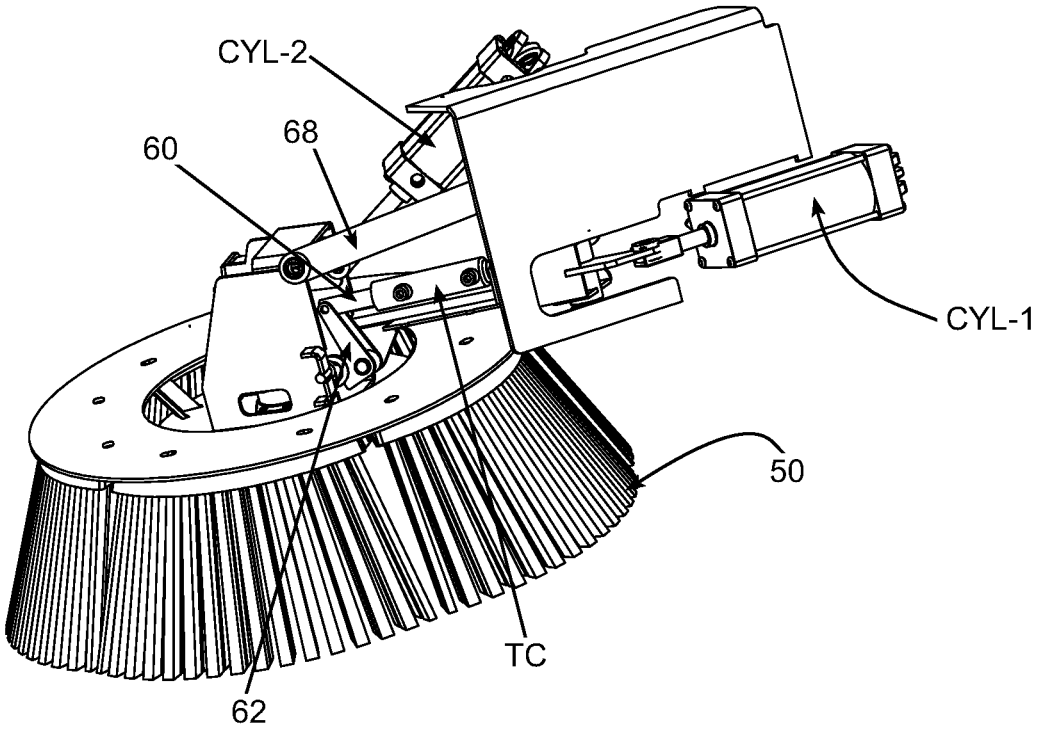
FIG. 4 is a side view of the side-broom shown in FIG. 3 showing a tilt-cylinder.
Figure 5:
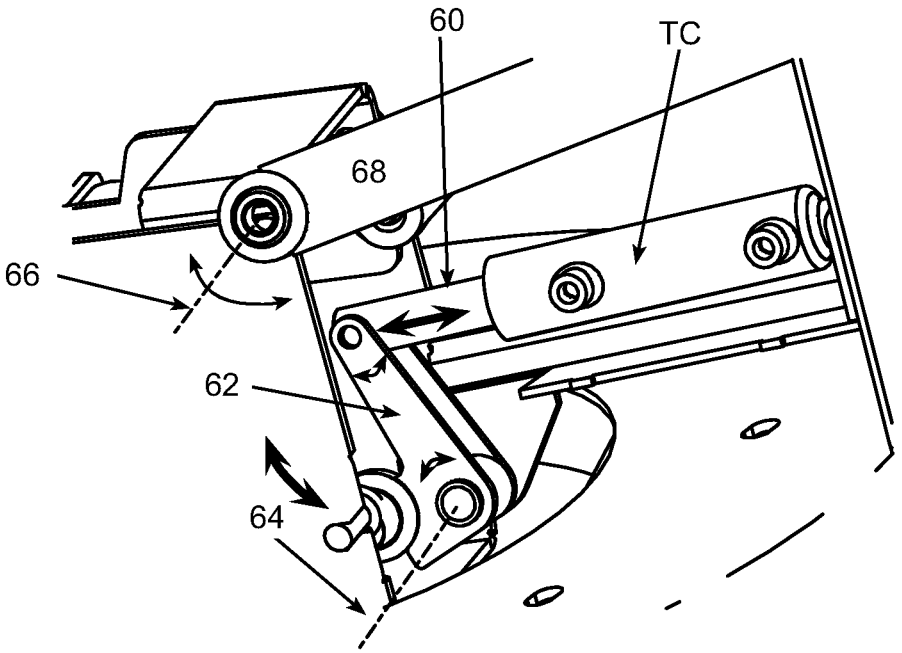
FIG. 5 is an enlarged detail view of the tilt-cylinder with selected structures omitted for reasons of clarity.

An example side-broom (which may also be known as a gutter broom in some embodiments) is shown in FIGS. 3-5 and may include a mounting disc 48 to which bristles 50 (typically in the form of pre-assembled bristle modules or segments) may be mounted to form a near continuous substantially circular array of bristles 50. A motor 52 (typically hydraulic, but may be of any suitable type) may be connected to the disc/bristle assembly for rotating the disc/bristle assembly in a selected direction (e.g., clockwise, counterclockwise, or both). A bidirectional pressurized fluidic actuator CYL-1 (typically pneumatic, but may be of any suitable type) may include a ram 54 connected through a link 56 to rotate the side-broom about a pivot 58 to and from a retracted or inward position, as shown in FIG. 3, to an extended or outward position (as represented by the broom 22 in FIG. 2). Additionally, another pressurized fluidic actuator CYL-2 (e.g., hydraulic or pneumatic) may operate to lift the side-broom to a raised "travel" position and to lower the side-broom to a street-surface contacting position for sweeping. In general, the side-broom broom may typically have a diameter of about 120 cm (about 48 inches), but any suitable size may be used.

As shown in the view of FIG. 4 and in the detail of FIG. 5, a bidirectional fluidic tilt-control cylinder TC (typically hydraulic, but may be of any suitable type) may include an extendible/retractable ram 60 connected to a link 62 mounted for pivotal motion about axis 64 to tilt the motor housing about axis 66 to adjust the tilt angle of the broom relative to the surface being swept. A rigid link 68 may be connected through a spherical bushing about axis 66 to a bracket (not shown) attached to the vehicle undercarriage. In a typical application, a side-broom may be tilted up to about six degrees, for example, relative to the surface being swept when the side-broom is in its extended position to more aggressively sweep or "dig" in a gutter area and may be tilted between zero and one degree or so, for example, when in a retracted position to function more as a scrubbing or scouring broom. Of course, any suitable angles may be employed. In some embodiments, the fluid pressure profile in the tilt-control cylinder TC as the side-broom moves to and from its retracted and extended positions may be determined empirically in order to position the side-broom at a desired tilt angle. Alternatively, in some embodiments, the title angle of the side-broom may be set and adjusted manually, automatically, or a combination thereof. Further alternatively, in some embodiments, the side-broom may be attached to an arm depending from the vehicle chassis, and the arm may be articulated in order to orient the side-broom in a desired tilt position.

Figure 6:
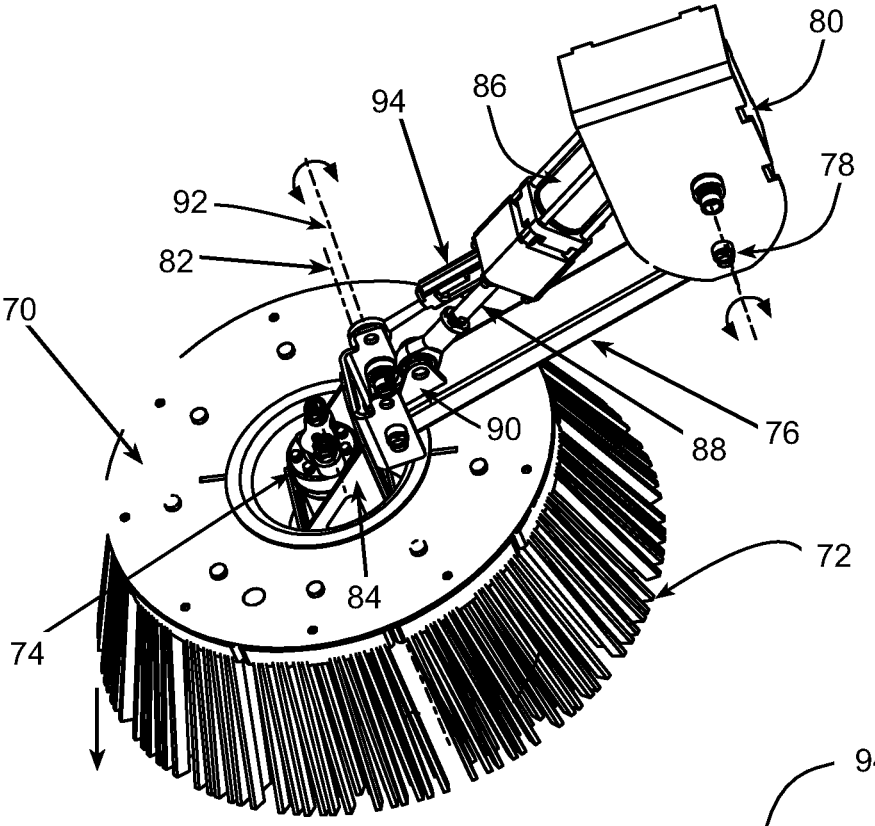
FIG. 6 is a perspective view of an exemplary material-transfer broom.

As shown in FIG. 6, each material-transfer broom may include a mounting disc 70 to which bristles 72 (typically in the form of pre-assembled bristle modules) are mounted to form a near continuous array of bristles 72. A motor 74 (typically hydraulic, but may be of any suitable type) may be connected to the disc/bristle assembly for rotating the disc/bristle assembly in a selected direction (e.g., clockwise, counterclockwise, or both). A trailing arm 76 may be pivotally mounted at pivot axis 78 to a support bracket 80 which, in turn, may be connected to the vehicle chassis or under carriage (not shown). The opposite end of the trailing arm 76 may be pivotally connected at pivot axis 82 to a bracket 84 that supports the motor 74 and the connected disc/bristle assembly. In general, each material-transfer broom may have a diameter of about 60 cm. (about 24 inches), but any suitable size may be used.

A pneumatic actuator 86 having an extendable/retractable ram 88 may be pivotally connected, at its base end, to the bracket 80 with the end of its ram 88 pivotally connected to the control arm 76 via a bracket 90. When pressurized air is introduced into the actuator 86, the ram 88 may retract to lift the material-transfer broom toward and to its raised "travel" position, and conversely, when the air pressure is lowered, the ram 88 may extend consequent to the weight of the material-transfer broom to lower the broom into contact with the surface being swept. When the air pressure in the actuator 86 is at its minimum, the full weight of the material-transfer broom may determine the maximum downward force applied by the broom.

Figure 7:
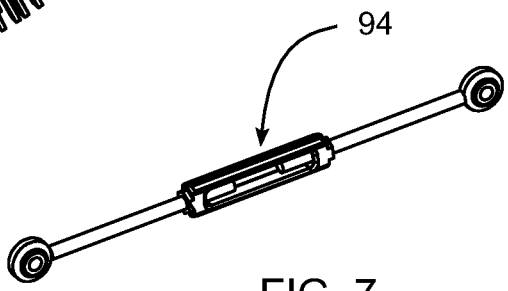
FIG. 7 is a detail perspective view of a turnbuckle for manual control of the tilt of a material-transfer broom.

In general, in some embodiments, it may be preferable for a broom to be tilted at some tilt angle relative to the surface being swept so that an arcuate "contact patch" may be created to provide a more aggressive brushing action. To this end, a tilt axis bushing may provide a tilt axis 92 that may be displaced from the pivotal connection 82. In some embodiments, the tilt angle of each material-transfer broom may be set and maintained by an operator adjustable turnbuckle 94 (shown in FIG. 7); however, a fluidic actuator or an electric actuator (e.g., electric motor leadscrew device) may be preferable in certain applications.

As shown in FIG. 6, the trailing arm 76 may be pivotally mounted at axis 78, which may be substantially horizontally aligned. As an option, the bracket 80 or a sub-bracket thereof (not shown) may be mounted or pivoted about a substantially vertical axis to allow a few degrees of movement about the vertical axis, as represented by the material-transfer broom 26 in FIG. 2.

The organization of the above-described material-transfer brooms may provide a number of efficiency improving benefits to the overall sweeper. By adjusting the air pressure in each pneumatic actuator, the individual brooms can resiliently "ride on" undulating road surfaces and closely follow the various declinations and inclinations as the sweeper vehicle moves in its direction of travel. The pneumatic pressure can be decreased, as desired, to provide a more aggressive sweeping action. In some embodiments, with a three-broom array as described above, roadways with a crowned center area may be effectively swept in a manner superior to that offered by classic cylindrical tube brooms rotated about a substantially horizontal axis. Additionally, the tilt angle can be adjusted so the material-transfer brooms, in addition to providing their material-transfer functionality, can also function as "digger" brooms to aggressively scrub or scour compacted adherent aggregations or agglomerations of debris from the road surface.

In some embodiments, an approximate tilt angle range for enhanced (i.e., more aggressive) sweeping for the side-brooms and the material-transfer/scrubbing brooms may be between about 3 and 8 degrees relative to the surface being swept with the "digger" functionality appearing most prominently between about 5 and 8 degrees, for example. Of course, other suitable tilt angle ranges may be used. In some embodiments, the upper limit for the tilt angle can be determined empirically based upon experience observing the removal rate of adherent compacted aggregations or agglomerations of debris from the road surface. Alternatively, the tilt angle may be set and adjusted manually or automatically, such as by a computer, for example, or by a combination thereof.

In order to maximize sweeping aggressiveness, especially with regard to the removal of "packed-down" or compressed adherent aggregations or agglomerations of debris on the surfaces being swept, in some embodiments it may be preferred that the bristles of all brushes be fabricated from a resilient steel alloy formed as a wire or flat band segment that may be conventionally bent into a U-shape and assembled into bristle modules or segments. However, for those environments where steel bristles are not required, traditional plastic-bristles, such polyurethane, polypropylene, or polyamide, may be suitable. Of course, any suitable material may be employed for the bristles.

Figure 8:
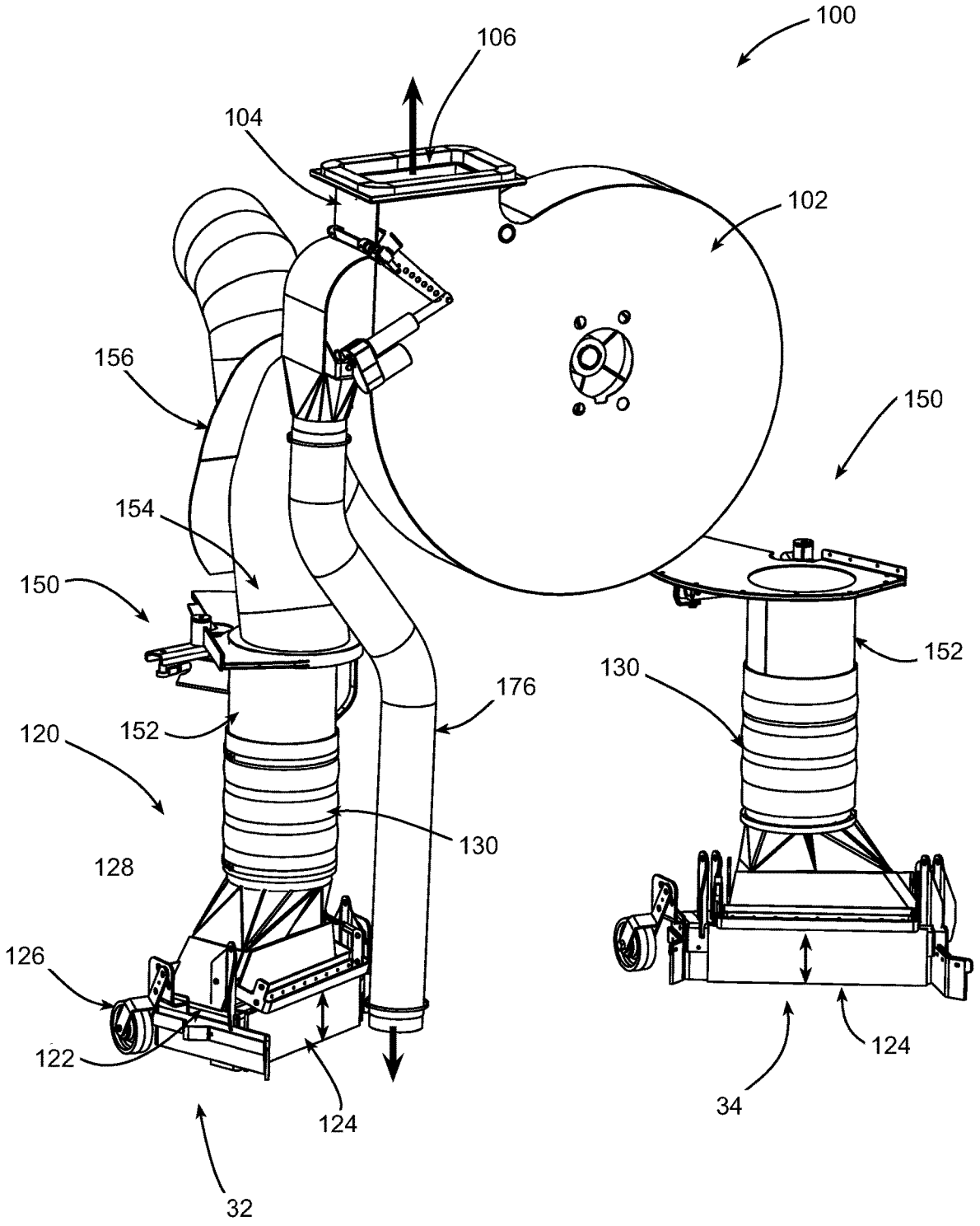
FIG. 8 is a perspective view of an air flow system including a centrifugal fan and suction air-inlets or pick-up heads on either side thereof.
Figure 9:
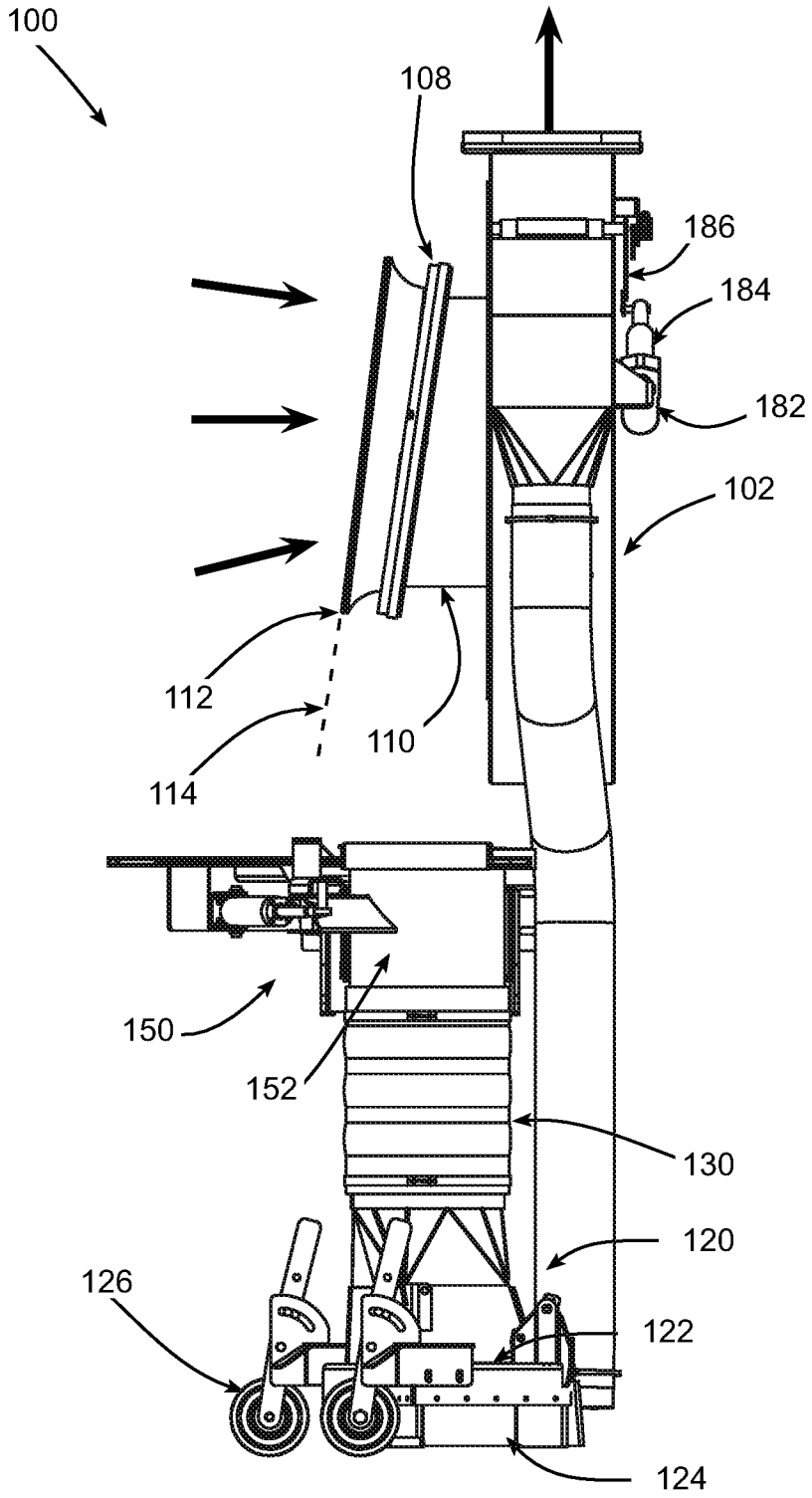
FIG. 9 is a side view of the centrifugal fan shown in FIG. 8.

A partial perspective view of the air flow system 100 is shown in FIG. 8 and in side view in FIG. 9. A centrifugal fan 102 may include an outlet portion 104 through which the pressurized air flow may be discharged through opening 106 to the ambient environment. As shown in the side view of FIG. 9, an upwardly inclined inlet duct 110 may connect through an interface 108 with an air inlet ring 112 connected to the debris hopper 42 on the left of the debris hopper bulkhead 114 (shown in dotted-line).

A suction-inlet or pick-up head 120 may include a frame 122 having elastomeric curtains 124 about the periphery thereof with height-adjustable wheels 126 designed to roll along the surface being swept. As represented by the bidirectional up/down arrow on the right in FIG. 8, the debris-facing elastomeric curtain 124 on both pick-up heads 120 may be moved to a raised position via an actuator (not shown) when sweeping leaf accumulations. A transition structure 128 may change the air-flow cross-section into a circular cross-section for connection with an elastomeric hose 130 which, in turn, may connect to the inlet portion 152 of a gate valve 150. The gate valve outlet may connect to an air flow tube 154 for conducting the air flow to the debris hopper 42 where some of the entrained particulates are separated from the air flow and collected for eventual disposal. The air flow from the air flow tube 154 may pass through an interface 156 transitioning through the bulkhead of the debris hopper (not shown). Each suction-inlet pick-up head 120 may be attached to a pneumatic cylinder/chain assembly 98 (FIG. 1); when pressurized, the pneumatic cylinder/chain assembly 98 may lift the respective suction-inlet pick-up head 120 to the raised travel position shown in FIG. 1. In general, each suction-inlet may have a side-to-side width of about 71 cm or so (about 28 inches), but any suitable size may be used.

Figure 10:
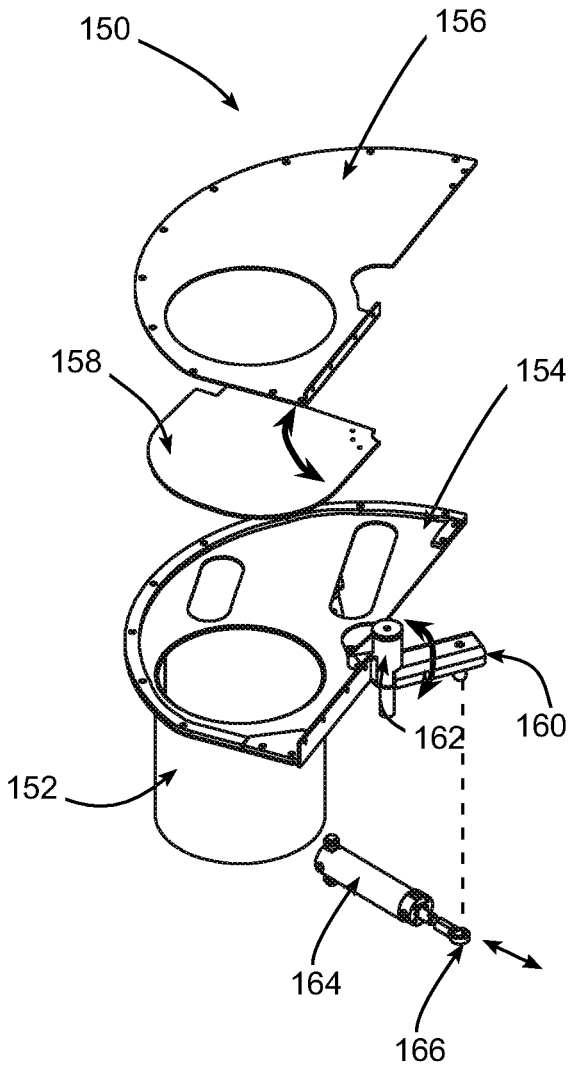
FIG. 10 is an exploded perspective view of an air flow control valve.

As shown in the exploded perspective view of FIG. 10, the air flow valve 150 may include the inlet portion 152, which may connect to the elastomeric hose 130 shown in FIG. 8 and FIG. 9. A first half-moon shaped valve housing 154 may be secured to the inlet 152 and may cooperate with another half-moon shaped valve housing 156 to retain a valving plate 158 therebetween. As represented by the bidirectional arrow on plate 158, the valving plate 158 may be designed to move between a position in which the air flow may be substantially blocked and another position in which the air flow may be substantially unobstructed, or any position therebetween. The valve plate 158 may be connected to an operating arm 160 that may be rotatable about a pivot 162. A bidirectional actuator 164 (e.g., pneumatic, hydraulic, or electric) may include a rod 166 that may connect to the operating arm 160 so that the valve plate 158 may be moved in response to the operating rod 166 moving to and from its retracted and extended positions.

Figure 11:
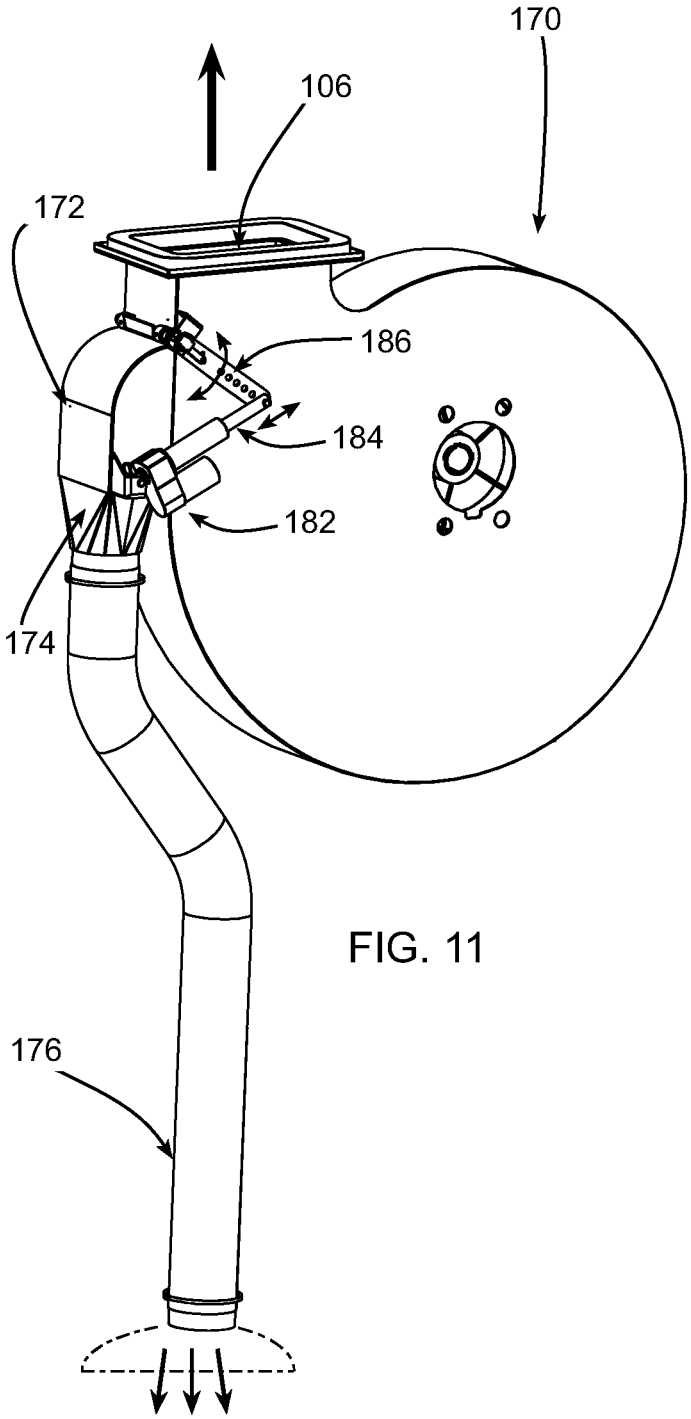
FIG. 11 is a perspective view of the fan shown in FIGS. 8 and 9 and an entrained-particle recovery and recirculation/capture system.
Figure 12:
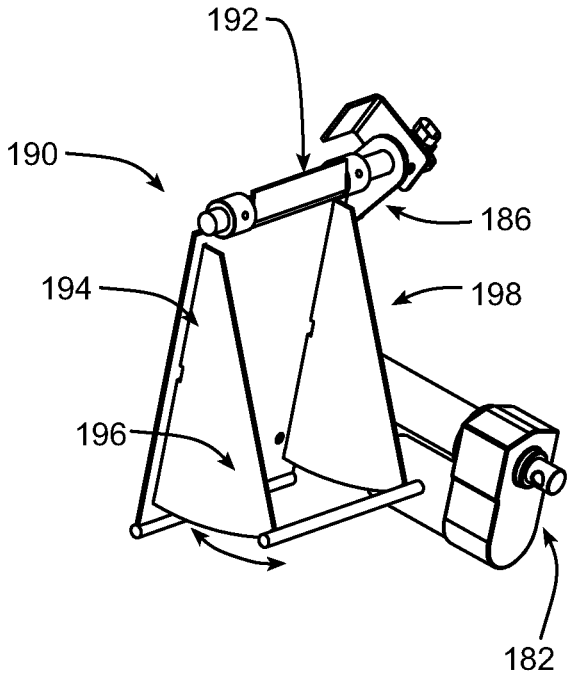
FIG. 12 is a detailed perspective view of an air flow diverter or scoop for diverting a portion of the air flow in the fan.
Figure 13:
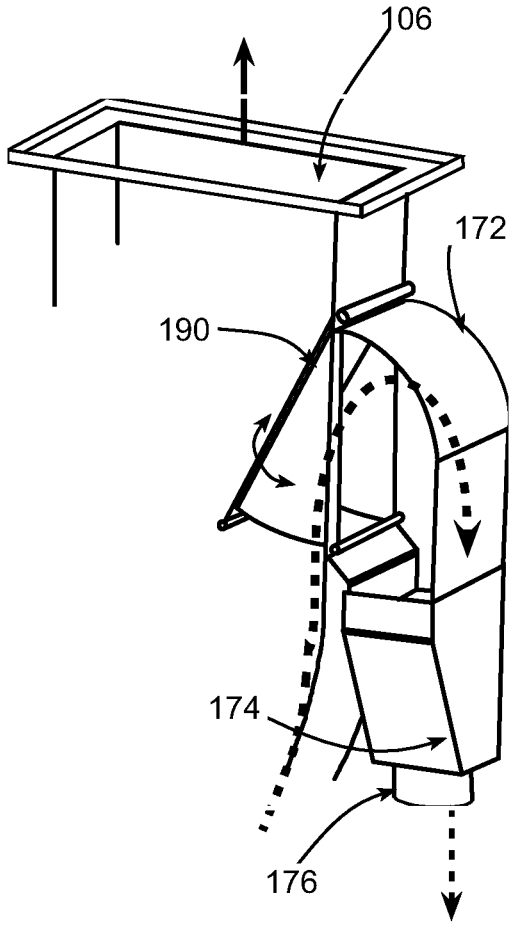
FIG. 13 is a perspective view of a portion of the fan adjacent the outlet showing the placement of the air flow diverter or scoop of FIG. 12 in operation.

A particle recirculation and capture system 170 is shown in overall view in FIG. 11 and in detail in FIG. 12 and FIG. 13. As shown in FIG. 11, a housing 172 may be attached to the exterior of the fan scroll adjacent the air flow exit 106. A transition section 174 may connect to a discharge air conduit or hose 176 to discharge an air flow within the hose 176, including any particulates entrained therein, to a position adjacent to the surface being swept and forward of the suction-inlet 32 (as shown in FIG. 8).

As shown in FIG. 12, an air flow diverter or scoop, generally indicated at 190, may be pivotally mounted at its upper end, at 192, for movement about the pivot axis between an open position and a closed position and any position therebetween. The diverter 190 may include a flat panel 194, a first sidewall 196 and a second sidewall 198 spaced from the first sidewall 196, as shown in FIG. 12.

As shown in FIGS. 12 and 13, the diverter 190 may be moved under control of an actuator 182 (preferably an electric ball/leadscrew actuator, in some embodiments, but of any suitable type) having an extendable/retractable ram 184 connected to a link 186 to move the diverter 190 between a closed position and the open position shown. In the open position, some of the air flow, and any entrained particulates therein, may enter the opened diverter 190 and flow into the housing 172 to reverse direction therein into the hose 176 for discharge from the bottom of the air conduit or hose 176 in front of the suction-inlet 32 for re-entry into the air flow system as the sweeper vehicle 20 moves forward along its direction of travel.

The direction reversal represented by the dotted-line in FIG. 13 may slow the velocity of the entrained particulates (as may the bends in the hose 176 shown in FIG. 11). In some embodiments, the outlet end of the air conduit or hose 176 may preferably have a cross-section enlarging termination (shown in a generic manner in dotted-line) to further slow the velocity of the out flowing air and the particulates entrained therein.

In general, a range of particle sizes and weights may enter into the suction-inlet 32 and/or 34 and be transported into the debris hopper 42 where a substantial fraction of the particulates may be separated from the air flow and accumulated in the debris hopper 42 for eventual disposal. In practice, however, a minority of the particulates may not be separated from the air flow and may enter the fan inlet to be exhausted into the local atmosphere.

For centrifugal fans, the centrifugal forces exerted on the particles may cause the relatively heavier entrained particulates to concentrate in that air flow strata or layer contiguous or adjacent to the outermost wall of the fan housing 102. The placement of the diverter scoop 190 in the outermost wall of the fan housing 102 may increase the probability that the heavier particles will be diverted from the air flow just prior to being exhausted and presented to the suction-inlet 32 or 34 via the hose 176 for recirculation, thereby increasing the probability that heavier particles ultimately will be separated from the air flow and collected in the debris hopper 42. In theory, n recirculation cycles of a particle will increase the probability that the particle will be retained in the debris hopper 42 and lowers the probability that the particle will be exhausted into the atmosphere.

Figure 14:
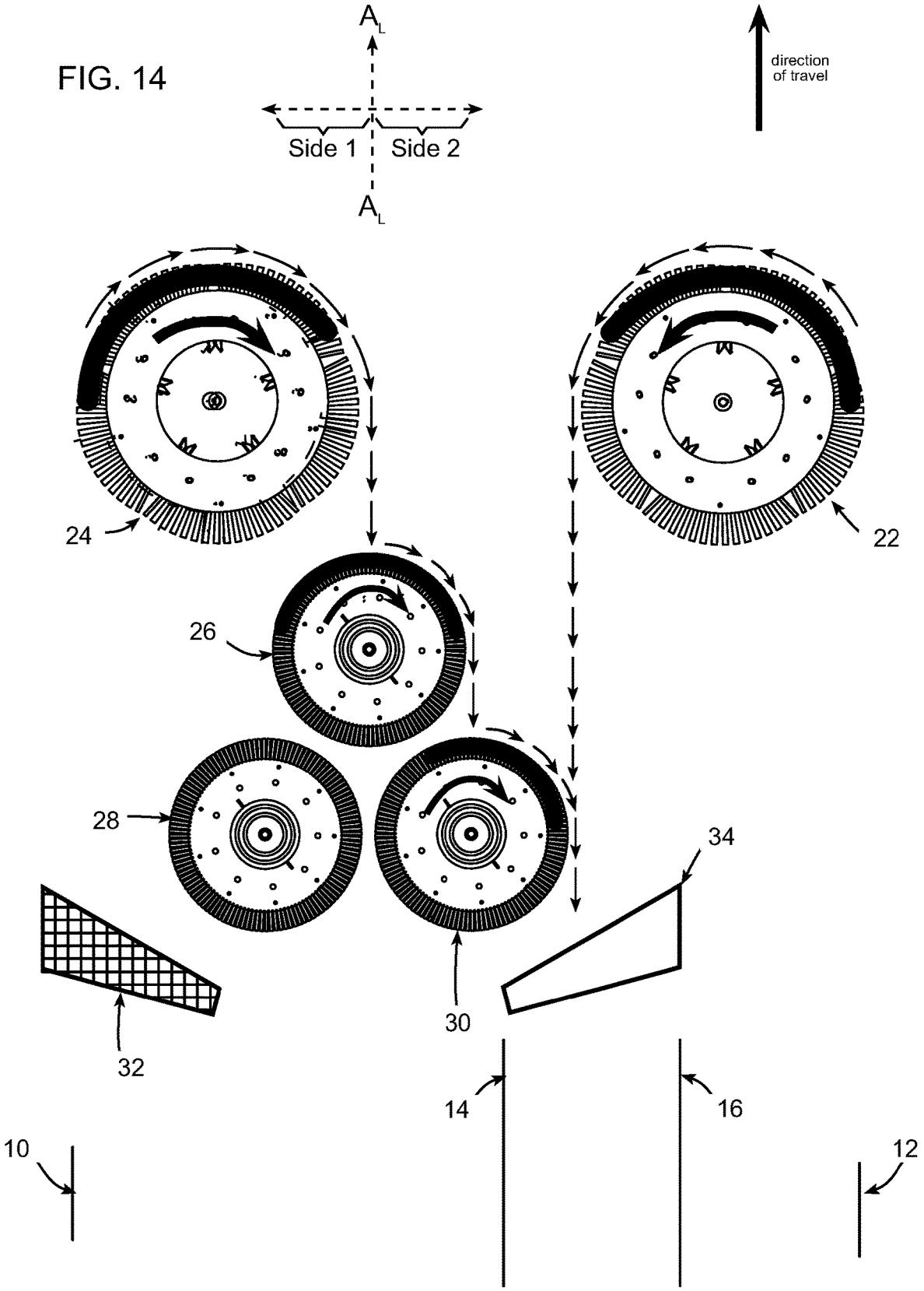
FIG. 14 is a top view of the various brooms shown in FIG. 2 positioned for a first sweeping mode.
Figure 15:
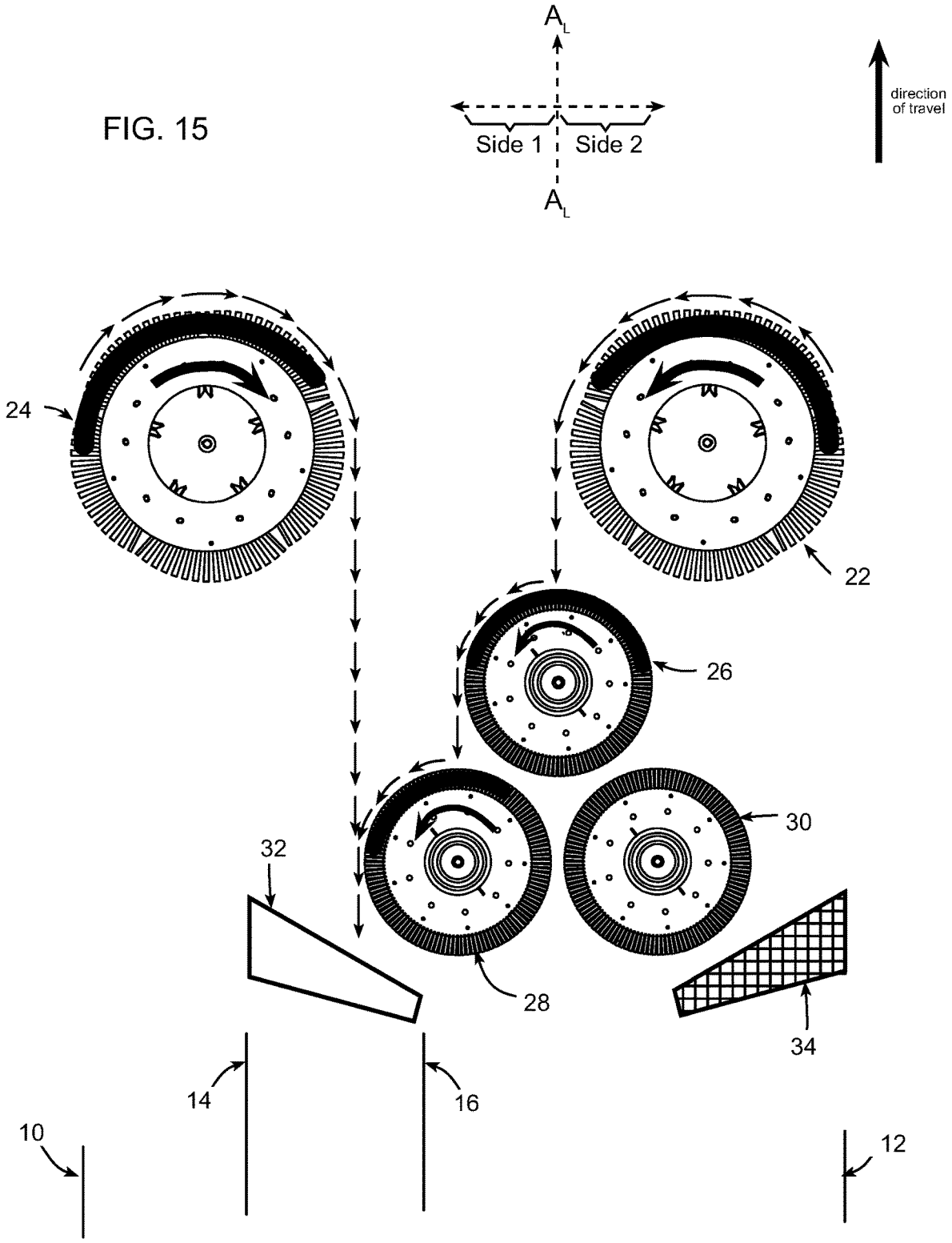
FIG. 15 is a top view of the various brooms shown in FIG. 2 positioned for a second sweeping mode.
Figure 16:
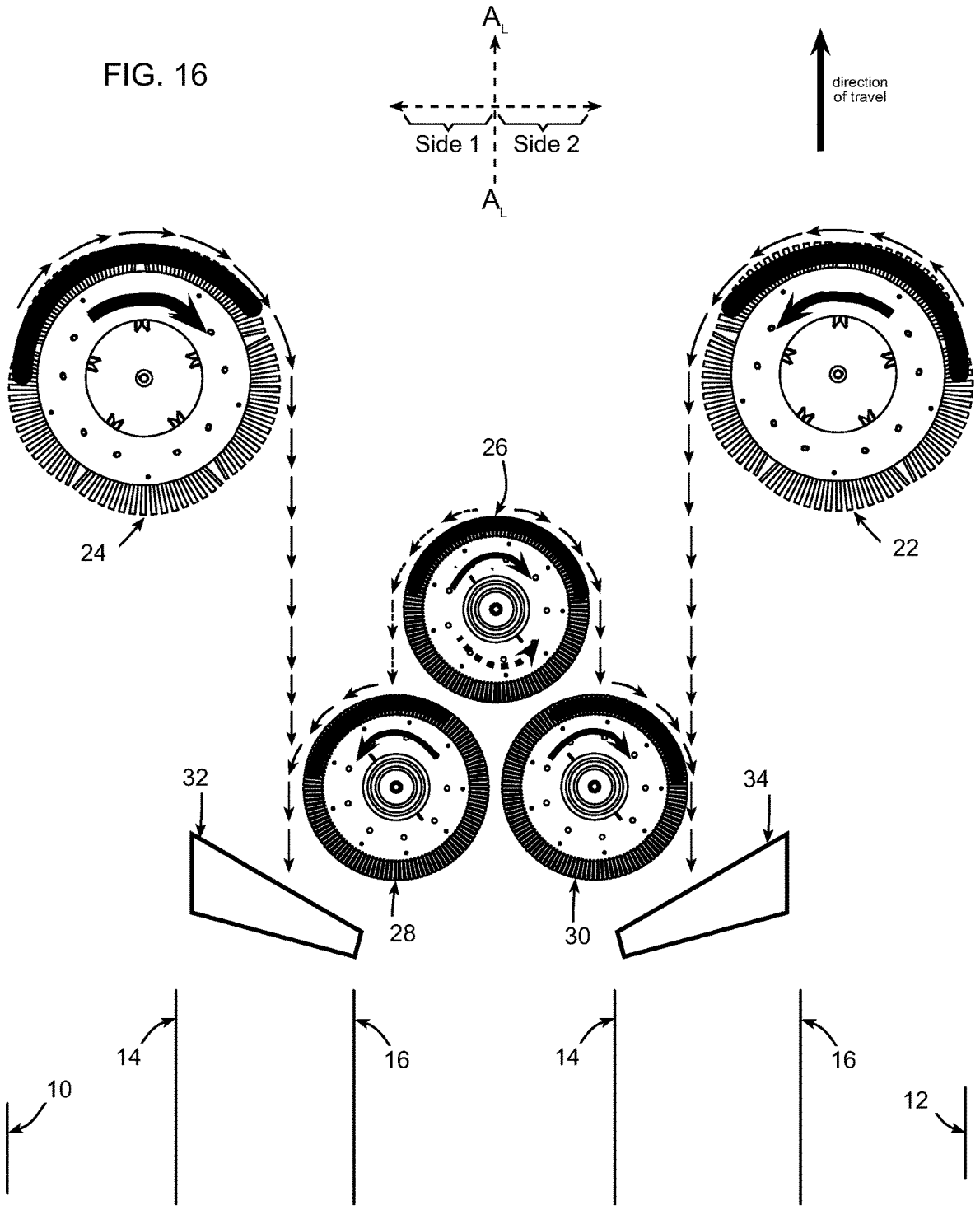
FIG. 16 is a top view of the various brooms shown in FIG. 2 positioned for a third sweeping mode.

FIGS. 14, 15, and 16 are top plan views of side-brooms 22 and 24 and material-transfer brooms 26, 28, and 30 showing various positions and/or rotational directions for three different sweeping modes.

In each of FIGS. 14, 15, and 16, a longitudinal axis $A_L$-$A_L$ may be approximately aligned with the center of the primary or leading material-transfer broom 26 with the arrowhead representing the direction of travel DT. In the context of a left-hand drive vehicle, the structure to the left of the longitudinal axis $A_L$-$A_L$ may be defined as on a first or left side (i.e., side 1) and structure to the right of the longitudinal axis $A_L$-$A_L$ may be defined as on a second or right side (i.e., side 2). The longitudinal axis $A_L$-$A_L$ of FIGS. 14, 15, and 16 may be preferably aligned with the centerline of the vehicle, although in some embodiments, various components may need to be mounted in a non-centerline alignment to avoid interference with the drive-line components (i.e., drive shafts including segmented drive shaft arrangements and their support bearings of the vehicle as delivered by the manufacturer, for example). In addition, the primary material-transfer broom 26 may be optionally mounted from a swing-arm for limited side-to-side movement.

FIG. 14 illustrates a first sweeping operational state or mode, sometimes referred to as a "right-side sweeping" mode, in which the left side-broom 24 may be moved to its retracted or inward position, and the right side-broom 22 may be moved to its extended or outward position. As the sweeper vehicle moves in its direction of travel DT, the left-side-broom 24 may be rotated clockwise (CW) (from the viewpoint of FIG. 14) to brush any debris to the right to form an accumulated debris stream (sometimes referred to as a "windrow") as the vehicle moves in its direction of travel DT. Depending upon the debris on the surface being swept, the resulting windrow may be continuous or discontinuous, of varying width and/or height and/or shape, and have a varying moisture content. In FIG. 14, the windrow formed by the left side-broom 24 may be intended to be intercepted by or encounter the leading or primary material-transfer broom 26 as represented by the arrows on the right-hand side of the left side-broom 24. In a similar manner, the right side-broom 22 may rotate counterclockwise (CCW) (from the viewpoint of FIG. 14) to brush debris to form another windrow trailing from the left side of the right side-broom 22 as indicated by the arrows. The thick black arcuate line associated with the left side-broom 24 and the similar thick black arcuate line associated with the right side-broom 22 represent contact patches where the ends of the broom bristles are in optimum contact with the surface being swept to brush debris into the area therebetween. The respective contact patches may be achieved by preferentially tilting the side-brooms about respective tilt axes and controlling the downward force applied to the broom so that the individual bristles can yield to store potential energy to assist in moving the debris in the desired direction.

As the sweeper vehicle moves in the direction of travel DT, the debris windrow from the left side-broom 24 encounters the primary or leading material-transfer broom 26, which may be rotated clockwise, with the debris brushed to the right to form a further windrow for interception by the right side secondary broom 30, which may also rotate clockwise and, in turn, brush the debris to the right to add its debris to the debris deposited by the right side-broom 22. Further, any debris not brushed by the left side-broom 24 or the right side-broom 22 may encounter either the leading material-transfer broom 26 or the right side secondary material-transfer broom 30 to be positioned along with the debris from the right side-broom 22 for entrainment into the suction-inlet 34 as the sweeper vehicle moves in its direction of travel DT. The gate valve 150 associated with the right suction-inlet 34 may be substantially open to allow air flow into the air flow system thereby entraining debris for delivery to the debris hopper 42. The gate valve 150 associated with the left-side suction-inlet 32 may be substantially closed (as indicated by the cross-hatching) thereby precluding substantial air flow therethrough. In the configuration shown in FIG. 14, the trailing left-side material-transfer broom 28 may be unpowered and may be lifted out of engagement with the surface being swept. Of course, in some embodiments, trailing left-side material-transfer broom 28 may be powered, may be positioned into engagement with the surface being swept, and may be rotated either CW or CCW for sweeping action. Likewise, although the left side-broom 24 is illustrated as being rotated in this mode, in some embodiments the left side-broom 24 may not be rotated and may be unpowered and may be lifted out of engagement with the surface being swept. The same may be true of the left side-broom 24 in other "right-side sweeping" modes described herein.

In the operational state of FIG. 14 as the sweeper vehicle moves in the direction of travel DT, a swept stripe may be defined, on the left side, at reference character 10 and, on the right side, at reference character 12, into which swept debris is brushed to the right to form a debris windrow that may be positioned for entrainment into the suction-inlet 34 which, in turn, may define a vacuumed or suctioned stripe the extends laterally between, on the left, at reference character 14 and, on the right, at reference character 16. In some embodiments, brooms 22, 24, 26, 28, and 30 may be positioned such that all or substantially all of the surface between character 10 and character 12 (that is, the swept stripe) is swept as the sweeper vehicle moves in the direction of travel DT.

In some embodiments, the mode shown in FIG. 14 may be best-suited for sweeping the right curb and gutter area of a street or roadway.

As shown in FIG. 15, in a second sweeping operational state or mode sometimes referred to as the "left-side sweeping" mode, the left side-broom 24 may be moved to its extended or outward position, and the right side-broom 22 may be moved to its inward or retracted position. The left side-broom 24 may be rotated clockwise (from the perspective of FIG. 15) and the right side-broom 22 may be rotated counterclockwise to brush debris into the area between the two side-brooms 22 and 24. As the sweeper vehicle moves in the direction of travel DT, the debris may encounter the left side-broom 24 which may brush the so encountered debris to the right to form a debris windrow intended to encounter the left side suction inlet 32 as represented by the arrows on the right-side of the left side-broom 24, and, in a similar manner, the right side-broom 22 may rotate counterclockwise to brush any encountered debris to form another windrow trailing from the left side of the right side-broom 22 as indicated by the arrows. As the sweeper vehicle moves in the direction of travel DT, the debris windrow from the right side-broom 22 may encounter the primary or leading broom 26, which may be rotated counterclockwise, with the debris brushed to the left to form a trailing windrow for interception by the left side secondary broom 28 which, in turn, may brush the debris to the left to add to the debris from the left side-broom 24. Any debris not brushed by the left side-broom broom 24 or the right side-broom 22 may encounter either the leading material-transfer broom 26 or the left side secondary material-transfer broom 28 to be positioned for entrainment into the suction inlet 32 as the sweeper vehicle moves in its direction of travel DT. The gate valve 150 associated with the left suction-inlet 32 may be open to allow air flow into the air flow system thereby entraining debris for delivery to the debris hopper 42. In a similar manner, gate valve 150 associated with the right suction-inlet 34 may be closed thereby precluding substantial air flow therethrough (as indicated by the cross-hatching on suction-inlet 34). In the configuration shown in FIG. 15, the trailing right-side material transfer broom 30 may be unpowered and may be lifted out of engagement with the surface being swept. Of course, in some embodiments, trailing right-side material-transfer broom 30 may be powered, may be positioned into engagement with the surface being swept, and may be rotated either CW or CCW for sweeping action. The thick black arcuate lines respectively associated with brooms 22, 24, 26, and 28 represent contact patches where the ends of the broom bristles are in optimum contact with the surface being swept to brush debris. As noted above, each contact patch may be achieved by preferentially tilting the respective broom about a respective tilt axis and controlling the downward force applied to the broom so that the individual bristles can yield to store potential energy to assist in moving the debris in the desired direction. Although the right side-broom 22 is illustrated as being rotated in this mode, in some embodiments the right side-broom 22 may not be rotated and may be unpowered and may be lifted out of engagement with the surface being swept. The same may be true of the right side-broom 22 in other "left-side sweeping" modes described herein.

In the operational state or mode of FIG. 15, as the sweeper vehicle moves in the direction of travel DT, a swept stripe may be defined, on the left side, at the reference character 10 and, on the right side, at the reference character 12 in which swept debris may be brushed to form a debris windrow that may be positioned for entrainment or aspiration into the suction-inlet 32 which, in turn, may define a narrower suctioned stripe defined, on the left, at reference character 14 and on the right at reference character 16. In some embodiments, brooms 22, 24, 26, 28, and 30 may be positioned such that all or substantially all of the surface between character 10 and character 12 (that is, the swept stripe) is swept as the sweeper vehicle moves in the direction of travel DT.

In some embodiments, the mode shown in FIG. 15 may be best-suited for sweeping the left curb and gutter area of a street or roadway.

FIG. 16 illustrates a third sweeping operational state or mode, sometimes referred to as the "all-sweep" mode, in which the left side-broom 24 and the right side-broom 22 are shown in their respective extended positions. The left side-broom 24 may be rotated in a clockwise direction (from the perspective of FIG. 16) by its motor, and the right side-broom 22 may be rotated in a counterclockwise direction by its motor. As the vehicle moves in the direction of travel, the counter-rotating side-brooms 22 and 24 may operate to sweep debris in the general direction of the area between the two side-brooms where the debris tends to organize or accumulate into respective debris windrows for each side-broom 22 and 24. The thick black arcuate lines respectively associated with brooms 22, 24, 26, 28, and 30 represent contact patches where the ends of the broom bristles are in optimum contact with the surface being swept to brush debris. As noted above, each contact patch may be achieved by preferentially tilting the respective broom about a respective tilt axis and controlling the downward force applied to the broom so that the individual bristles can yield to store potential energy to assist in moving the debris in the desired direction.

As the sweeper vehicle moves along the direction of travel DT, the debris swept by the first and second side-brooms 22 and 24 may accumulate in the general area therebetween including a respective windrow for the left side-broom 24 that may be positioned to be intercepted by the left suction-inlet 32. In a similar manner, a windrow may be formed by the right side-broom 22 and may be positioned to be intercepted by the right suction-inlet 34. The three material-transfer brooms 26, 28, and 30 may encounter the debris accumulation. The primary or apex material-transfer broom 26 may be rotated in a clockwise direction to sweep material in its path in the direction of the arrows shown toward the right-side suction-inlet 34. A left side secondary trailing material-transfer broom 28 trails the leading or primary material-transfer broom 26 and may be located generally to the left of the axis $A_L$-$A_L$. In a similar manner, the secondary trailing right side material-transfer broom 30 trails the leading or primary broom 26 and may be generally located to the right of axis $A_L$-$A_L$ and/or the axis of rotation of the primary broom 26. In FIG. 16, the primary or apex material-transfer broom 26 may be rotated in a clockwise direction to sweep debris toward the right side secondary material-transfer broom 30 which may also rotate in a clockwise direction. Debris encountered by the primary or apex broom 26 may be transferred into the path of the right side trailing material-transfer broom 30 with the debris placed in the path of the right side suction-inlet 34. The debris may be entrained in the air flow as the sweeper vehicle 20 moves along its direction of travel DT and may be delivered through the open air flow valve 150 for transport into the debris hopper 42 for collection. As shown on the left side of FIG. 16, debris encountering the trailing left side secondary material-transfer broom 28 may be swept into the path of the left side suction-inlet 32 with the debris entrained in the air flow and delivered to the debris hopper 42 for collection. In this mode of operation, both air flow valves 150 (and hence both suction-inlets 32 and 34) may be open.

In some embodiments, the operating mode of FIG. 16 may be best suited for relatively narrow streets or lanes in which the outermost edges of the extended side-brooms 22 and 24 may extend into the opposite gutters. In some embodiments in which both suction-inlets 32 and 34 are served by the same fan, vacuum source, or other air movement device, greater suction effectiveness may be achieved in one suction-inlet in some instances by closing the other suction-inlet. In other embodiments, each suction-inlet may be served by a separate fan, vacuum source, or other air movement device. Of course, any desired number of suction-inlets may be provided, and the suction-inlets may be served by one or more fans, vacuum sources, or other air movement devices. Also, some embodiments may not have any suction-inlets or any fan, vacuum source, or other air movement device. For example, in some embodiments, brooms may be employed as described herein to sweep debris onto a conveyor rather than into a suction-inlet.

The choice of the rotational direction for the primary material-transfer broom 26 may be selected or arbitrary. In FIG. 16, the material-transfer broom 26 is shown as rotating in a clockwise direction; as can be appreciated, the primary material-transfer broom 26 may also be rotated in a counterclockwise direction as shown by the dotted-line arrow. In some embodiments, material-transfer broom 26 may be rotated in a clockwise direction at some times and in a counterclockwise direction at other times. The same is true for the other brooms described herein.

When the vehicle is in its FIG. 16 "all-sweep" mode and moving in the direction of travel DT, the primary material-transfer broom and the first and second spaced secondary material-transfer brooms may provide overlapping swept stripes well-suited for sweeping the "crowned" central part of a roadway surface with the material-transfer brooms "riding" the topology of the central part of the roadway as well as the various inclinations and declinations and undulations of the roadway. In some embodiments, the primary material-transfer broom and the first and second spaced secondary material-transfer brooms may provide a sweeping/scrubbing functionality that may be superior to a horizontally mounted cylindrical tube broom.

In some embodiments, the system described above may operate under the supervision of an appropriately programmed controller that can take the form of one or more stored-program controlled (e.g., firmware and/or software) microprocessors or microcomputers (as well as general-purpose or special-purpose computers or processors, including RISC processors), application-specific integrated-circuits (ASIC), programmable logic arrays (PLA), discrete logic or analog circuits, with related non-volatile and volatile memory, and/or combinations thereof. For example, in some embodiments, a commercially available programmable mobile controller from IFM Efector, Inc., Malven Pa. under the part designation CR0234 and an associated keypress/display under part designation CR1081 may be used. Of course, any suitable controller may be used.

Figure 17:
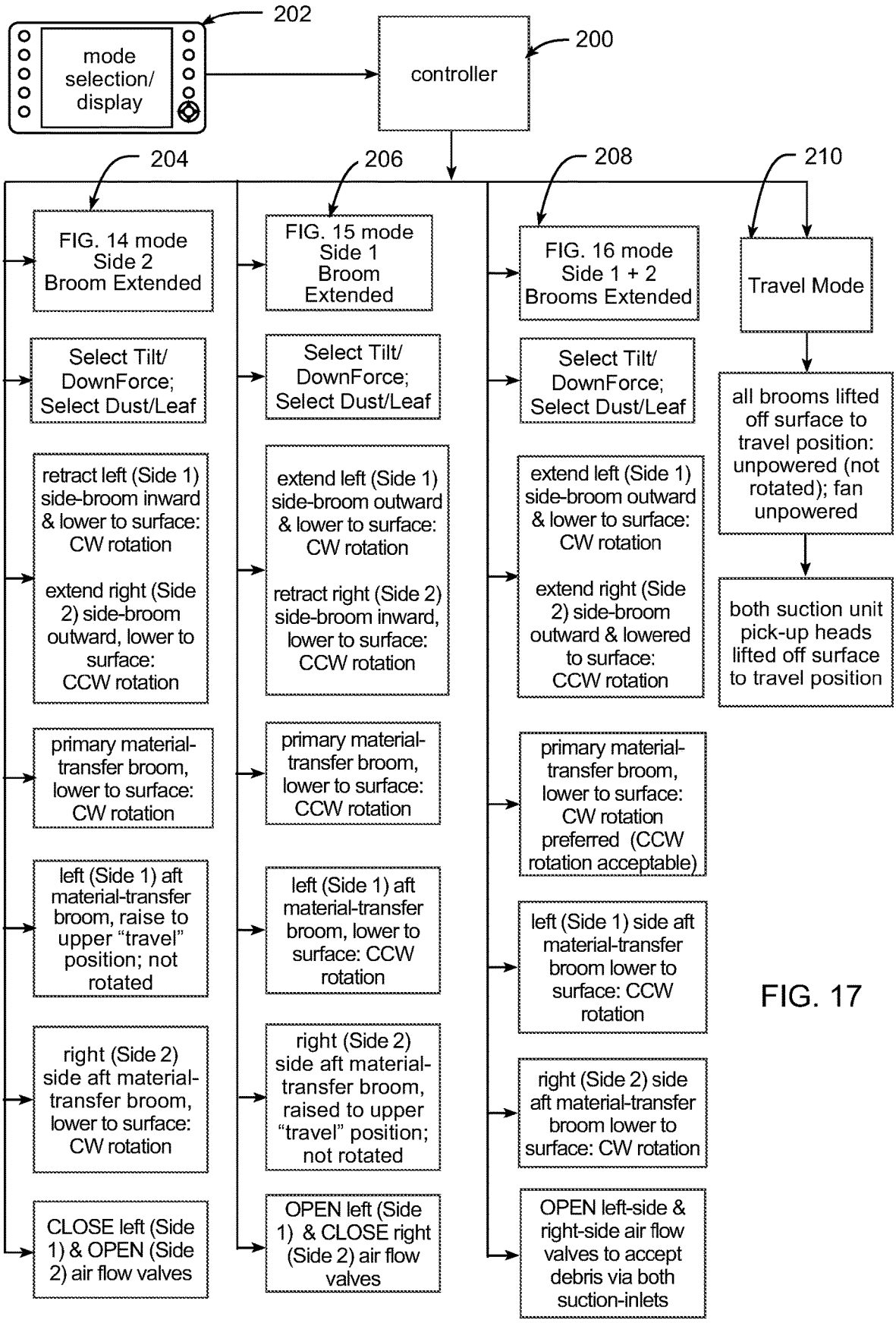
FIG. 17 is an operational state or flow chart for arranging the organization of the brooms shown in FIG. 2 for a travel mode of operation, the first mode of operation shown in FIG. 14, the second mode of operation shown in FIG. 15, and the third mode of operation shown in FIG. 16.

As shown in FIG. 17, in some embodiments, a controller 200 may receive an operator mode-selection command for a particular operating mode, such as the FIG. 14, FIG. 15, and FIG. 16 modes, for example, as well as a "travel" mode, from a keypress/display unit 202. Additionally or alternatively, the controller 200 may include command entry capability and related display functionality for controlling and displaying the tilt orientation and/or rotational direction for one or both of the side-brooms and/or one or more material-transfer brooms. In some embodiments, controller 200 may be programmed with or allow operator selection of a default mode of operation. In some embodiments, such as the FIG. 14, FIG. 15, and FIG. 16 modes, for example, controller 200 may allow operator selection of or issue commands to set a tilt and/or downforce for each broom, and controller 200 may allow operator selection of or issue commands to set a dust and/or leaf setting for each suction-inlet.

In the case where the FIG. 14 operational state or mode 204 is selected, the controller 200 may issue commands to extend the right side-broom 22, retract the left side-broom 24, rotate the left side-broom 24 clockwise, and rotate the right side-broom 22 counterclockwise. Similarly, controller 200 may issue commands to rotate the primary or apex material-transfer broom 26 and the right-side trailing material-transfer broom 30 clockwise, and move the left side material-transfer broom 28 to its raised travel position and not rotate it. Controller 200 may also issue commands to close the air flow valve controlling the air flow through suction-inlet 32 and open the air flow through the suction-inlet 34.

In the case where the FIG. 15 operational state or mode 206 is selected, the controller 200 may issue commands to extend the left side-broom 24, retract the right side-broom 22, rotate the left side-broom 24 clockwise, and rotate the right side-broom 22 counterclockwise. Similarly, controller 200 may issue commands to rotate the primary or apex material-transfer broom 26 and the left-side trailing material-transfer broom 28 counterclockwise, and move the right side material-transfer broom 30 to its raised travel position and not rotate it. Controller 200 may also issue commands to close the air flow valve 150 controlling the air flow through suction-inlet 34 and open the air flow valve 150 controlling the air flow through the suction-inlet 32.

In the case where the FIG. 16 operational state or mode 208 is selected, the controller 200 may issue commands to extend both the left and right side-brooms 24, 22 to their respective extended positions, rotate the left side-broom 24 clockwise, and rotate the right side-broom 22 counterclockwise. Similarly, controller 200 may issue commands to rotate the primary or apex material-transfer broom 26 and the right-side trailing material-transfer broom 30 clockwise, and rotate the left side material-transfer broom 28 counterclockwise. Controller 200 may also issue commands to open both valves respectively controlling the air flow through suction-inlet 32 and suction-inlet 34.

In the case where the "travel" mode 210 is selected, controller 200 may issue commands to raise all brooms and the suction-inlet heads 120 to their respective upper "travel" position to allow the vehicle to travel without any brooms or suction-inlet heads engaging the road surface. Controller 200 may also issue commands not to rotate the brooms and not to operate the fan.

In FIG. 17, the command flow paths for modes 204, 206, and 208 suggest simultaneous or near real-time control of each broom or valve, and the command flow paths for the "travel" mode suggest sequential control; however, either simultaneous (or near real-time) or sequential control may be employed for any mode of operation.

Figure 18:
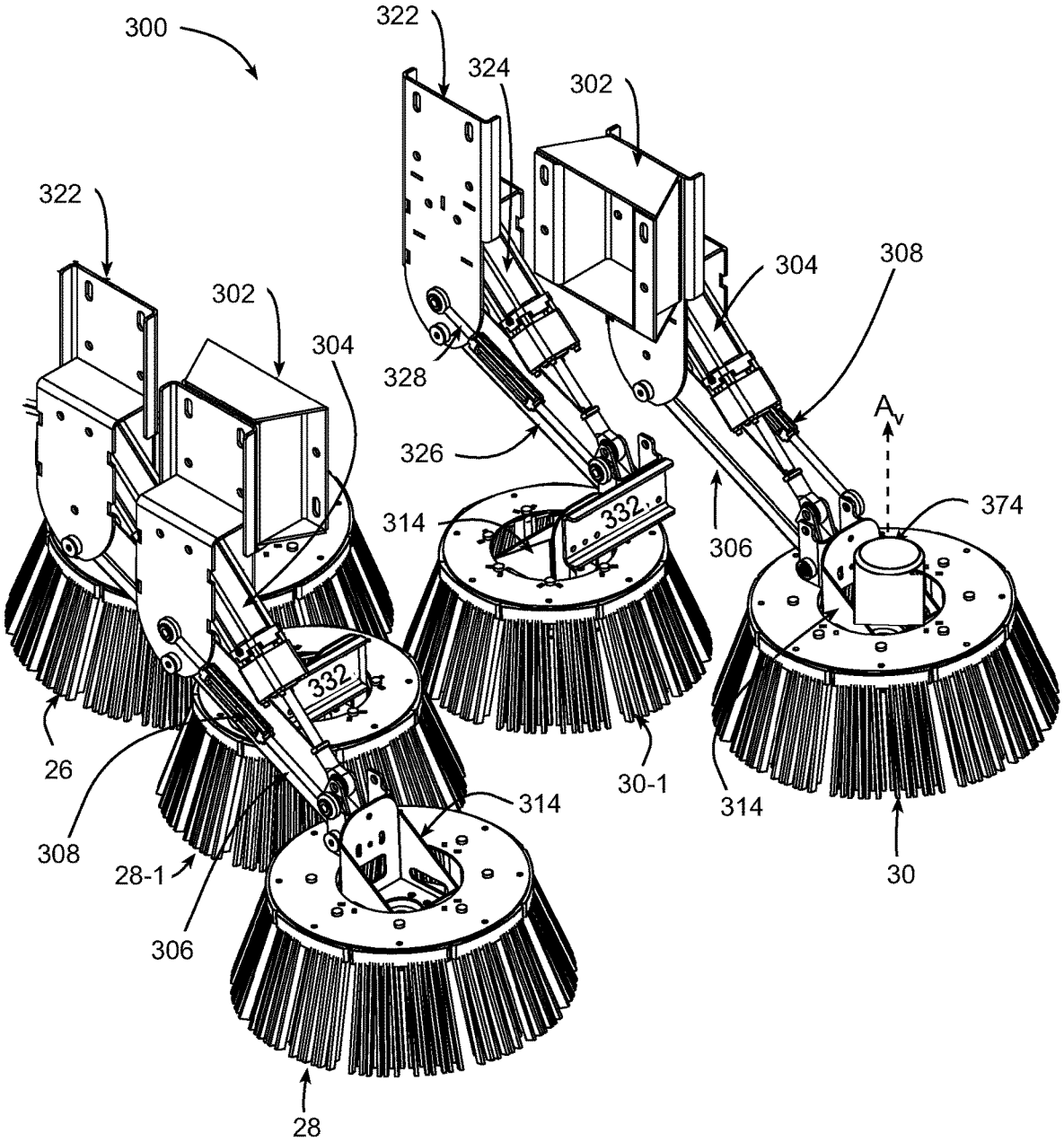
FIG. 18 is a perspective view of a 5-broom variant that includes a pair of intermediate brooms positioned between the apex or leading broom and the trailing brooms.

FIG. 18 is a perspective view of a material-transfer broom variant 300 showing the material-transfer broom 26, the material-transfer broom 30, and the material-transfer broom 28, with an intermediate material-transfer broom 30-1 interposed between the broom 26 and the broom 30 and another material-transfer broom 28-1 interposed between the broom 26 and the broom 28. Each of the material-transfer brooms may have a nominally vertical axis Av as shown in a representative manner for material-transfer broom 30.

As shown in FIG. 18, the trailing broom 30 and the trailing broom 28 may each be carried by a respective broom support that may include a support member 302 designed to be directly attached or indirectly connected to the undercarriage of the sweeper vehicle, such as the frame rails FR1 and FR2, for example.

A bidirectional pneumatic actuator 304, a trailing arm 306, and a turnbuckle 308 may each be pivotally connected at a base or proximate end to support member 302. Turnbuckle 308 may be the same as or similar to turnbuckle 94 shown in FIG. 7. The remote end of the trailing arm 306, the turnbuckle 308, and the pneumatic actuator 304 may be pivotally connected to a bracket assembly attached to or adjacent the motor mounting bracket 314 via various spheriodal connectors, for example. The bidirectional pneumatic actuator 304 may function to lift the broom 28 or 30 to an upper "travel" position and to also lower the broom 28 or 30 into engagement with the surface being swept.

In FIG. 18, the drive motor 374 (shown for material-transfer broom 30) is not shown for the material-transfer broom 28 to reveal the interior structure of the motor mounting bracket 314.

The material-transfer broom 26 may be mounted, positioned, and operated as described above in relationship to FIG. 6.

In a similar manner, the intermediate material-transfer broom 30-1 and the intermediate material-transfer broom 28-1 may be connected directly or indirectly to the undercarriage of the sweeper vehicle via a respective support assembly 322 that pivotally supports a proximate end of a trailing arm 326, the proximate end of a pneumatic cylinder 324, and the proximate end of a turnbuckle 328. The remote end of the trailing arm 326 may be pivotably connected to a laterally extending arm 332 from the motor carrier bracket 314 via various spheriodal connectors, for example.

Each mounting assembly 302 and 322 may be formed as a pressed metal formation, as a weldment, or a combination thereof, for example, that may be designed to be directly connected (e.g., via threaded fasteners) to the vehicle frame rails (shown in FIG. 2) or indirectly connected to the vehicle frame rails or other portions of the vehicle undercarriage using various types of adapters, connector plates, spacer plates, shims, etc. (not shown).

Figure 19:
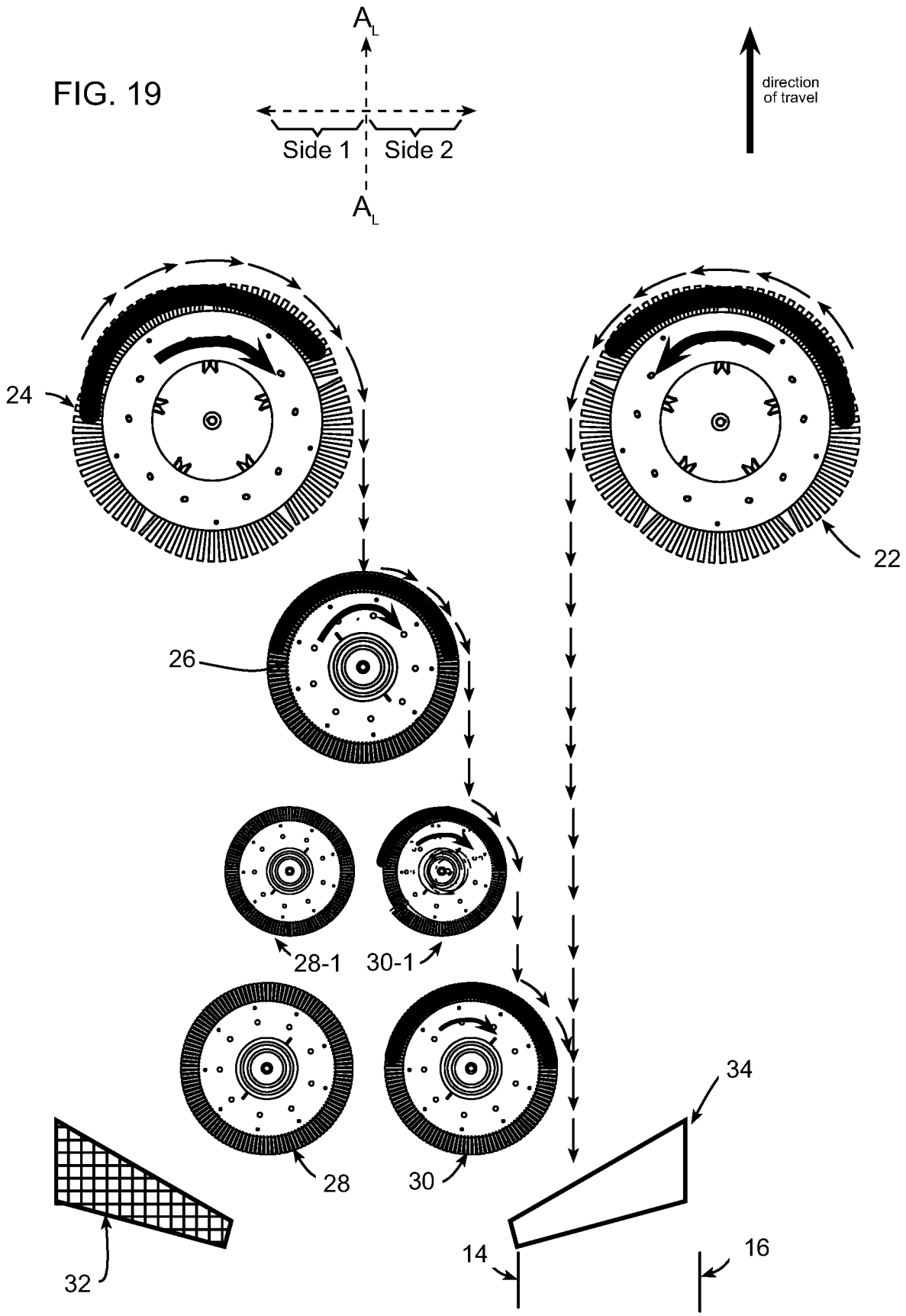
FIG. 19 is a top view of the various brooms shown in FIG. 18 positioned for a first sweeping mode.
Figure 20:
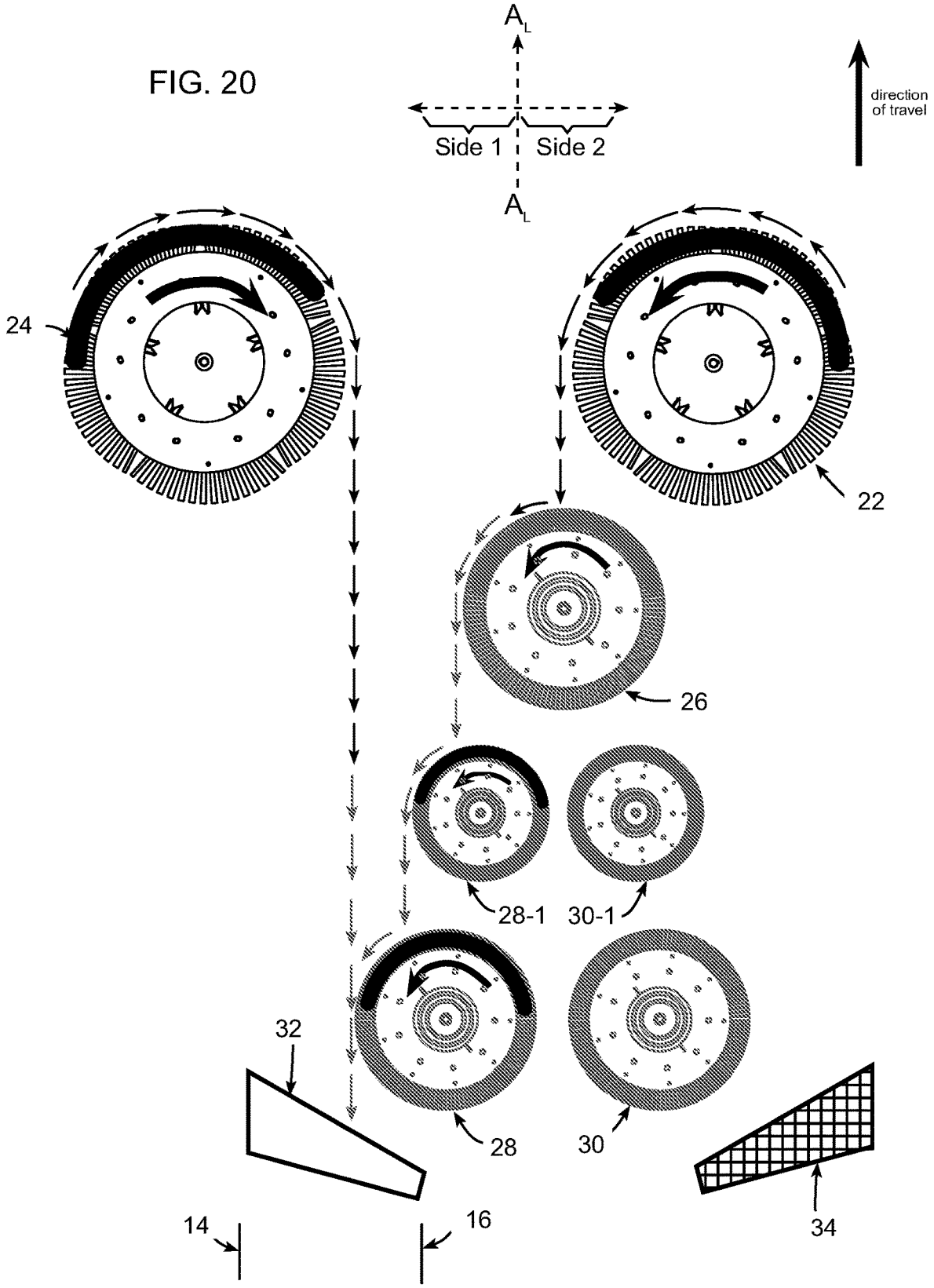
FIG. 20 is a top view of the various brooms shown in FIG. 18 positioned for a second sweeping mode.
Figure 21:
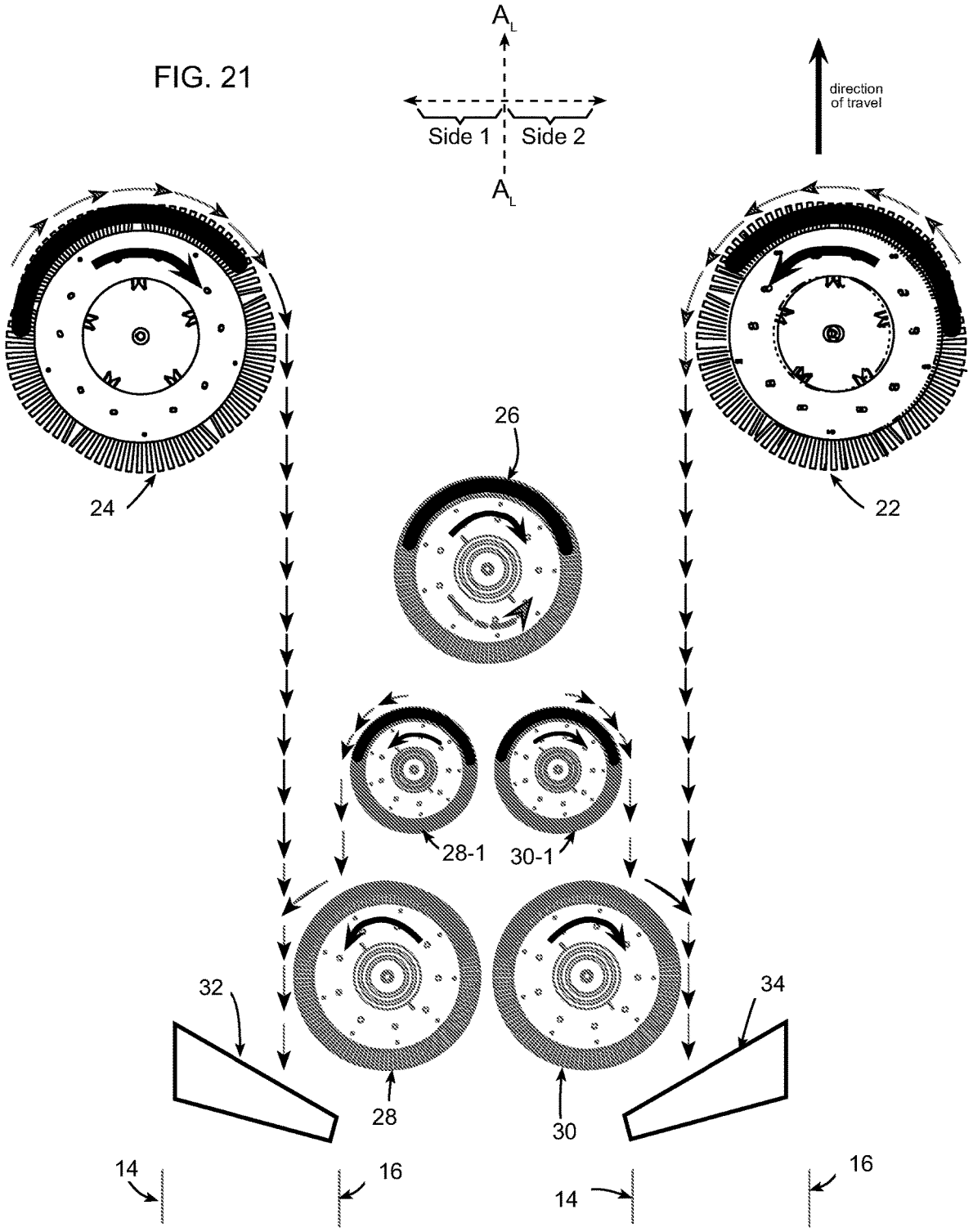
FIG. 21 is a top view of the various brooms shown in FIG. 18 positioned for a third sweeping mode.

FIGS. 19, 20, and 21 are top or plan views of side-brooms 22 and 24 and the material-transfer brooms 26, 28, 28-1, 30, and 30-1 showing various positions and/or rotational directions for the right-side, left-side, and all-sweep modes.

As in the case of FIGS. 14, 15, and 16, FIGS. 19, 20, and 21 include a longitudinal axis $A_L$-$A_L$ that may be approximately aligned with the center of the primary or apex material-transfer broom 26 with the arrow DT representing the direction of travel. In the context of a left-hand drive vehicle, the structure to the left of the longitudinal axis $A_L$-$A_L$ may be defined as on a first or left side (i.e., side 1) and the structure to the right of the longitudinal axis $A_L$-$A_L$ may be defined as on a second or right side (i.e., side 2). The longitudinal axis $A_L$-$A_L$ of FIGS. 19, 20, and 21 may or may not be aligned with the centerline of the vehicle, although in some embodiments and as a function of the truck chassis manufacturer, various components may be mounted in a non-centerline alignment to avoid interference with the drive line components (i.e., drive shaft or drive shafts) of the vehicle. In addition, the primary material-transfer broom 26 may be optionally mounted from a swing-arm for limited side-to-side movement and/or mounted for limited movement about an axis.

FIG. 19 illustrates a first sweeping operational state or mode, sometimes referred to as a "right-side sweeping" mode and operationally corresponding to FIG. 14 described above, in which the left side-broom 24 may be moved to its retracted or inward position, and the right side-broom 22 may be moved to its extended or outward position. The left side-broom 24 may be rotated clockwise and the right side-broom 22 may be rotated counterclockwise to brush debris into the area between the two side-brooms 22 and 24. As the sweeper vehicle moves in the direction of travel DT, the debris encounters the clockwise rotating side-broom 24 to form a debris windrow for interception by the primary broom 26. Additionally, the counterclockwise rotating side-broom 22 also forms a debris windrow that may be in alignment with the suction-inlet 34.

The primary or apex material-transfer broom 26 may be rotated clockwise to brush the debris to the right to form a debris windrow for interception by the right-side intermediate material-transfer broom 30-1, which in turn may also be rotated clockwise to brush the debris to the right to form a debris windrow for interception by the right side trailing material-transfer broom 30, which also may be rotated in the clockwise direction to form a debris windrow for moving the debris into the pathway of the right-side suction-inlet 34 as the vehicle moves in its direction of travel. As a consequence of the rotating brooms 26, 30-1, and 30, the debris may be positioned in the path of the suction-inlet 34. The gate valve 150 associated with the suction-inlet 34 may be open to allow air flow into the air flow system thereby entraining the debris for delivery to the debris hopper 42. The gate valve 150 associated with the left-side suction-inlet 32 may be closed (as indicated by the cross-hatching) thereby precluding substantial air flow therethrough. In the configuration shown in FIG. 19, the left-side material-transfer brooms 28 and 28-1 may be unpowered and may be lifted to their respective "travel" positions out of engagement with the surface being swept. Alternatively, in some embodiments, the left-side material-transfer brooms 28 and 28-1 may be rotated CW or CCW and may be engaged with the surface being swept.

In some embodiments, the mode shown in FIG. 19 may be best-suited for sweeping the right curb and gutter area of a street or roadway.

FIG. 20 illustrates a second sweeping operational state or mode, sometimes referred to as the "left-side sweeping" mode and operationally corresponding to FIG. 15 described above, in which the left side-broom 24 may be moved to its extended or outward position and the right side-broom 22 may be moved to its inward or retracted position. The left side-broom 24 may be rotated clockwise and the right side-broom 22 may be rotated counterclockwise to brush debris into the area between the two side-brooms 22 and 24. As the sweeper vehicle moves in the direction of travel DT, the left side-broom 24 may form a debris windrow that may be aligned with the left side suction inlet 32. The right side-broom 22 may form a windrow that may be intercepted by the counterclockwise rotating primary broom 26 which, in turn, may form a debris windrow for interception by the intermediate broom 28-1, which, in turn, may form a debris windrow for interception by the trailing material-transfer broom 28 which, in turn, may transfer the debris into the path of the left section-inlet 32. Debris may enter the left suction-inlet 32 as the vehicle moves in the direction of travel DT. The gate valve 150 associated with the left suction-inlet 32 may be open to allow air flow into suction-inlet 32 thereby entraining debris for delivery to the debris hopper 42. In the configuration shown in FIG. 20, the intermediate broom 30-1 and the secondary right-side material-transfer broom 30 may be unpowered and may be lifted out of engagement with the surface being swept and held in their travel mode. Alternatively, in some embodiments, the right-side material-transfer brooms 30 and 30-1 may be rotated CW or CCW and may be engaged with the surface being swept.

In some embodiments, the mode shown in FIG. 20 may be best-suited for sweeping the left curb and gutter area of a street or roadway.

FIG. 21 illustrates a third sweeping operational state or mode, sometimes referred to as the "all-sweep" mode, in which the left side-broom 24 and the right side-broom 22 are shown in their respective extended positions. The left side-broom 24 may be rotated in a clockwise direction by its motor, and the right side-broom 22 may be rotated in a counterclockwise direction by its motor. As the sweeper vehicle moves in the direction of travel DT, the counter-rotating side-brooms 22 and 24 may operate to sweep debris toward the general direction of the area between the two side-brooms where a portion of the debris may tend to organize or accumulate into a debris windrow to the right of the clockwise rotating left side-broom 24 and to the left of the counterclockwise rotating right side-broom 22. The thick black arcuate line associated with the left side-broom 24 and the similar thick black arcuate line associated with the right side-broom 22 represent contact patches where the ends of the broom bristles are in optimum contact with the surface being swept to brush debris into the area therebetween. The contact patch may be achieved by preferentially tilting the side-brooms about respective tilt axes and controlling the downward force applied to the broom so that the individual bristles can yield to "push" the debris in the desired direction.

As the sweeper vehicle moves along its direction of travel DT, the debris swept by the first and second side-brooms 22 and 24 may accumulate in the general area therebetween with the five material-transfer brooms 26, 30-1, 28-1, 28, and 30 encountering the debris accumulated by operation of the counter-rotating side-brooms 22 and 24. The primary or apex material-transfer broom 26 may be rotated in a clockwise direction to sweep material in its path in the direction of the arrows toward and with the cooperation of the clockwise rotating intermediate material-transfer broom 30-1 and trailing material-transfer broom 30 to move the debris toward and into the path of the right-side suction-inlet 34. The secondary trailing right side material-transfer broom 30 and the right side intermediate broom 30-1 may trail behind the leading or primary broom 26 and may be generally located to the right of the axis $A_L$-$A_L$ and/or the axis of rotation of the primary broom 26. The left side intermediate broom 28-1 and the secondary trailing material-transfer broom 28, which may trail behind the leading or primary material-transfer broom 26 and may be located generally to the left of the axis $A_L$-$A_L$, may rotate in a counterclockwise direction to move the debris toward and into the path of the left-side suction-inlet 32. The air-flow valves 150 of both suction-inlets, 32 and 34, may be in their open position.

In some embodiments, the operating mode of FIG. 21 may be best suited for relatively narrow streets or lanes in which the outermost edges of the extended side-brooms 22 and 24 extend into the opposite gutters.

In FIG. 21, the choice of the rotational direction for the primary material-transfer broom 26 may be selected or arbitrary. The material-transfer broom 26 is shown as rotating in a clockwise direction; as can be appreciated, the primary material-transfer broom 26 can also be rotated in a counterclockwise direction as shown by the dotted-line arrow.

When the vehicle is in its FIG. 21 "all-sweep" mode and moving in the direction of travel DT, the primary material-transfer broom 26, the first and second spaced intermediate material-transfer brooms 30-1 and 28-1, and the trailing material-transfer brooms 30 and 28 may provide overlapping swept stripes well-suited for sweeping the "crowned" central part of a roadway surface with the material-transfer brooms "riding" the topology of the central part of the roadway as well as the various inclinations and declinations and undulations of the roadway as the sweeper vehicle moves in its direction of travel DT. In some embodiments, the primary material-transfer broom 26, the intermediate material-transfer brooms 30-1 and 28-1, and the first and second spaced trailing material-transfer brooms 30 and 28 may provide a sweeping/scrubbing functionality that may be superior to a horizontally mounted cylindrical tube broom.

In some embodiments, the system described above may operate under the supervision of an appropriately programmed controller that can take the form of one or more stored-program controlled (i.e., firmware and/or software) microprocessors or microcomputers (as well as general-purpose computers or special-purpose processors, including RISC processors), application-specific integrated-circuits (ASIC), programmable logic arrays (PLA), discrete logic or analog circuits, with related non-volatile and volatile memory, and/or combinations thereof. In some embodiments, a commercially available programmable mobile controller from IFM Efector, Inc., Malven Pa. under the part designation CR0234 and an associated keypress/display under part designation CR1081 may be used.

In the context of broom arrangements using intermediate material-transfer brooms 28-1 and 30-1 shown in FIGS. 19, 20, and 21, in some embodiments the controller 200 may treat the intermediate material-transfer broom 28-1 as being slaved to the trailing material-transfer broom 28 and may treat the intermediate material-transfer broom 30-1 as being slaved to the trailing material-transfer broom 30. Thus, when the trailing material-transfer broom 28 receives a command to rotate counterclockwise or to move to its travel position, the intermediate material-transfer broom 28-1 may also receive a command to rotate counterclockwise or to move to its travel position. In a similar manner, when the trailing material-transfer broom 30 receives a command to rotate clockwise or to move to its travel position, the intermediate material-transfer broom 30-1 may also receive a command to rotate clockwise or to move to its travel position. Alternatively, in some embodiments, the intermediate material-transfer brooms 28-1 and 30-1 may be controlled independently of the trailing material-transfer brooms 28 and 30.

In the embodiments described above, the leading material-transfer broom 26, depending upon the operating state or mode, may move debris toward the left side of the vehicle or the right side of the vehicle. The trailing material-transfer brooms 30 and 28 may also serve to laterally displace the debris to a position on the left side of the vehicle and on the right side of the vehicle into the path of the left side suction inlet 32 or the right side suction inlet 34 for entrainment into the respective suction-inlet when the valve plate 150 for the respective suction-inlet valve is open. Since, in the embodiments described above, the broom 30 and the broom 28 may have a nominal diameter of about 24 inches (about 70 cm.) and may be spaced-apart about 6 inches (about 15.2 cm.) from the periphery of one broom to the periphery of the other broom, the debris accumulations may be separated by about 54 inches (about 137 cm.). As can be appreciated, the dimensions mentioned are representative only and may vary as a function of the design constraints for the particular sweeper vehicle.

Figure 22:
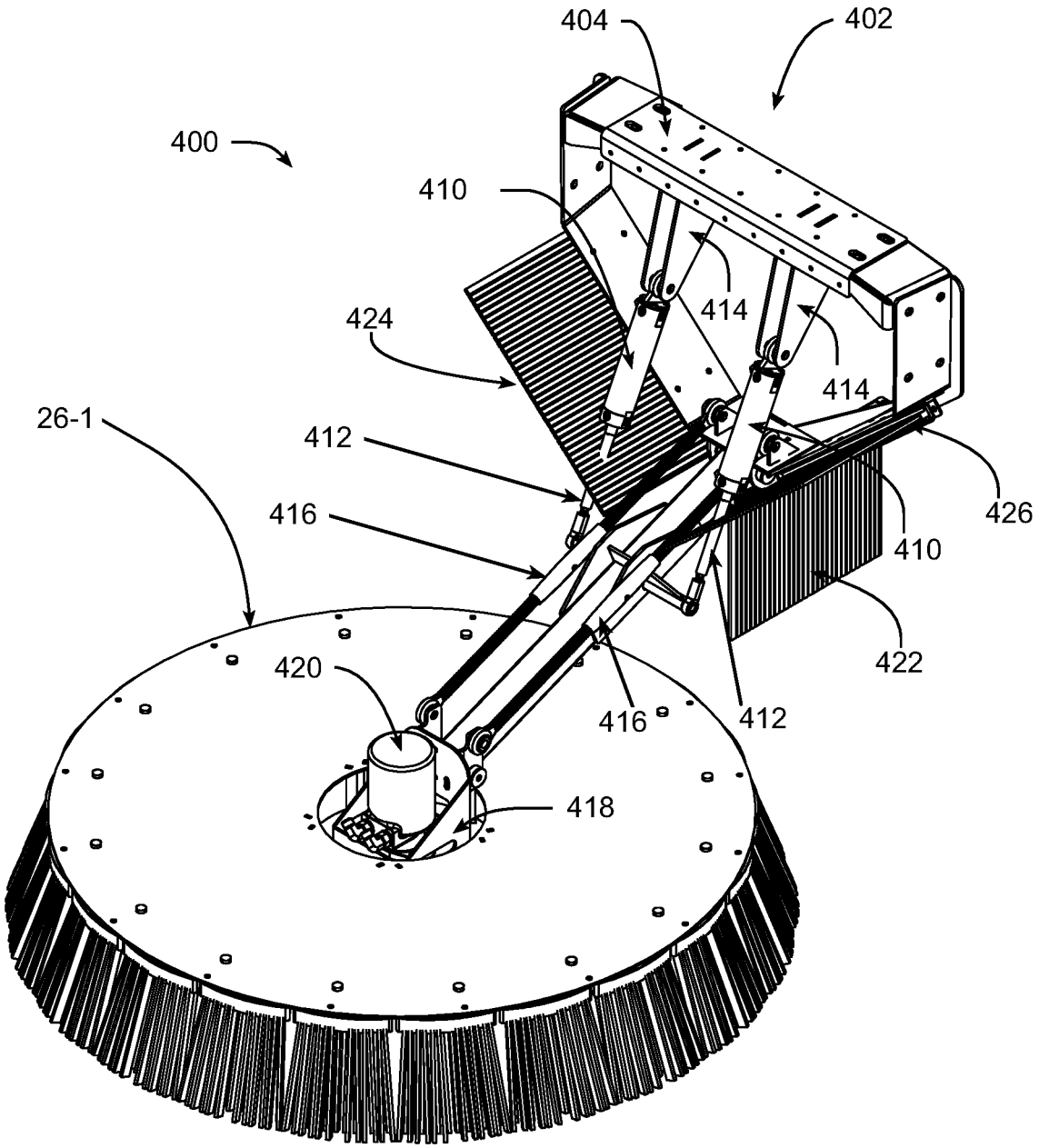
FIG. 22 is a perspective view of a single transfer-broom variant.

FIG. 22 presents a broom assembly 400 having a single primary broom 26-1 with a diameter that generally corresponds to the equivalent diameter of the trailing brooms 28 and 30 (e.g., about 54 inches or 137 cm.) in the embodiments above; the primary broom 26-1 can be rotated in one direction or the other (i.e., clockwise or counterclockwise). As shown, the broom assembly 400 may include a mounting structure 402 having a primary support beam 404 for mounting directly or indirectly on or between the frame rails FR1 and FR2 (FIG. 2) or other portion of the undercarriage of the vehicle. A pair of lift control cylinders, each including a cylinder 410 and associated operating rod 412, may be connected at their proximate end to a pair of spaced brackets 414 that may depend from the support beam 404. Additionally, a pair of turnbuckles 416 may be connected at their proximate end to the lower portion of the mounting structure 402 and at their remote end to a motor support bracket 418 that receives the bidirectional motor 420.

The mounting structure 402 may be provided with three dust suppression combs 422, 424, and 426. Each dust suppression comb may include an array of spaced-parallel, resilient, and shape-sustaining members that serve as a partial barrier to dust or debris migration therethrough.

Figure 23:
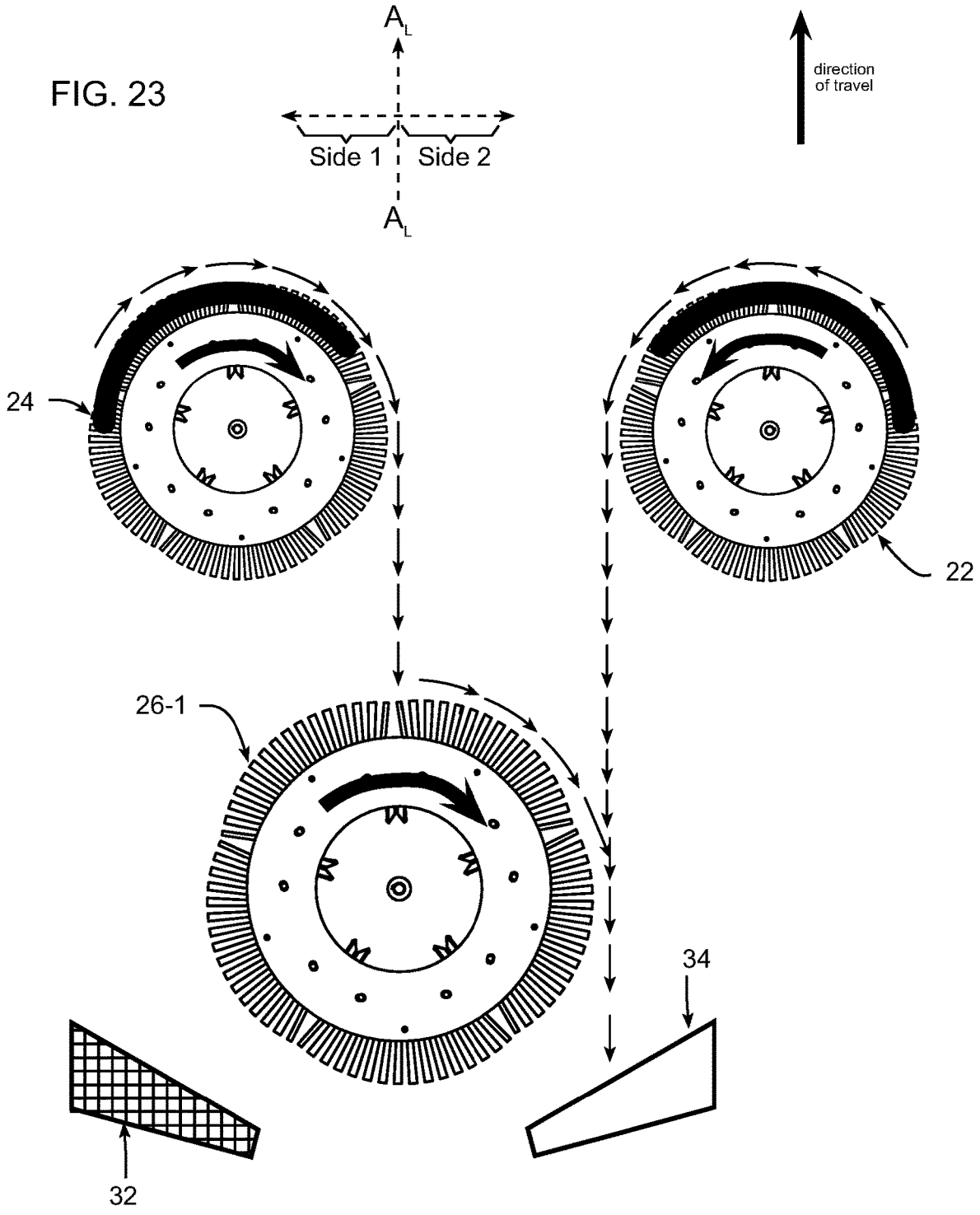
FIG. 23 is a top view of the single transfer-broom variant of FIG. 22 and two side brooms in a first sweeping mode.

FIG. 23 illustrates a first sweeping mode, sometimes designated as the right-side sweeping mode, in which the left side-broom 24 may be positioned in its retracted position and rotated clockwise and the right side-broom 22 may be positioned in its extended position and rotated counterclockwise, the two side-brooms 24 and 22 brushing debris into the area generally between the side-brooms. In FIG. 23, the suction-inlet 34 may be open (the valve plate 150 may be moved to the open position to allow airflow therethrough) and the suction-inlet 32 may be closed.

As the sweeper vehicle moves in its direction of travel DT, the clockwise rotating side-broom 24 may move debris to the right to form a debris windrow extending from the right-hand side of the side-broom 24 with the debris windrow being intercepted by the clockwise rotating primary-broom 26-1. The counterclockwise rotating side-broom 22 may move debris to its left side to form a debris windrow extending from the left-hand side of the side-broom 22 with the debris windrow being intercepted by the suction-inlet 34 for pickup thereby. The clockwise rotating primary-broom 26-1 may move its debris to the right into the suction stripe of the suction-inlet 34, as the sweeper vehicle moves in its direction of travel DT. As a consequence, a substantial portion of the swept debris may be entrained into the air flow through the suction-inlet 34 for deposit and accumulation in the debris hopper 42.

Figure 24:
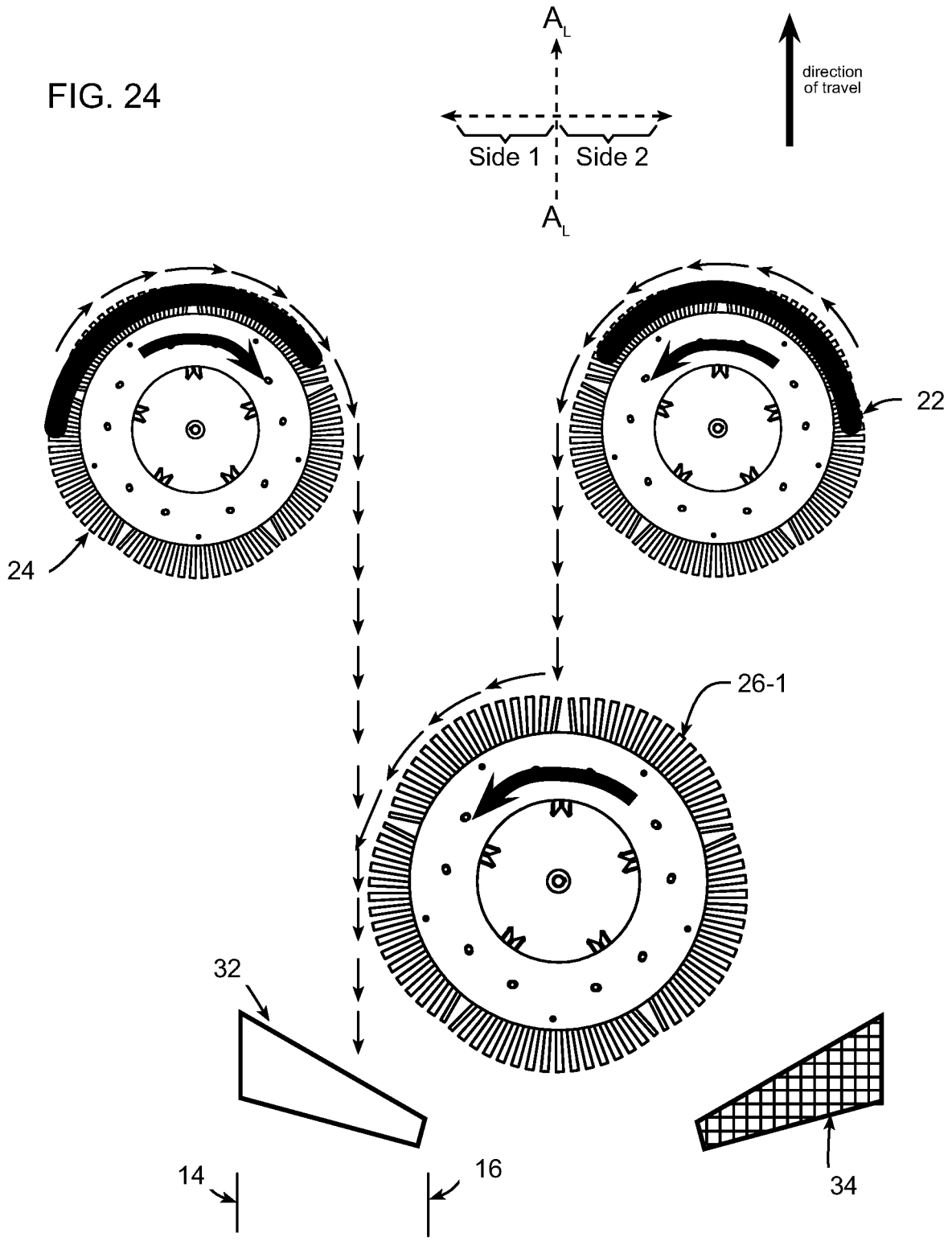
FIG. 24 is a top view of the single transfer-broom variant of FIG. 22 and two side brooms in a second sweeping mode.

FIG. 24 illustrates a second sweeping operational state or mode, sometimes designated as the left-side sweeping mode, in which the left side side-broom 24 may be positioned in its extended position and rotated clockwise as the sweeper vehicle moves in its direction of travel DT and the right side side-broom 22 may be positioned in its retracted position and rotated counterclockwise, the two side-brooms 24 and 22 brushing debris into the area generally between the side-brooms 24 and 22. As the sweeper vehicle moves in its direction of travel DT, the left side-broom 24 may form a debris windrow that may be aligned with open suction-inlet 32 for pickup thereby. The right side-broom 22 may form a debris windrow on its left side that may be intercepted by the counterclockwise rotating primary broom 26-1 to transfer the debris to the open suction-inlet 32. The debris may be entrained into the air flow through the suction inlet 32 for deposit and accumulation in the debris hopper 42.

FIGS. 25-28 illustrate a further variant of the disclosed sweeper system including a swing-arm broom assembly 500 mounted for pivotal movement between first and second positions about an axis Ax that may or may not be approximately coextensive with the axis Av of the material-transfer broom 26 described above. The swing-arm broom assembly 500 may include a trailing arm carrying a further material-transfer broom that, depending upon the pivotal position of the broom assembly 500, may assume the function of the left-side trailing material-transfer broom 28 or the right-side trailing material-transfer broom 30 described above.

As shown in FIGS. 25-28, the swing-arm broom assembly 500 may include a support assembly 502 for connecting the broom assembly 500 directly or indirectly to the vehicle chassis and/or vehicle undercarriage. The support assembly 502 may include a beam member 504 with aperture plates 506 for mounting the beam member 504 to the vehicle frame rails (FIG. 2) and/or other portions of the undercarriage. The remaining components of the broom assembly 500 may be carried by the support beam 504 and pivoted thereabout axis Ax under the control of a bidirectional fluidic actuator 514, for example. In some embodiments, the support assembly 502 may be mounted so that the pivot axis Ax of the swing-arm assembly is substantially coextensive or coincident with the axis of rotation Av of the material-transfer broom 26 (illustrated by the dashed line circle in FIG. 25).

Figure 25:
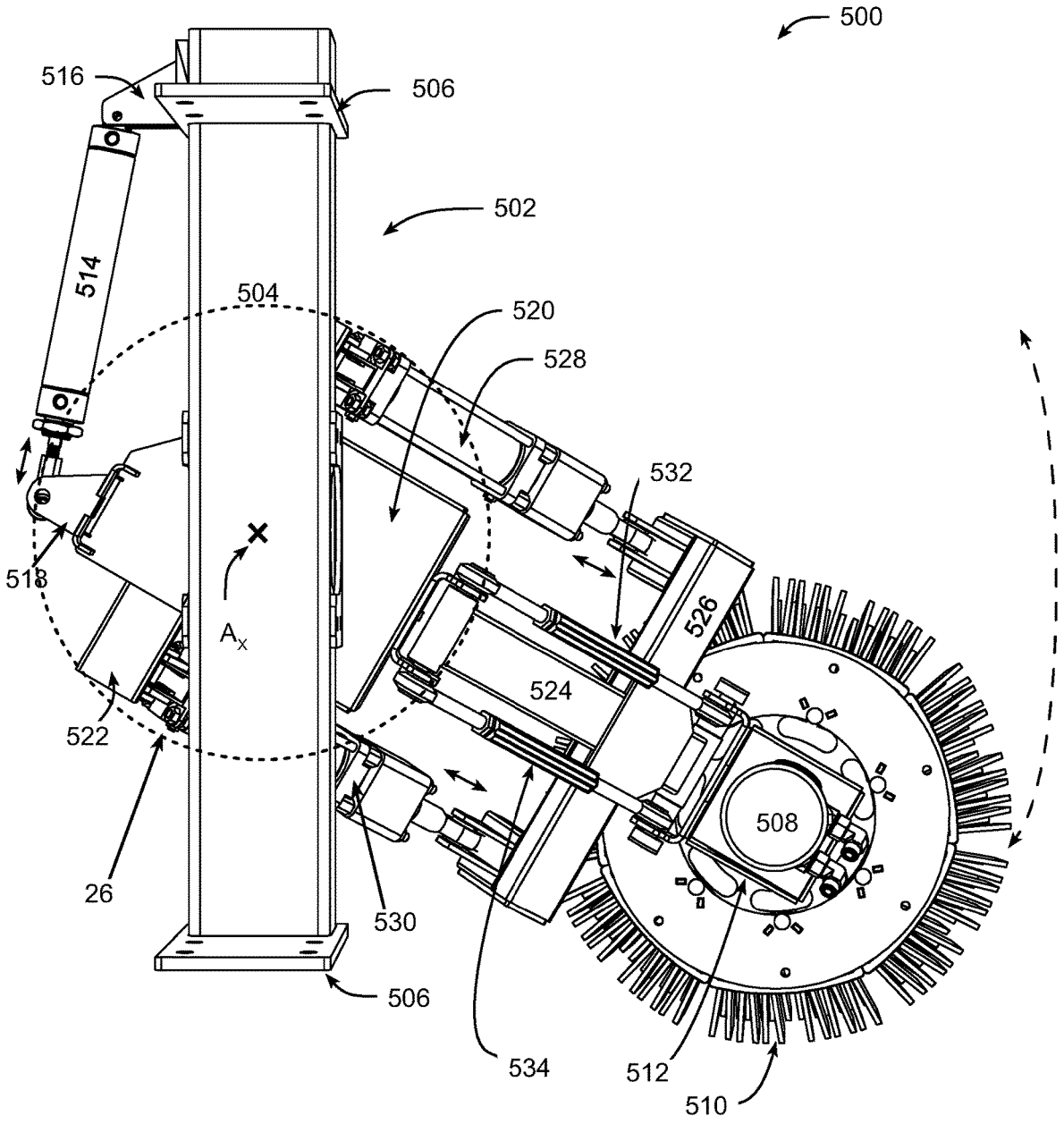
FIG. 25 is a top or plan view of a single-broom swing-arm broom assembly.
Figure 26:
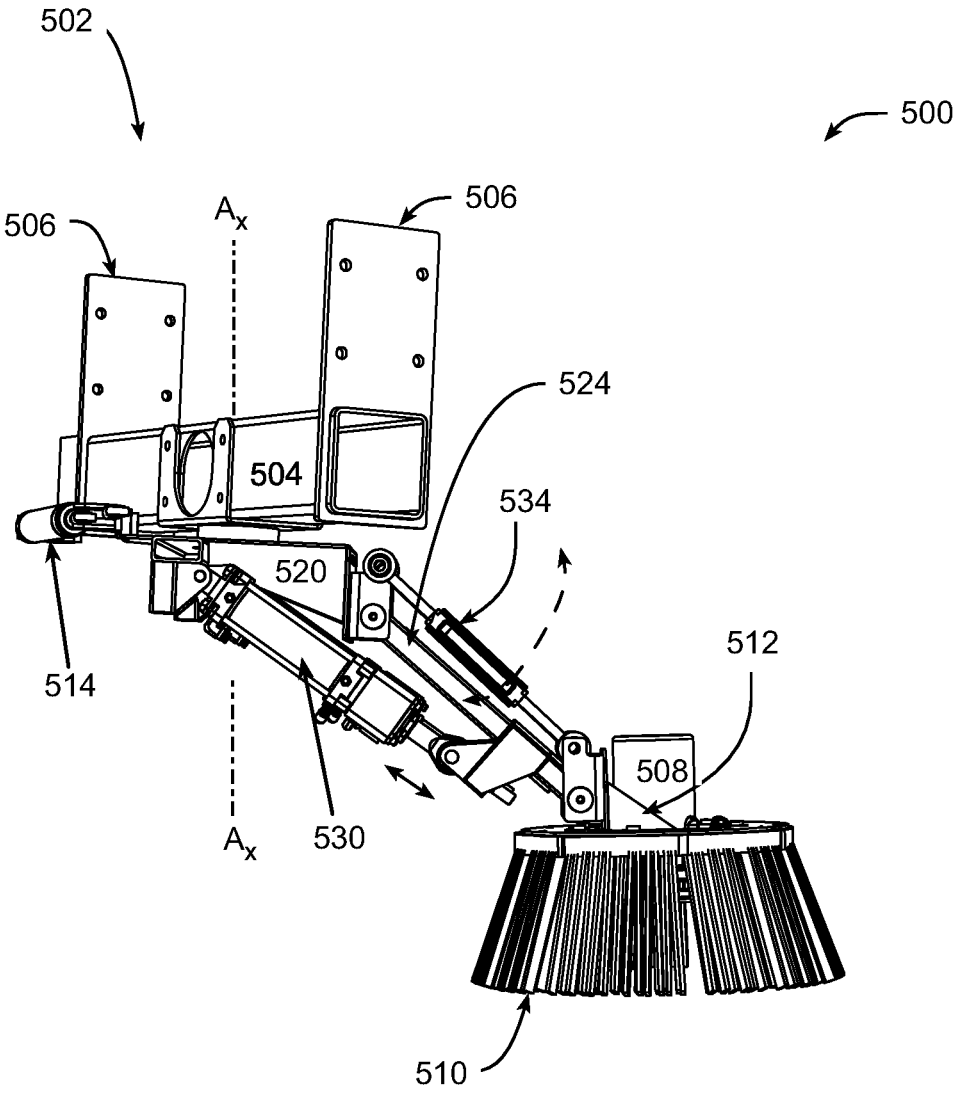
FIG. 26 is a side view of the single-broom swing-arm broom assembly of FIG. 25.
Figure 27:
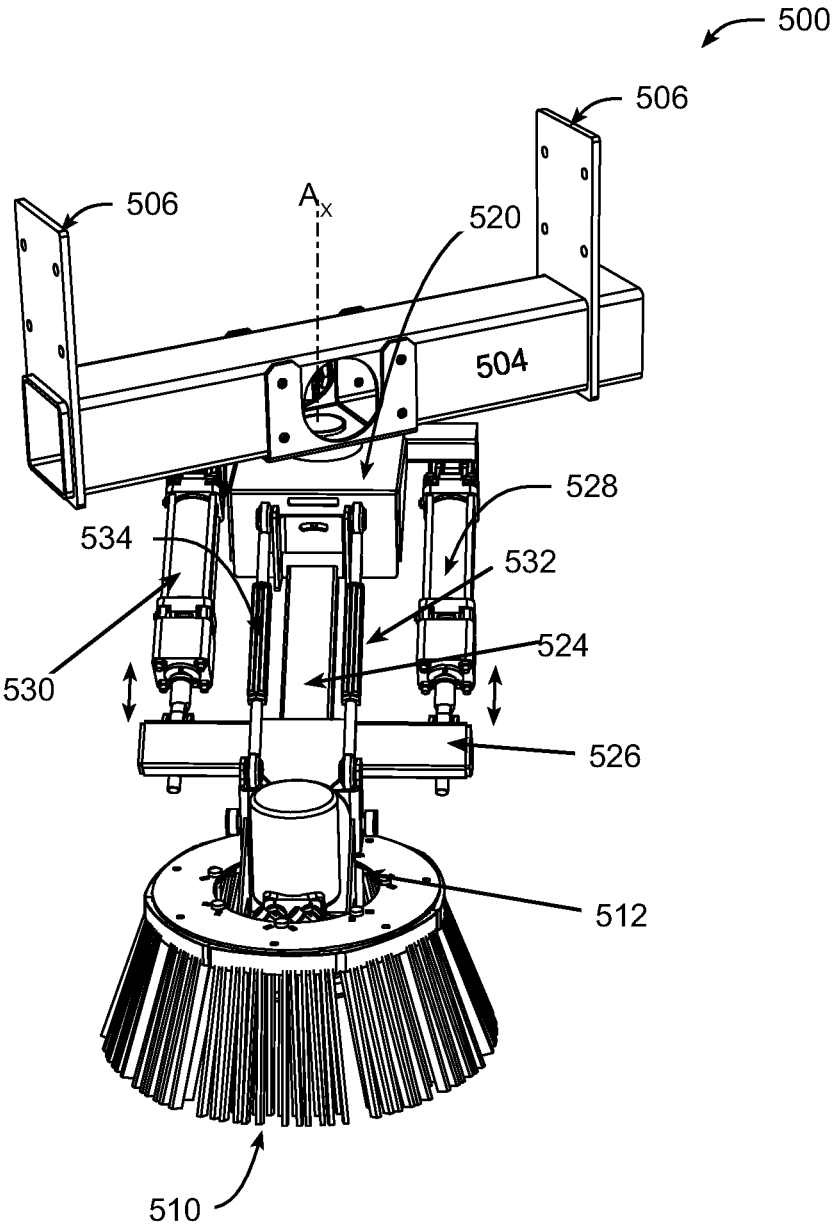
FIG. 27 is perspective view of the single-broom swing-arm broom assembly of FIG. 25.
Figure 28:
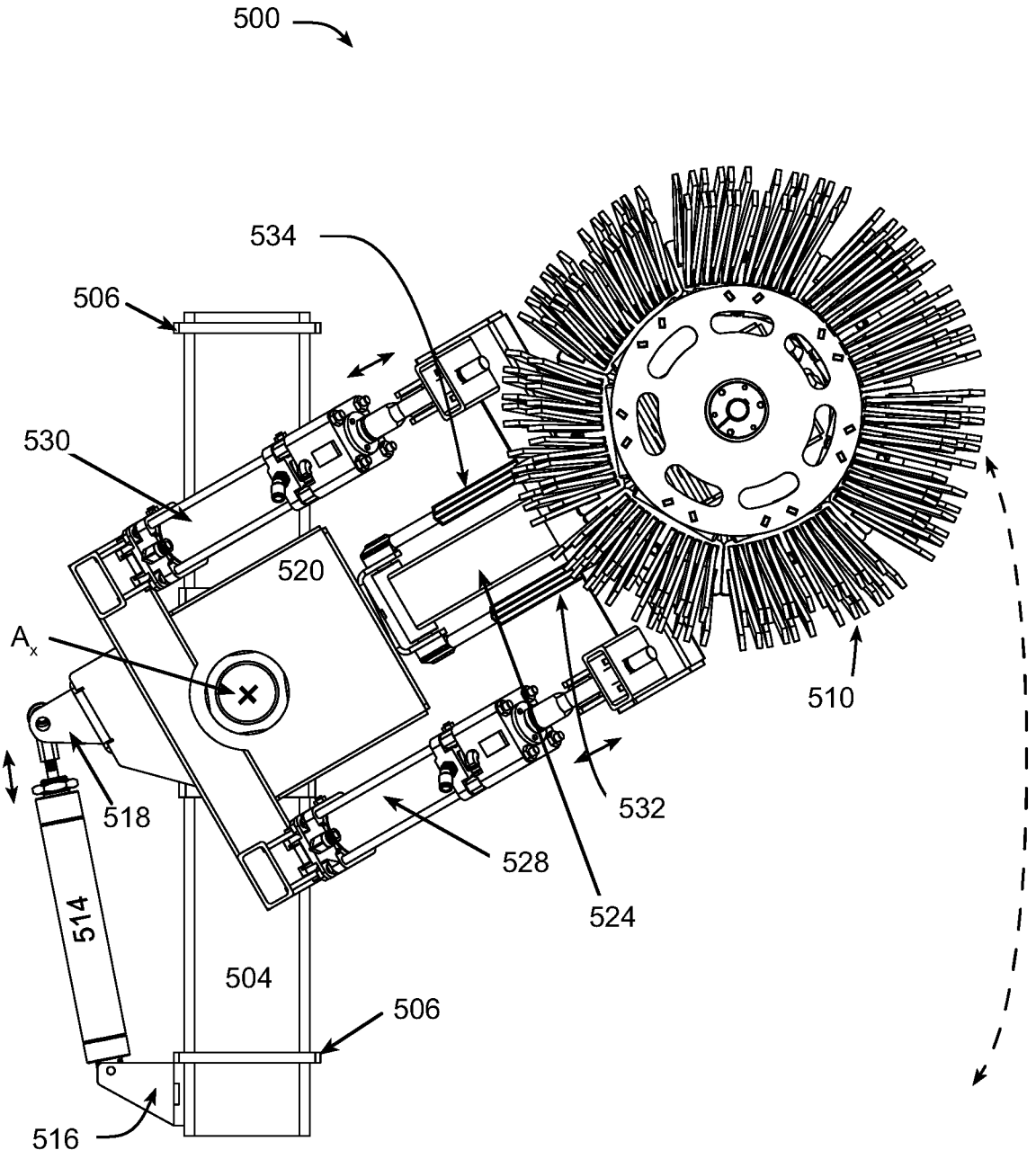
FIG. 28 is a bottom view of the single-broom swing-arm broom assembly of FIG. 25.

As shown, the proximate or base end of actuator 514 may be connected to a connection bracket 516 and the piston end of the actuator 514 may be connected to another bracket 518. In FIG. 25, when the operating rod of the actuator 514 is extended, the pivotally mounted components may move in the counterclockwise direction, and, when the operating rod of the actuator 514 is retracted, the pivotally mounted components may move in the clockwise direction.

A mounting structure 520 may receive, through appropriate brackets and bushings, for example, the base end of bidirectional actuators 528 and 530 as well as the base end of a trailing arm 524. The remote end of the trailing arm 524 may include a transverse member 526 to which the operating rods of the actuators 528 and 530 are attached. The remote ends of turnbuckles 532 and 534 may be connected to a motor bracket 512 which in turn may receive a bidirectional hydraulic motor 508. The motor 508, in turn, may drive the material-transfer broom 510.

As can be appreciated, the bidirectional actuator 514 may be operable to move the pivotable assembly between first and second end positions as well as any intermediate position. Additionally, the actuators 528 and 530, which are typically pneumatically operated (but may be hydraulic), may function to lift the broom 510 from a ground surface engaging sweeping position to a lifted "travel" position and to lower the broom 510 into engagement with the surface to be swept.

Figure 29:
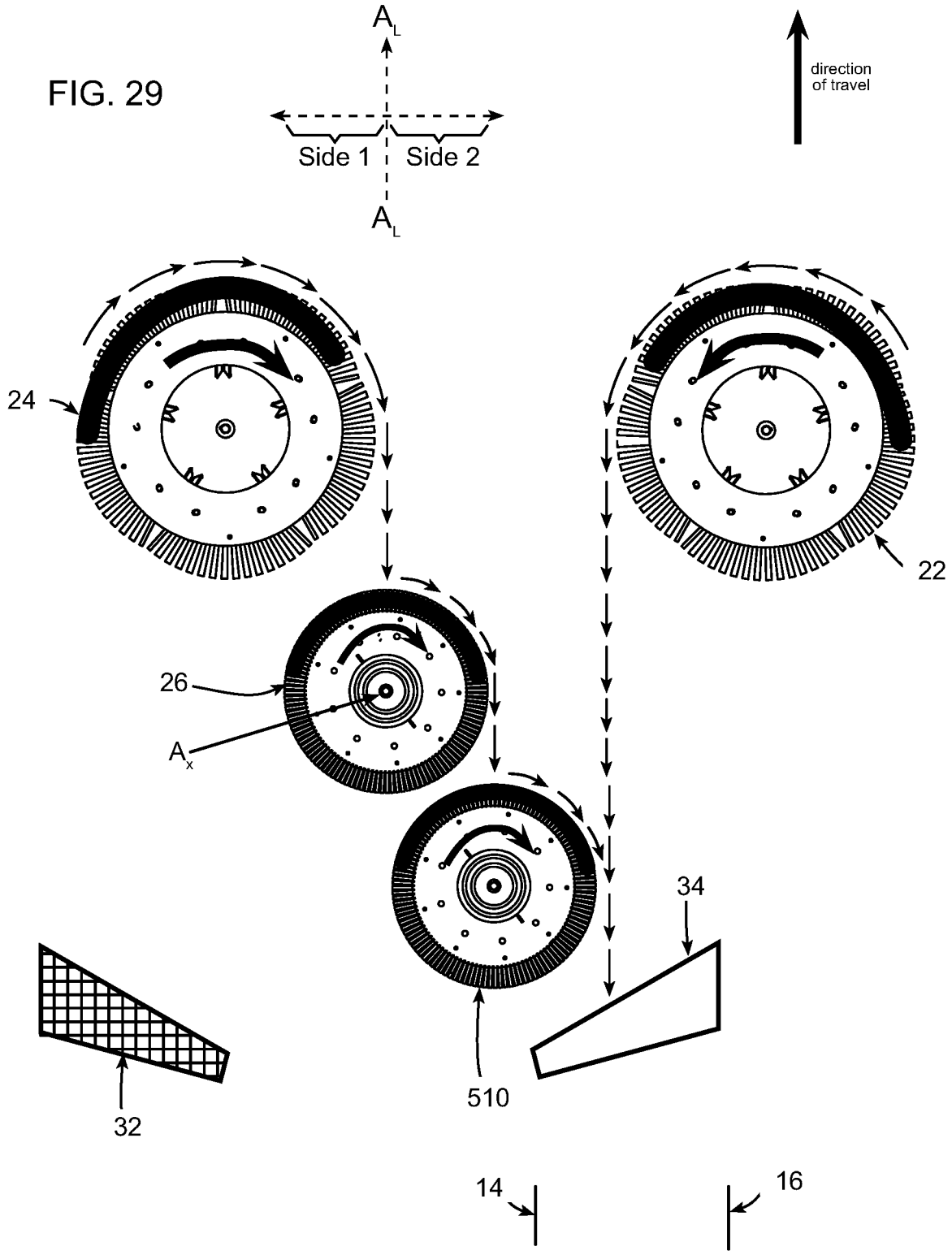
FIG. 29 is a top view of a first sweeping mode for a sweeper employing the single-broom swing-arm broom assembly of FIGS. 25-28.
Figure 30:
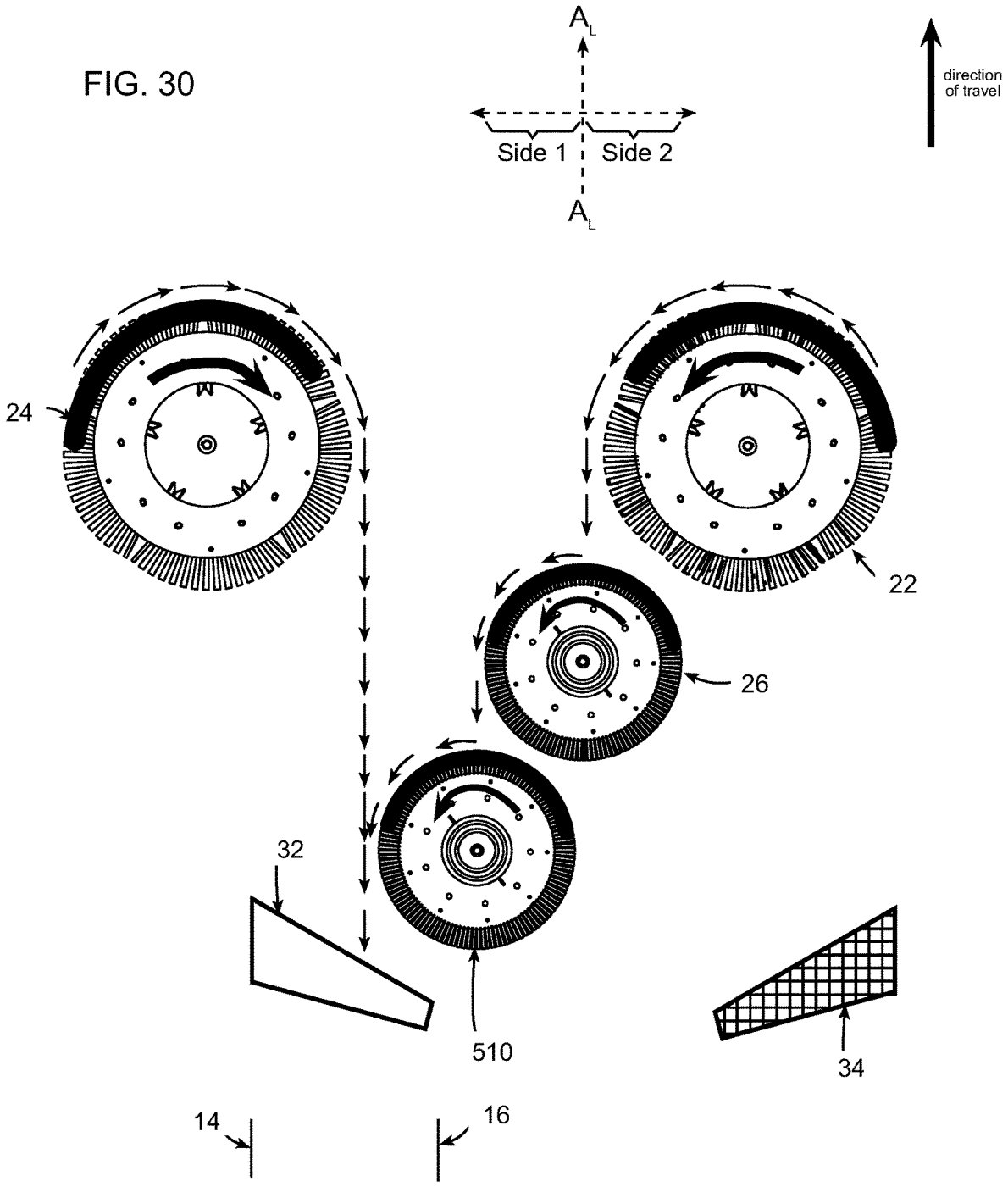
FIG. 30 is a top view of a second sweeping mode for a sweeper employing the single-broom swing-arm broom assembly of FIGS. 25-28.

FIG. 29 and FIG. 30 present first and second operating states or modes using the swing-arm broom assembly 500.

In FIG. 29, which corresponds functionally to FIG. 14 and which presents the right-side sweeping mode, the swing-arm broom assembly 500 may be operated via the piston/cylinder actuator 514 to swing the broom 510 counterclockwise into the position shown in FIG. 29 to the position occupied by the broom 30 in FIG. 14. As shown in FIG. 29, the left side-broom 24 may rotate clockwise to brush the debris to its right side edge to form a debris windrow. The right side-broom 22 may rotate counterclockwise to brush debris to its left side to form a debris windrow that may be intercepted by the suction-inlet 34 for pickup thereby. The broom 26 and the broom 510 may be rotated in the clockwise direction to brush debris accumulated between the side-brooms 22 and 24 to the right into the pathway of the suction inlet 34 for entrainment thereinto, which corresponds functionally to FIG. 14. FIG. 30 presents the left-side sweeping mode in which the swing-arm broom assembly 500 may be operated via the piston/cylinder actuator 514 to swing the broom 510 clockwise into the position shown in FIG. 30 (corresponding to the position occupied by the broom 28 in FIG. 15). As shown in FIG. 30, the left side-broom 24 may be rotated clockwise to transfer debris to its right edge with the debris forming a windrow that may be aligned with the open suction-inlet 32 for pickup thereby. The right side-broom 22 may rotate counterclockwise to transfer debris to its left edge for transfer to the counterclockwise rotating primary broom 26 and the broom 510 for transfer of the debris to the suction inlet 32 for entrainment and pickup thereby.

Figure 31:
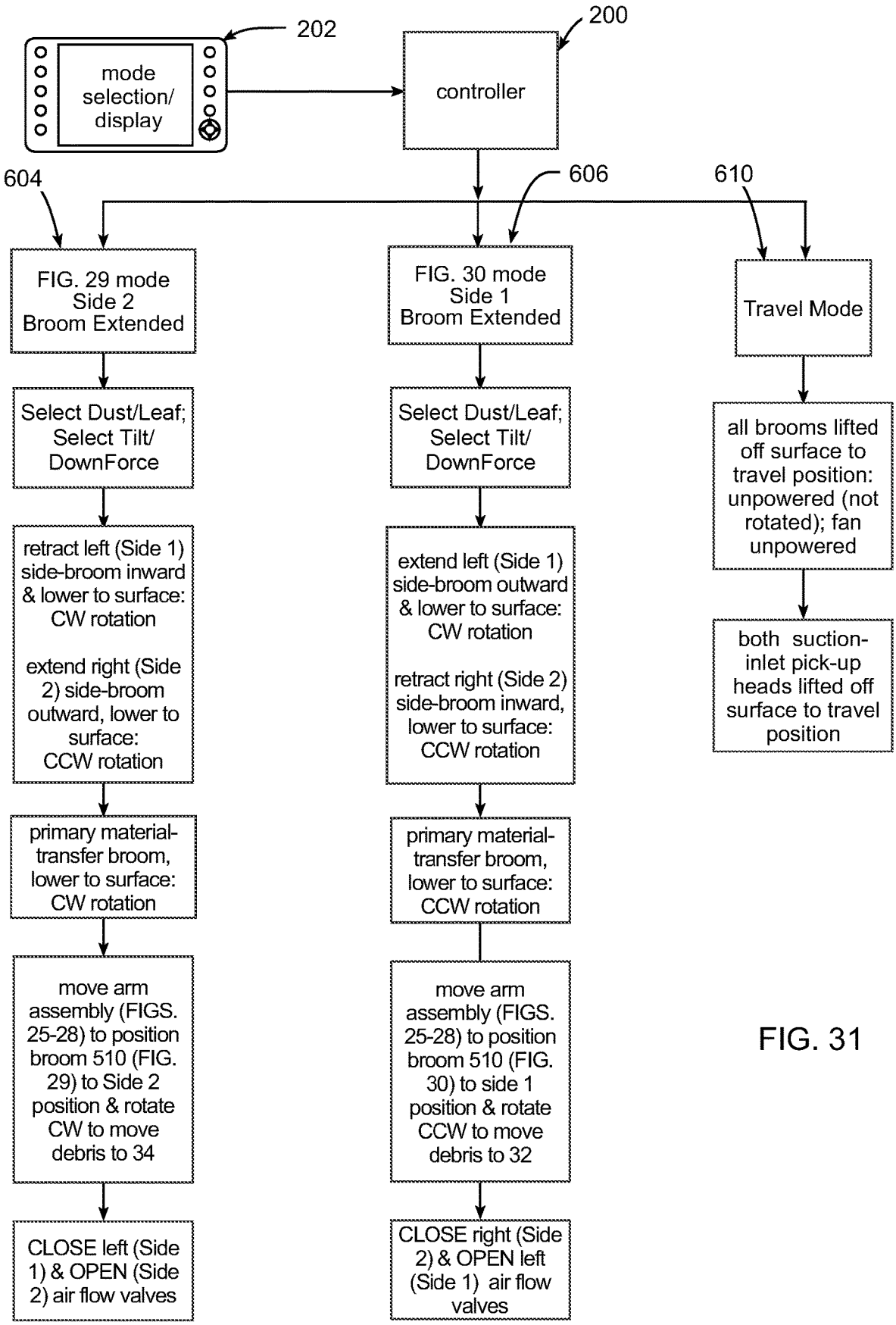
FIG. 31 is an operational state or flow chart for arranging the organization of the brooms shown in FIGS. 29 and 30.

FIG. 31 is an operational flow chart for arranging the organization of the brooms shown in the FIGS. 25-28 and presents operational steps in column 604 for right side sweeping, operational steps in column 606 for left side sweeping, and the operational steps for the travel mode shown in column 610. In some embodiments, such as the FIG. 29 and FIG. 30 modes, for example, controller 200 may allow operator selection of or issue commands to set a tilt and/or downforce for each broom, and controller 200 may allow operator selection of or issue commands to set a dust and/or leaf setting for each suction-inlet.

Figure 32:
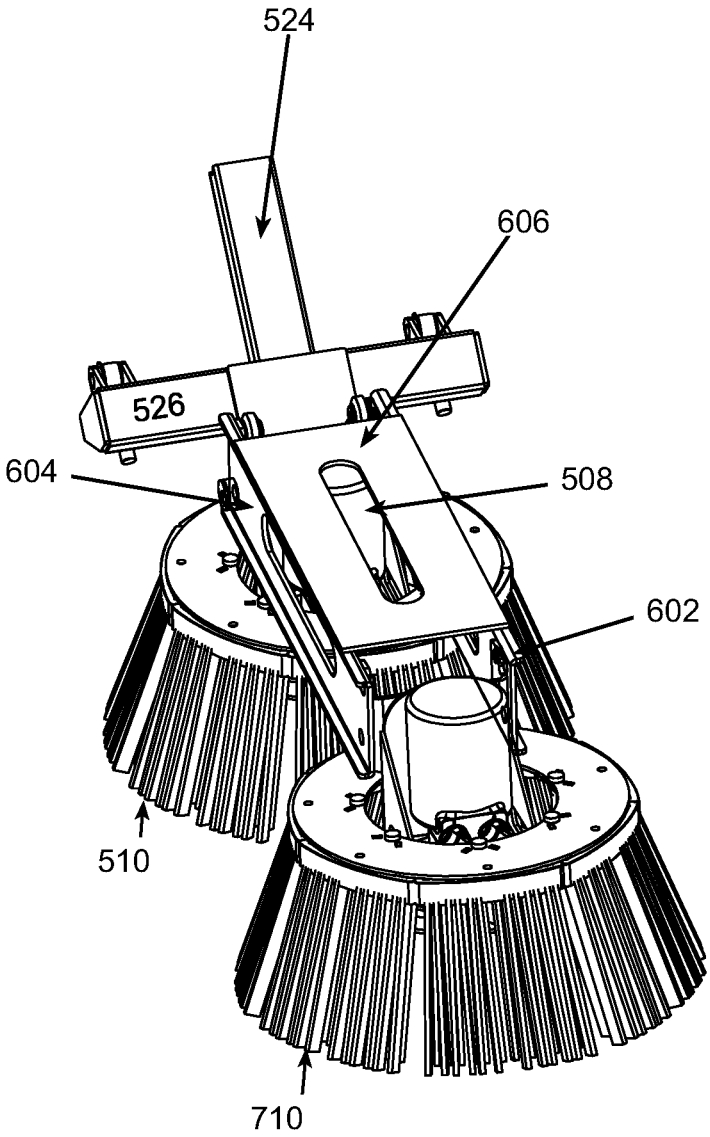
FIG. 32 is a perspective view of the swing-arm broom assembly of FIGS. 25-28 with a second broom mounted to the swing-arm.
Figure 33:
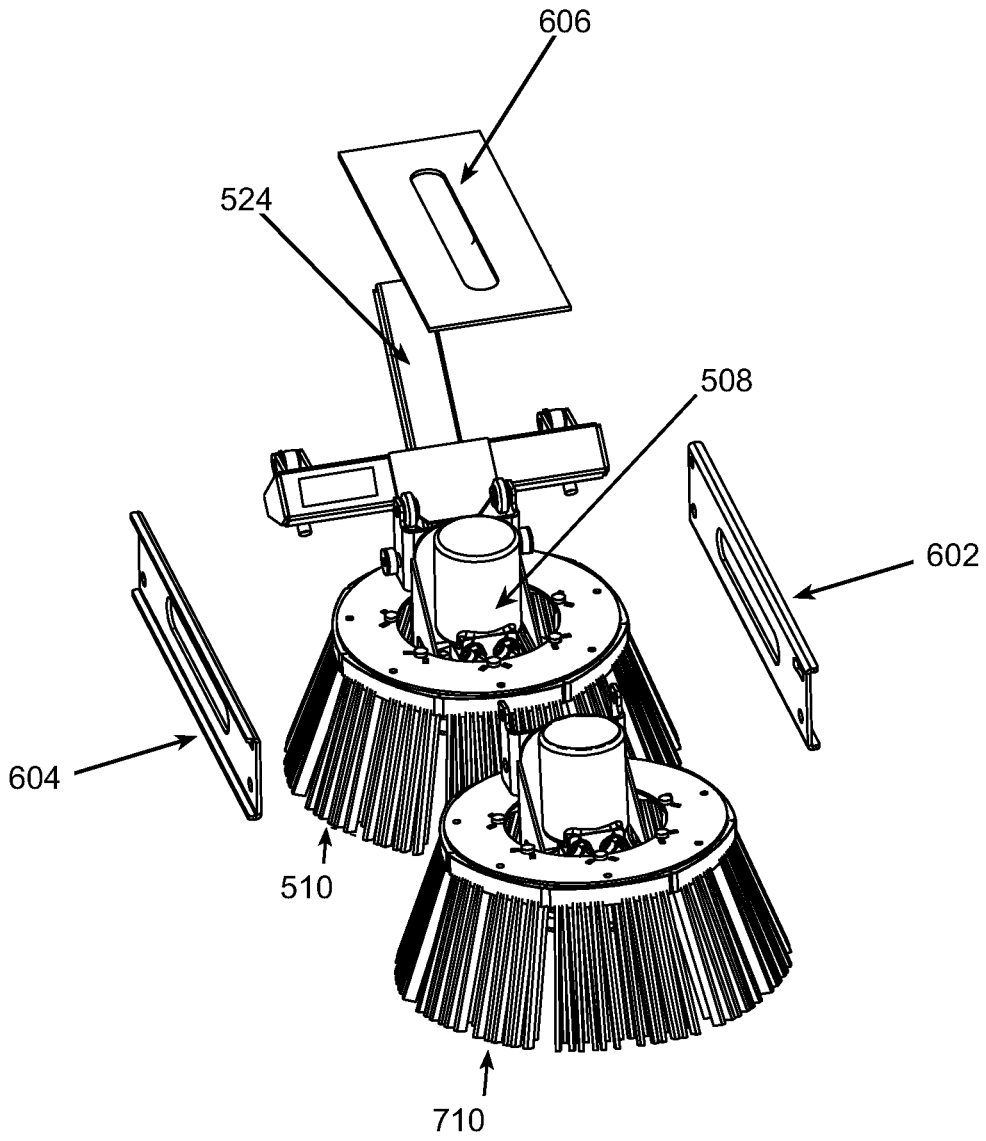
FIG. 33 is a perspective view of the multi-broom swing-arm broom assembly of FIG. 32 with selected components shown in exploded view.

FIGS. 32 and 33 present a variant of the swing-arm broom assembly 500 shown in FIGS. 25-28 in which a second trailing broom 710 may be coupled to the swing-arm shown in FIGS. 25-28.

Figure 34:
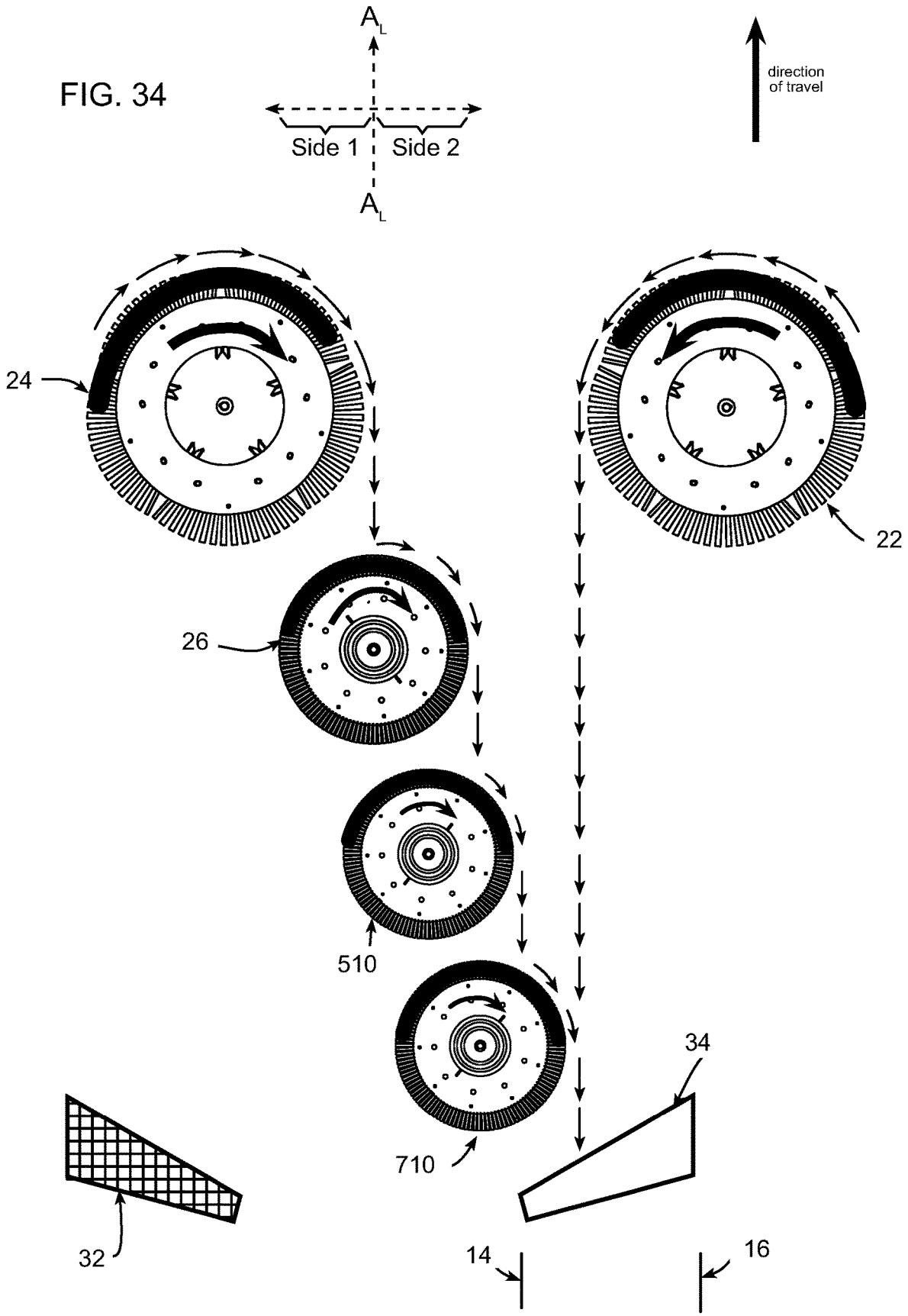
FIG. 34 is a top view of a first sweeping mode for a sweeper employing the multi-broom swing-arm broom assembly of FIG. 32.

In FIG. 34, which corresponds functionally to FIG. 14 and which presents the right-side sweeping mode, the swing-arm broom assembly 500 may be operated via the piston/cylinder actuator 514 to swing the brooms 510 and 710 counterclockwise into the position shown in FIG. 34. The left side-broom 24 may rotate clockwise to brush the debris to its right side edge thereof to form a debris windrow. The right side-broom 22 may rotate counterclockwise to brush debris to its left side to form a debris windrow that may be intercepted by the suction-inlet 34 for pickup thereby. The broom 26 and the broom 510 and the broom 710 may be rotated in the clockwise direction to brush debris from the debris windrow of side-broom 22 and any debris accumulated between the side-brooms 22 and 24 to the right into the pathway of the suction inlet 34 for entrainment thereinto.

Figure 35:
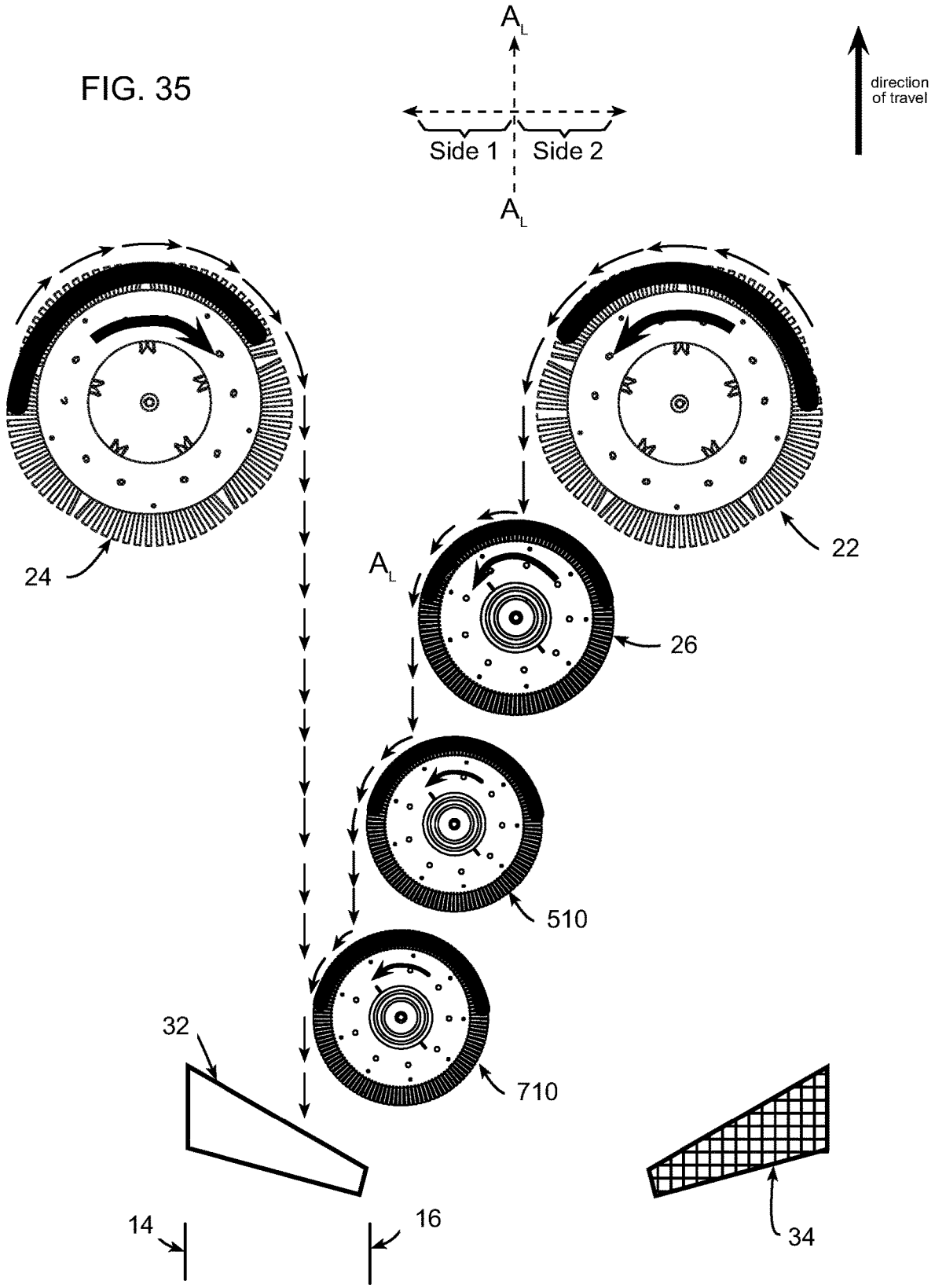
FIG. 35 is a top view of a second sweeping mode for a sweeper employing the multi-broom swing-arm broom assembly of FIG. 32.

FIG. 35, which corresponds functionally to FIG. 15, presents the left-side sweeping mode in which the swing-arm broom assembly 500 may be operated via the piston/cylinder actuator 514 to swing the brooms 510 and 710 clockwise into the position shown in FIG. 35. As shown and FIG. 35, the left side-broom 24 may be rotated clockwise to transfer debris to its right edge with the debris forming a windrow that may be aligned with the open suction-inlet 32 for entrainment and pickup thereby. The right side-broom 22 may rotate counterclockwise to transfer debris to its left edge for transfer to the counterclockwise rotating primary broom 26, the broom 510, and the broom 710 for transfer of the debris to the open suction-inlet 32 for entrainment and pickup thereby.

Alternative Embodiments

There now follows a description of alternative embodiments set out as clauses:

1. A sweeper vehicle for moving in a direction of travel to remove debris from a roadway surface being swept, including:

at least a first and a second side-broom mounted to the vehicle, each side-broom movable between a retracted position and an extended position, each of the side-brooms having a motor for rotating its respective side-broom in a direction of rotation to sweep at least a portion of the debris on the surface being swept into an area between the first and second side-brooms;

a first suction-inlet at or adjacent a first side of the vehicle and a second suction-inlet at or adjacent a second side of the vehicle, each suction-inlet connected through a respective air-flow valve to a debris hopper, each air-flow valve operable between a substantially open position and a substantially closed position;

a fan for creating an air flow through the debris hopper and at least one of the suction-inlets when the valve associated with the at least one suction-inlet is in its substantially open position;

a primary material-transfer broom having a respective motor for rotating the primary material-transfer broom about an axis of rotation;

a first secondary material-transfer broom having a respective motor for rotating the first secondary material-transfer broom about an axis of rotation in a first direction of rotation for transferring at least a portion of the debris in a direction for pickup by the first suction-inlet as the sweeper vehicle moves in the direction of travel;

a second secondary material-transfer broom having a respective motor for rotating the second secondary material-transfer broom about an axis of rotation in a second direction of rotation for transferring at least a portion of the debris in a direction for pickup by the second suction-inlet as the sweeper vehicle moves in the direction of travel;

the primary material-transfer broom rotatable in a selected one of a first direction of rotation to transfer at least a portion of the debris to the first secondary material-transfer broom and a second direction of rotation to transfer at least a portion of the debris to the second secondary material-transfer broom.

2. The sweeper vehicle of clause 1, further including: a stored-program controlled processor for controlling the side-brooms, the material-transfer brooms, and the air-flow valves to organize the side-brooms, material-transfer brooms, and air-flow valves into at least two operational states.

3. The sweeper vehicle of clause 2, the sweeper vehicle having a first operational state, including:

the first side-broom positioned at or near its retracted position and the second side-broom positioned at or near its extended position, both side-brooms rotated in a respective direction to sweep debris into an area between the first and second side-brooms, and the primary material-transfer broom and the second secondary material-transfer broom rotated to sweep debris in a direction for pickup by the second suction-inlet, the air-flow valve operatively associated with the second suction-inlet substantially opened and the air-flow valve operatively associated with the first suction-inlet substantially closed.

4. The sweeper vehicle of clause 3, wherein:

the first secondary material-transfer broom moved to a raised position out of engagement with the surface being swept.

5. The sweeper vehicle of clause 2, the sweeper vehicle having a second operational state, including:

the first side-broom positioned at or near its extended position and the second side-broom positioned at or near its retracted position, both side-brooms rotated in respective directions to sweep debris into an area between the first and second side-brooms, and the primary material-transfer broom and the first secondary material-transfer broom rotated to sweep debris in a direction for pickup by the first suction-inlet as the vehicle moves in the direction of travel, the air-flow valve operatively associated with the second suction-inlet substantially closed and the air-flow valve operatively associated the first suction-inlet substantially open.

6. The sweeper vehicle of clause 5, wherein:

the second secondary material-transfer broom is moved to a raised position out of engagement with the surface being swept.

7. The sweeper vehicle of clause 2, the sweeper vehicle having a third operational state, including:

the first and second side-brooms positioned at or near their respective extended positions and each side-broom respectively rotated in a direction to sweep debris into an area between the first and second side-brooms, the primary material-transfer broom and one of the secondary material-transfer brooms rotated in the same direction to sweep debris in a direction for pickup by one of the first and second suction-inlets and the other of the secondary material-transfer brooms rotated a direction to sweep debris in a direction for pickup by the other of the first and second suction-inlets, the air-flow valve operatively associated with the first suction-inlet substantially open and the air-flow valve operatively associated with the second suction-inlet substantially open.

8. The sweeper vehicle of clause 2, the sweeper vehicle further including: a first intermediate material-transfer broom mounted intermediate the primary material-transfer broom and the first secondary material-transfer broom and operationally slaved to the first secondary material-transfer broom for rotation in the same direction therewith, and a second intermediate material-transfer broom mounted intermediate the primary material-transfer broom and the second secondary material-transfer broom and operationally slaved to the second secondary material-transfer broom for rotation in the same direction therewith.

9. The sweeper vehicle of clause 2, the sweeper vehicle further including an air flow recirculation system including:

an air flow diverter for diverting a portion of the air flow from an outlet portion of the fan into an air flow conduit for discharge therefrom in a vicinity of a selected one of the first and second suction-inlets so that at least a portion of the air flow discharged is introduced into the selected suction-inlet.

10. The sweeper vehicle of clause 2, further including a debris exhaust system including:

an air flow diverter for diverting a portion of the air flow from an outlet portion of the fan into an air flow conduit for discharge therefrom onto the surface being swept.

11. A sweeper vehicle system for moving in a direction of travel to remove debris from a roadway surface being swept, including:

at least a first and a second side-broom mounted to the vehicle, each side-broom movable between a respective retracted position and an extended position, each of the side-brooms having a motor for rotating its respective side-broom in a direction of rotation to sweep at least a portion of the debris on the surface being swept into an area between the first and second side-brooms, the first side-broom in its retracted position and the second side-broom in its extended position;

a first suction-inlet at or adjacent a first side of the vehicle and a second suction-inlet at or adjacent a second side of the vehicle, each suction-inlet connected through a respective air-flow valve to a debris hopper, each air-flow valve operable between a substantially open position and a substantially closed position, the air-flow valve for the second suction-inlet in its substantially open position;

a fan for creating an air flow through the debris hopper and at least one of the suction-inlets when the valve associated with the at least one suction-inlet is in its substantially open position;

a primary material-transfer broom having a respective motor for rotating the primary material-transfer broom in a selected one of a first direction of rotation and a second direction of rotation;

a first secondary material-transfer broom having a respective motor for rotating the first secondary material-transfer broom in at least a first direction of rotation for transferring at least a portion of the debris in a direction for pickup by the first suction-inlet as the sweeper vehicle moves in the direction of travel;

a second secondary material-transfer broom having a respective motor for rotating the second secondary material-transfer broom in at least a second direction of rotation for transferring at least a portion of the debris in a direction for pickup by the second suction-inlet as the sweeper vehicle moves in the direction of travel;

the primary material-transfer broom rotated in its second direction of rotation to transfer at least a portion the debris to the second secondary material-transfer broom, the second secondary material-transfer broom rotated in a direction of rotation to transfer at least a portion of the debris to the second suction-inlet for pickup therethrough as the sweeper vehicle moves in the direction of travel.

12. A sweeper vehicle system for moving in a direction of travel to remove debris from a roadway surface being swept, including:

at least a first and a second side-broom mounted to the vehicle, each side-broom movable between a respective retracted position and an extended position, each of the side-brooms having a motor for rotating its respective side-broom in a direction of rotation to sweep at least a portion of the debris on the surface being swept into an area between the first and second side-brooms, the first side-broom in its extended position and the second side-broom in its retracted position;

a first suction-inlet at or adjacent a first side of the vehicle and a second suction-inlet at or adjacent a second side of the vehicle, each suction-inlet connected through a respective air-flow valve to a debris hopper, each air-flow valve operable between a substantially open position and a substantially closed position, the air-flow valve associated with the first suction inlet in its substantially open position;

a fan for creating an air flow through the debris hopper and at least one of the suction-inlets when the valve associated with the at least one suction-inlet is in its substantially open position;

a primary material-transfer broom having a respective motor for rotating the primary material-transfer broom about a respective axis of rotation in a selected one of a first direction of rotation for transfer of at least a portion of the debris in a first direction and a second direction of rotation for transfer of at least a portion of the debris in a second direction;

a first secondary material-transfer broom having a respective motor for rotating the first secondary material-transfer broom about a respective axis of rotation in at least a first direction of rotation for transferring at least a portion the debris in a direction for pickup by the first suction-inlet as the sweeper vehicle moves in the direction of travel;

a second secondary material-transfer broom having a respective motor for rotating the second secondary material-transfer broom about a respective axis of rotation in at least a second direction of rotation for transferring at least a portion of the debris in a direction for pickup by the second suction-inlet as the sweeper vehicle moves in the direction of travel;

the primary material-transfer broom rotated in its first direction of rotation to transfer at least a portion of the debris to the first secondary material-transfer broom, the first secondary material-transfer broom rotated in a direction of rotation to transfer at least a portion of the debris to the first suction-inlet for pickup therethrough as the sweeper vehicle moves in the direction of travel.

13. A sweeper vehicle system for moving in a direction of travel to remove debris from a roadway surface being swept, including:

at least a first and a second side-broom mounted to the vehicle, each side-broom movable between a respective retracted position and an extended position, each of the side-brooms having a motor for rotating its respective side-broom in a direction of rotation to sweep at least a portion of the debris on the surface being swept into an area between the first and second side-brooms, both side-brooms in their extended position;

a first suction-inlet at or adjacent a first side of the vehicle and a second suction-inlet at or adjacent a second side of the vehicle, each suction-inlet connected through a respective air-flow valve to a debris hopper, each air-flow valve operable between a substantially open position and a substantially closed position, each air-flow valve in its substantially open position;

a fan for creating an air flow through the debris hopper and at least one of the suction-inlets when the valve associated with the at least one suction-inlet is in its substantially open position;

a primary material-transfer broom having a respective motor for rotating the primary material-transfer broom about a respective axis of rotation in a selected one of a first direction of rotation for transfer of at least a portion of the debris in a first direction and a second direction of rotation for transfer of at least a portion of the debris in a second direction;

a first secondary material-transfer broom having a respective motor for rotating the first secondary material-transfer broom about a respective axis of rotation in at least a first direction of rotation for transferring at least a portion of the debris in a direction for pickup by the first suction-inlet as the sweeper vehicle moves in the direction of travel;

a second secondary material-transfer broom having a respective motor for rotating the second secondary material-transfer broom about a respective axis of rotation in at least a second direction of rotation for transferring at least a portion of the debris in a direction for pickup by the second suction-inlet as the sweeper vehicle moves in the direction of travel;

the primary material-transfer broom rotated in one of its first and second directions of rotation to transfer at least a portion of the debris to one of the first and second secondary material-transfer brooms;

the first secondary material-transfer broom rotated in a direction of rotation to transfer at least a portion of the debris to the first suction-inlet for pickup therethrough as the sweeper vehicle moves in the direction of travel; and the second secondary material-transfer broom rotated in a direction of rotation to transfer at least a portion of the debris to the second suction-inlet for pickup therethrough as the sweeper vehicle moves in the direction of travel.

14. A sweeper vehicle system for moving in a direction of travel to remove debris from a roadway surface being swept, including:

at least a first and a second side-broom mounted to the vehicle, each side-broom movable between a retracted position and an extended position, each of the side-brooms having a motor for rotating its respective side-broom in a direction of rotation to sweep at least a portion of the debris on the surface being swept into an area between the first and second side-brooms;

a suction-inlet at or adjacent a first side of the vehicle and another suction-inlet at or adjacent a second side of the vehicle, each of the suction-inlets connected through a respective air-flow valve to a debris hopper, each air-flow valve operable between a substantially open position and a substantially closed position;

a fan for creating an air flow through the debris hopper and at least one of the suction-inlets when the valve associated with the at least one suction-inlet is in its substantially open position; and a primary material-transfer broom having a motor, the primary material-transfer broom motor configured for rotating the primary material-transfer broom about an axis of rotation in a first direction of rotation to sweep at least a portion of the debris swept by at least one of the first and second side-brooms in a direction toward the first suction-inlet for pickup thereby when the valve associated with the first suction-inlet is in its substantially open position, and the primary material-transfer broom motor configured for rotating the at least one material-transfer broom about the axis in a second direction of rotation to sweep at least a portion of the debris swept by at least one of the first and second side-brooms in a second direction for pickup by the second suction-inlet when the valve associated with the second suction-inlet is in its substantially open position.

15. A sweeping vehicle system for moving in a direction of travel to remove debris from a roadway surface being swept, including:

at least a first and a second side-broom mounted to the vehicle, each side-broom movable between a retracted position and an extended position, each of the side-brooms having a motor for rotating its respective side-broom in a direction of rotation to sweep at least a portion of the debris on the surface being swept into an area between the first and second side-brooms, the first side-broom in its retracted position and the second side-broom in its extended position;

a suction-inlet at or adjacent a first side of the vehicle and another suction-inlet at or adjacent a second side of the vehicle, each of the suction-inlets connected through a respective air-flow valve to a debris hopper, each air-flow valve operable between a substantially open position and a substantially closed position;

a fan for creating an air flow through the debris hopper and at least one of the suction-inlets when the valve associated with the at least one suction-inlet is in its substantially open position; and a material-transfer broom having a motor for rotating the material-transfer broom about an axis of rotation in a direction of rotation to sweep at least a portion of the debris in the area between the first and second side-brooms in a direction for pickup by the second suction-inlet when the valve associated with the second suction-inlet is in its substantially open position.

16. A sweeper vehicle system for moving in a direction of travel to remove debris from a roadway surface being swept, including:

at least a first and a second side-broom mounted to the vehicle, each side-broom movable between a retracted position and an extended position, each of the side-brooms having a motor for rotating its respective side-broom in a direction of rotation to sweep at least a portion of the debris on the surface being swept into an area between the first and second side-brooms, the first side-broom in its extended position and the second side-broom in its retracted position;

a suction-inlet at or adjacent a first side of the vehicle and another suction-inlet at or adjacent a second side of the vehicle, each of the suction-inlets connected through a respective air-flow valve to a debris hopper, each air-flow valve operable between a substantially open position and a substantially closed position;

a fan for creating an air flow through the debris hopper and at least one of the suction-inlets when the valve associated with the at least one suction-inlet is in its substantially open position; and a material-transfer broom having a motor for rotating the material-transfer broom about an axis of rotation in a direction of rotation to sweep at least a portion of the debris in the area between the first and second side-brooms in a direction for pickup by the first suction-inlet when the valve associated with the first suction-inlet is in its substantially open position.

17. A sweeper vehicle system for moving in a direction of travel to remove debris from a roadway surface being swept, including:

at least a first and a second side-broom mounted to the vehicle, each side-broom movable between a retracted position and an extended position, each of the side-brooms having a motor for rotating its respective side-broom in a direction of rotation to sweep at least a portion of the debris on the surface being swept into an area between the first and second side-brooms;

a suction-inlet at or adjacent a first side of the vehicle and another suction-inlet at or adjacent a second side of the vehicle, each of the suction-inlets connected through a respective air-flow valve to a debris hopper, each air-flow valve operable between a substantially open position and a substantially closed position;

a fan for creating an air flow through the debris hopper and at least one of the suction-inlets when the valve associated with the at least one suction-inlet is in its substantially open position;

a primary material-transfer broom having a respective motor for rotating the primary material-transfer broom about a respective axis of rotation in a selected one of a first direction of rotation for transfer of at least a portion of the debris in a first direction and a second direction of rotation for transfer of at least a portion of the debris in a second direction;

a secondary material-transfer broom having a respective motor for rotating the secondary material-transfer broom about an axis of rotation in a selected one of a first direction of rotation and a second direction of rotation;

a pivotable support structure having the secondary material-transfer broom mounted thereon and movable between first and second positions;

the pivotable support structure moved to its first position and the secondary material-transfer broom rotated in its first direction of rotation to brush debris provided by the primary material-transfer broom toward the first suction-inlet for pickup thereby when the primary material-transfer broom is rotated in its first direction of rotation, and the pivotable support structure moved to its second position and the secondary material-transfer broom rotated in its second direction of rotation to brush debris provided by the primary material-transfer broom toward the second suction-inlet for pickup thereby when the primary material-transfer broom is rotated in its second direction of rotation.

18. The sweeping vehicle system of clause 17, further including:

a second secondary material-transfer broom having a respective motor for rotating the second secondary material-transfer broom about a respective axis of rotation in a selected one of a first direction of rotation and a second direction of rotation, the second secondary material-transfer broom mounted on the pivotable support structure for movement between a first position in which the secondary material-transfer brooms are positioned for brushing debris provided thereto by the primary material-transfer broom in a direction for pickup by the first suction-inlet when the secondary material-transfer brooms are rotated in their first direction of rotation, and a second position in which the secondary material-transfer brooms are positioned for brushing debris provided thereto by the primary material-transfer broom in a direction for pickup by the second suction-inlet when the secondary material-transfer brooms are rotated in their second direction of rotation.

19. A sweeper vehicle having a direction of travel, including: a first side-broom;

a second side-broom spaced apart from the first side-broom; and at least one material-transfer broom disposed aft of the side-brooms with respect to the direction of travel;

wherein the side-brooms and the at least one material-transfer broom are operable in a plurality of modes for sweeping debris on a roadway as the vehicle proceeds in the direction of travel.

20. The sweeper vehicle of clause 19 wherein:

each of the first and second side-brooms is configurable in an extended position and a retracted position; and the at least one material-transfer broom is rotatable in two different directions.

21. The sweeper vehicle of clause 20 wherein the plurality of modes includes a mode wherein:

the first side-broom is in the extended position;

the second side-broom is in the retracted position; and the at least one material-transfer broom rotates in a first direction and is configured to receive debris from at least one of the side-brooms.

22. The sweeper vehicle of clause 20 wherein the plurality of modes includes a mode wherein:

the first side-broom is in the retracted position;

the second side-broom is in the extended position; and the at least one material-transfer broom rotates in a second direction and is configured to receive debris from at least one of the side-brooms.

23. The sweeper vehicle of clause 20 wherein the at least one material-transfer broom includes first and second material-transfer brooms and the plurality of modes includes a mode wherein:

the first side-broom rotates in a first direction;

the second side-broom rotates in a second direction opposite the first direction;

the first material-transfer broom rotates in the first direction and is configured to receive debris from at least one of the side-brooms; and the second material-transfer broom rotates in the first direction and is configured to receive debris from the first material-transfer broom.

24. The sweeper vehicle of clause 23 wherein the first and second material-transfer brooms are mounted to a swing-arm that is pivotable about a substantially vertical axis.

25. The sweeper vehicle of clause 23 further including a third material-transfer broom that rotates in the first direction and is configured to receive debris from the second material-transfer broom.

6. The sweeper vehicle of clause 19 wherein the at least one material-transfer broom is configured for rotation about a substantially vertical axis.

27. The sweeper vehicle of clause 19 further including at least one suction-inlet, wherein the at least one material-transfer broom is configured to sweep at least some of the debris toward the at least one suction-inlet.

28. The sweeper vehicle of clause 27 wherein the at least one suction-inlet includes a first suction-inlet and a second suction-inlet spaced apart from the first suction-inlet.

29. The sweeper vehicle of clause 28 wherein the plurality of modes includes:

a first mode wherein one of the first and second suction-inlets is operative for suctioning debris and the other of the first and second suction-inlets is not operative for suctioning debris; and a second mode wherein both of the first and second suction-inlets are operative for suctioning debris.

30. The sweeper vehicle of clause 29 wherein:

the at least one material-transfer broom includes a plurality of material-transfer brooms; and at least one of the plurality of material-transfer brooms does not rotate in the first mode.

31. The sweeper vehicle of clause 20 wherein the two different directions include clockwise and counterclockwise from a top plan view perspective.

32. The sweeper vehicle of clause 19 wherein the at least one material-transfer broom is configured to sweep at least some of the debris onto a conveyor for transport into a debris hopper.

33. A sweeper vehicle having a direction of travel, including:

a first broom disposed proximate a first side of the vehicle;

a second broom disposed proximate a second side of the vehicle;

each of the first and second brooms being configured to rotate about a substantially vertical axis and sweep debris inboard from the respective side of the vehicle; and a third broom disposed aft of the first and second brooms with respect to the direction of travel and configured to receive at least some of the debris from at least one of the first and second brooms as the vehicle moves in the direction of travel;

the third broom being further configured to rotate about a substantially vertical axis and sweep at least some of the debris toward at least one suction-inlet as the vehicle moves in the direction of travel;

a debris hopper; and an air flow system including a fan operable for creating an air flow sufficient to transport at least some of the debris from the at least one suction-inlet to the debris hopper.

34. The sweeper vehicle of clause 33 wherein the third broom is configured to rotate in a first direction in a first mode and the third broom is configured to rotate in a second direction in a second mode.

35. The sweeper vehicle of clause 34 wherein the at least one suction-inlet includes a first suction-inlet disposed aft of the first broom and a second suction-inlet disposed aft of the second broom;

wherein the first suction-inlet is not operative for suctioning debris in the first mode and the first suction-inlet is operative for suctioning debris in the second mode; and wherein the second suction-inlet is operative for suctioning debris in the first mode and the second suction-inlet is not operative for suctioning debris in the second mode.

36. The sweeper vehicle of clause 35 wherein:

the first broom is configured in a retracted position in the first mode and the first broom is configured in an extended position in the second mode; and the second broom is configured in an extended position in the first mode and the second broom is configured in a retracted position in the second mode.

37. A sweeper vehicle having a direction of travel, including:

a first broom disposed proximate a first side of the vehicle;

a second broom disposed proximate a second side of the vehicle;

each of the first and second brooms being configured to rotate about a substantially vertical axis and sweep debris inboard from the respective side of the vehicle;

a third broom disposed aft of the first and second brooms with respect to the direction of travel and configured to receive at least some of the debris from at least one of the first and second brooms as the vehicle moves in the direction of travel;

a fourth broom disposed aft of the third broom with respect to the direction of travel;

a fifth broom disposed aft of the third broom with respect to the direction of travel;

each of the third, fourth, and fifth brooms being further configured to rotate about a substantially vertical axis;

a first suction-inlet disposed aft of the first broom with respect to the direction of travel;

a second suction-inlet disposed aft of the second broom with respect to the direction of travel;

a debris hopper; and an air flow system including a fan operable for creating an air flow sufficient to transport at least some of the debris from the second suction-inlet to the debris hopper in a first mode and from the first suction-inlet to the debris hopper in a second mode;

the third broom being further configured to sweep at least some of the debris toward the fifth broom in the first mode and the third broom being further configured to sweep at least some of the debris toward the fourth broom in the second mode;

the fourth broom being further configured to sweep at least some of the debris toward the first suction-inlet in the second mode;

the fifth broom being further configured to sweep at least some of the debris toward the second suction-inlet in the first mode.

38. The sweeper vehicle of clause 37 wherein the third, fourth, and fifth brooms are arranged in a triad configuration.

39. The sweeper vehicle of clause 38 further including a third mode wherein:

the fourth broom is further configured to sweep at least some of the debris toward the first suction-inlet;

the fifth broom is further configured to sweep at least some of the debris toward the second suction-inlet; and the fan is operable for creating an air flow sufficient to transport at least some of the debris from the first suction-inlet to the debris hopper and from the second suction-inlet to the debris hopper.

40. The sweeper vehicle of clause 39 wherein, from a top plan view perspective, in the third mode:

the third broom is configured to rotate in a clockwise direction;

the fourth broom is configured to rotate in a counterclockwise direction; and the fifth broom is configured to rotate in a clockwise direction.

41. The sweeper vehicle of clause 37 further including:

a sixth broom intermediate the third and fourth brooms and configured to receive at least some of the debris from the third broom and sweep at least some of the debris toward the fourth broom in the second mode; and a seventh broom intermediate the third and fifth brooms and configured to receive at least some of the debris from the third broom and sweep at least some of the debris toward the fifth broom in the first mode.

42. A sweeper vehicle having a direction of travel, including:

a first broom and a second broom spaced laterally from the first broom with respect to the direction of travel;

each of the first and second brooms being configured to sweep debris in an inboard direction;

a third broom disposed aft of the first and second brooms with respect to the direction of travel and configured to receive at least some of the debris from at least one of the first and second brooms as the vehicle moves in the direction of travel;

a fourth broom disposed aft of the third broom with respect to the direction of travel and being pivotable between a first position in a first mode and a second position in a second mode;

a first suction-inlet disposed aft of the first broom with respect to the direction of travel;

a second suction-inlet disposed aft of the second broom with respect to the direction of travel;

a debris hopper; and an air flow system including a fan operable for creating an air flow sufficient to transport at least some of the debris from the second suction-inlet to the debris hopper in the first mode and from the first suction-inlet to the debris hopper in the second mode;

the fourth broom being further configured to receive at least some of the debris from the third broom and sweep at least some of the debris toward the second suction-inlet in the first mode and toward the first suction-inlet in the second mode.

43. The sweeper vehicle of clause 42 further including:

a fifth broom intermediate the third and fourth brooms, the fifth broom being configured to receive at least some of the debris from the third broom and sweep at least some of the debris toward the fourth broom.

44. The sweeper vehicle of clause 43 wherein each of the third, fourth, and fifth brooms is configured to rotate about a substantially vertical axis.

45. The sweeper vehicle of clause 44 wherein each of the third, fourth, and fifth brooms is configured to rotate in a clockwise direction from a top plan view perspective in the first mode.

46. The sweeper vehicle of clause 44 wherein each of the third, fourth, and fifth brooms is configured to rotate in a counterclockwise direction from a top plan view perspective in the second mode.

47. A sweeper vehicle for moving in a direction of travel to remove debris from a roadway surface being swept, the vehicle having a longitudinal axis defining a vehicle first side and a vehicle second side, including:

at least a first and a second side-broom mounted to the vehicle, each side-broom movable between a retracted position and an extended position, each of the side-brooms having a motor for rotating its respective side-broom in a direction of rotation to sweep at least a portion of the debris on the surface being swept into an area between the first and second side-brooms;

a first suction-inlet at or adjacent a first side of the vehicle and a second suction-inlet at or adjacent a second side of the vehicle, each suction-inlet connected through a respective air-flow valve to a debris hopper, each air-flow valve operable between a substantially open position and a substantially closed position;

a fan for creating an air flow through the debris hopper and at least one of the suction-inlets when the valve associated with the at least one suction-inlet is in its substantially open position;

a primary material-transfer broom having a respective motor for rotating the primary material-transfer broom about an axis of rotation in a selected one of a first direction of rotation and a second direction of rotation;

a first secondary material-transfer broom having a respective motor for rotating the first secondary material-transfer broom about an axis of rotation in a first direction of rotation for transferring at least a portion of the debris in a direction for pickup by the first suction-inlet as the sweeper vehicle moves in the direction of travel;

a second secondary material-transfer broom having a respective motor for rotating the second secondary material-transfer broom about an axis of rotation in a second direction of rotation for transferring at least a portion of the debris in a direction for pickup by the second suction-inlet as the sweeper vehicle moves in the direction of travel;

the primary material-transfer broom rotatable in a selected one of a first direction of rotation to transfer at least a portion of the debris to the first secondary material-transfer broom and a second direction of rotation to transfer at least a portion of the debris to the second secondary material-transfer broom;

the primary material-transfer broom positioned with its axis of rotation on or adjacent the longitudinal axis of the vehicle;

the first secondary material-transfer broom positioned with its axis of rotation offset a first selected distance from the longitudinal axis on the vehicle first side, the first selected distance such that the first secondary material-transfer broom receives at least a portion of debris swept thereto by the primary material-transfer broom when the primary material-transfer broom is rotated in its first direction of rotation;

the second secondary material-transfer broom positioned with its axis of rotation offset a second selected distance from the longitudinal axis on the vehicle second side, the second selected distance such that the second secondary material-transfer broom receives at least a portion of debris swept thereto by the primary material-transfer broom when the primary material-transfer broom is rotated in its second direction of rotation.

48. The sweeper vehicle of any one of clauses 1 to 47 wherein each of the brooms is configured to rotate about a substantially vertical axis.

49. The sweeper vehicle of any one of clauses 1 to 47 wherein at least one of the brooms is configured to rotate about an axis that is not substantially vertical.

50. The sweeper vehicle of any one of clauses 1 to 49 wherein at least one of the brooms is tiltable manually, selectively, automatically, or a combination thereof.

51. The sweeper vehicle of any one of clauses 1 to 50 wherein a position, a rotation, or both a position and a rotation of at least one of the brooms is controlled by a programmed computer processor.

52. The sweeper vehicle of any one of clauses 1 to 51 wherein a position, an operational state, or both a position and an operational state of one or more suction-inlets are controlled by a programmed computer processor.

53. The sweeper vehicle of any one of clauses 1 to 52 wherein at least one of the brooms is raised from the roadway surface and not rotated during at least one mode of operation.

54. The sweeper vehicle of any one of clauses 1 to 53 wherein at least one suction-inlet is raised from the roadway surface and not operated for suctioning during at least one mode of operation.

55. The sweeper vehicle of any one of clauses 1 to 54 wherein at least one suction-inlet creates a suctioned stripe on the roadway surface.

56. The sweeper vehicle of any one of clauses 1 to 55 wherein one or more of the brooms creates a swept stripe on the roadway surface.

As will be apparent to those skilled in the art, various changes and modifications may be made to the illustrated embodiments of the present invention without departing from the spirit and scope of the invention as defined in the appended claims and their legal equivalent. Among other things, any feature described for one embodiment may be used in any other embodiment, and any feature described herein may be used independently or in combination with other features. Also, unless the context indicates otherwise, it should be understood that when a component is described herein as being mounted to another component, such mounting may be direct with no intermediate components or indirect with one or more intermediate components. Although the side-brooms and material-transfer brooms are generally described herein as having a substantially round shape in plan or bottom view, such brooms may have any suitable shape (e.g., oval, polygonal, irregular, or a combination thereof). Similarly, although the side-brooms and material-transfer brooms are generally described herein as being configured for rotation about a substantially vertical axis, in some embodiments, one or more of such brooms may be configured for another type of motion, e.g., vibratory, oscillatory, reciprocating, random orbit, or a combination thereof, either in lieu of or in addition to rotation as described herein. Likewise, although the systems described herein have been illustrated in the context of a vacuum sweeper, the features described herein may be used in other types of sweepers as well. The scope of the invention is defined by the attached claims and other claims that may be drawn to this invention, considering the doctrine of equivalents, and is not limited to the specific examples described herein.

What is claimed is:

1. A sweeper vehicle for moving in a direction of travel to remove debris from a roadway surface being swept, comprising:

at least a first and a second side-broom mounted to the vehicle, each side-broom movable between a retracted position and an extended position, each of the side-brooms having a motor for rotating its respective side-broom in a direction of rotation to sweep at least a portion of the debris on the surface being swept into an area between the first and second side-brooms;

a first suction-inlet at or adjacent a first side of the vehicle and a second suction-inlet at or adjacent a second side of the vehicle, each suction-inlet connected through a respective air-flow valve to a debris hopper, each air-flow valve operable between a substantially open position and a substantially closed position;

a fan for creating an air flow through the debris hopper and at least one of the suction-inlets when the valve associated with the at least one suction-inlet is in its substantially open position;

a primary material-transfer broom having a respective motor for rotating the primary material-transfer broom about an axis of rotation;

a first secondary material-transfer broom having a respective motor for rotating the first secondary material-transfer broom about an axis of rotation in a first direction of rotation for transferring at least a portion of the debris in a direction for pickup by the first suction-inlet as the sweeper vehicle moves in the direction of travel;

a second secondary material-transfer broom having a respective motor for rotating the second secondary material-transfer broom about an axis of rotation in a second direction of rotation for transferring at least a portion of the debris in a direction for pickup by the second suction-inlet as the sweeper vehicle moves in the direction of travel;

the primary material-transfer broom rotatable in a selected one of a first direction of rotation to transfer at least a portion of the debris to the first secondary material-transfer broom and a second direction of rotation to transfer at least a portion of the debris to the second secondary material-transfer broom.

2. The sweeper vehicle of claim 1, further comprising:

a stored-program controlled processor for controlling the side-brooms, the material-transfer brooms, and the air-flow valves to organize the side-brooms, material-transfer brooms, and air-flow valves into at least two operational states.

3. The sweeper vehicle of claim 2, the sweeper vehicle having a first operational state, comprising:

the first side-broom positioned at or near its retracted position and the second side-broom positioned at or near its extended position, both side-brooms rotated in a respective direction to sweep debris into an area between the first and second side-brooms, and the primary material-transfer broom and the second secondary material-transfer broom rotated to sweep debris in a direction for pickup by the second suction-inlet, the air-flow valve operatively associated with the second suction-inlet substantially opened and the air-flow valve operatively associated with the first suction-inlet substantially closed.

4. The sweeper vehicle of claim 3, wherein:

the first secondary material-transfer broom moved to a raised position out of engagement with the surface being swept.

5. The sweeper vehicle of claim 2, the sweeper vehicle having a second operational state, comprising:

the first side-broom positioned at or near its extended position and the second side-broom positioned at or near its retracted position, both side-brooms rotated in respective directions to sweep debris into an area between the first and second side-brooms, and the primary material-transfer broom and the first secondary material-transfer broom rotated to sweep debris in a direction for pickup by the first suction-inlet as the vehicle moves in the direction of travel, the air-flow valve operatively associated with the second suction-inlet substantially closed and the air-flow valve operatively associated the first suction-inlet substantially open.

6. The sweeper vehicle of claim 5, wherein:

the second secondary material-transfer broom is moved to a raised position out of engagement with the surface being swept.

7. The sweeper vehicle of claim 2, the sweeper vehicle having a third operational state, comprising:

the first and second side-brooms positioned at or near their respective extended positions and each side-broom respectively rotated in a direction to sweep debris into an area between the first and second side-brooms, the primary material-transfer broom and one of the secondary material-transfer brooms rotated in the same direction to sweep debris in a direction for pickup by one of the first and second suction-inlets and the other of the secondary material-transfer brooms rotated a direction to sweep debris in a direction for pickup by the other of the first and second suction-inlets, the air-flow valve operatively associated with the first suction-inlet substantially open and the air-flow valve operatively associated with the second suction-inlet substantially open.

8. The sweeper vehicle of claim 2, the sweeper vehicle further comprising:

a first intermediate material-transfer broom mounted intermediate the primary material-transfer broom and the first secondary material-transfer broom and operationally slaved to the first secondary material-transfer broom for rotation in the same direction therewith, and a second intermediate material-transfer broom mounted intermediate the primary material-transfer broom and the second secondary material-transfer broom and operationally slaved to the second secondary material-transfer broom for rotation in the same direction therewith.

9. The sweeper vehicle of claim 2, the sweeper vehicle further comprising an air flow recirculation system comprising:

an air flow diverter for diverting a portion of the air flow from an outlet portion of the fan into an air flow conduit for discharge therefrom in a vicinity of a selected one of the first and second suction-inlets so that at least a portion of the air flow discharged is introduced into the selected suction-inlet.

10. The sweeper vehicle of claim 2, further comprising a debris exhaust system comprising:

an air flow diverter for diverting a portion of the air flow from an outlet portion of the fan into an air flow conduit for discharge therefrom onto the surface being swept.

11. A sweeper vehicle having a direction of travel, comprising:

a first broom disposed proximate a first side of the vehicle;

a second broom disposed proximate a second side of the vehicle;

each of said first and second brooms being configured to rotate about a substantially vertical axis and sweep debris inboard from the respective side of the vehicle;

a third broom disposed aft of said first and second brooms with respect to said direction of travel and configured to receive at least some of the debris from at least one of said first and second brooms as the vehicle moves in the direction of travel;

a fourth broom disposed aft of said third broom with respect to said direction of travel;

a fifth broom disposed aft of said third broom with respect to said direction of travel;

each of said third, fourth, and fifth brooms being further configured to rotate about a substantially vertical axis;

a first suction-inlet disposed aft of said first broom with respect to said direction of travel;

a second suction-inlet disposed aft of said second broom with respect to said direction of travel;

a debris hopper; and an air flow system comprising a fan operable for creating an air flow sufficient to transport at least some of the debris from said second suction-inlet to said debris hopper in a first mode and from said first suction-inlet to said debris hopper in a second mode;

said third broom being further configured to sweep at least some of the debris toward said fifth broom in said first mode and said third broom being further configured to sweep at least some of the debris toward said fourth broom in said second mode;

said fourth broom being further configured to sweep at least some of the debris toward said first suction-inlet in said second mode;

said fifth broom being further configured to sweep at least some of the debris toward said second suction-inlet in said first mode.

12. The sweeper vehicle of claim 11 wherein said third, fourth, and fifth brooms are arranged in a triad configuration.

13. The sweeper vehicle of claim 12 further comprising a third mode wherein:

said fourth broom is further configured to sweep at least some of the debris toward said first suction-inlet;

said fifth broom is further configured to sweep at least some of the debris toward said second suction-inlet; and said fan is operable for creating an air flow sufficient to transport at least some of the debris from said first suction-inlet to said debris hopper and from said second suction-inlet to said debris hopper.

14. The sweeper vehicle of claim 13 wherein, from a top plan view perspective, in said third mode:

said third broom is configured to rotate in a clockwise direction;

said fourth broom is configured to rotate in a counter-clockwise direction; and said fifth broom is configured to rotate in a clockwise direction.

15. The sweeper vehicle of claim 11 further comprising:

a sixth broom intermediate said third and fourth brooms and configured to receive at least some of the debris from said third broom and sweep at least some of the debris toward said fourth broom in said second mode; and a seventh broom intermediate said third and fifth brooms and configured to receive at least some of the debris from said third broom and sweep at least some of the debris toward said fifth broom in said first mode.

16. A sweeper vehicle for moving in a direction of travel to remove debris from a roadway surface being swept, the vehicle having a longitudinal axis defining a vehicle first side and a vehicle second side, comprising:

at least a first and a second side-broom mounted to the vehicle, each side-broom movable between a retracted position and an extended position, each of the side-brooms having a motor for rotating its respective side-broom in a direction of rotation to sweep at least a portion of the debris on the surface being swept into an area between the first and second side-brooms;

a first suction-inlet at or adjacent a first side of the vehicle and a second suction-inlet at or adjacent a second side of the vehicle, each suction-inlet connected through a respective air-flow valve to a debris hopper, each air-flow valve operable between a substantially open position and a substantially closed position;

a fan for creating an air flow through the debris hopper and at least one of the suction-inlets when the valve associated with the at least one suction-inlet is in its substantially open position;

a primary material-transfer broom having a respective motor for rotating the primary material-transfer broom about an axis of rotation in a selected one of a first direction of rotation and a second direction of rotation;

a first secondary material-transfer broom having a respective motor for rotating the first secondary material-transfer broom about an axis of rotation in a first direction of rotation for transferring at least a portion of the debris in a direction for pickup by the first suction-inlet as the sweeper vehicle moves in the direction of travel;

a second secondary material-transfer broom having a respective motor for rotating the second secondary material-transfer broom about an axis of rotation in a second direction of rotation for transferring at least a portion of the debris in a direction for pickup by the second suction-inlet as the sweeper vehicle moves in the direction of travel;

the primary material-transfer broom rotatable in a selected one of a first direction of rotation to transfer at least a portion of the debris to the first secondary material-transfer broom and a second direction of rotation to transfer at least a portion of the debris to the second secondary material-transfer broom;

the primary material-transfer broom positioned with its axis of rotation on or adjacent the longitudinal axis of the vehicle;

the first secondary material-transfer broom positioned with its axis of rotation offset a first selected distance from the longitudinal axis on the vehicle first side, the first selected distance such that the first secondary material-transfer broom receives at least a portion of debris swept thereto by the primary material-transfer broom when the primary material-transfer broom is rotated in its first direction of rotation;

the second secondary material-transfer broom positioned with its axis of rotation offset a second selected distance from the longitudinal axis on the vehicle second side, the second selected distance such that the second secondary material-transfer broom receives at least a portion of debris swept thereto by the primary material-transfer broom when the primary material-transfer broom is rotated in its second direction of rotation.

* * * * *